US007111755B2

(12) United States Patent
Koyama et al.

(10) Patent No.: US 7,111,755 B2
(45) Date of Patent: Sep. 26, 2006

(54) LIQUID DISCHARGE METHOD AND APPARATUS AND DISPLAY DEVICE PANEL MANUFACTURING METHOD AND APPARATUS

(75) Inventors: Yoshihiro Koyama, Kanagawa (JP); Seiichirou Satomura, Kanagawa (JP); Makoto Akahira, Kanagawa (JP); Hidehiko Fujimura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/607,513

(22) Filed: Jun. 27, 2003

(65) Prior Publication Data

US 2004/0023567 A1 Feb. 5, 2004

(30) Foreign Application Priority Data

Jul. 8, 2002 (JP) ..... 2002-199213

(51) Int. Cl.
*B41J 2/01* (2006.01)

(52) U.S. Cl. ..... 222/1; 427/466; 427/469; 439/894

(58) Field of Classification Search ..... 427/466, 427/469; 439/894; 222/1
See application file for complete search history.

(56) References Cited

U.S. PATENT DOCUMENTS

| | | | | |
|---|---|---|---|---|
| 4,963,882 A | | 10/1990 | Hickman | 347/41 |
| 5,023,110 A | | 6/1991 | Nomura et al. | |
| 5,036,337 A | | 7/1991 | Rezanka | 347/57 |
| 5,670,205 A | | 9/1997 | Miyazaki et al. | |
| 5,948,576 A | * | 9/1999 | Shirota et al. | 430/7 |
| 6,060,113 A | | 5/2000 | Banno et al. | |
| 6,364,450 B1 | | 4/2002 | Yamaguchi et al. | |
| 6,497,474 B1 | * | 12/2002 | Irinoda et al. | 347/54 |
| 6,500,485 B1 | | 12/2002 | Yamaguchi et al. | |
| 6,511,158 B1 | * | 1/2003 | Tanaka | 347/54 |
| 6,596,988 B1 | * | 7/2003 | Corso et al. | 250/288 |
| 6,629,741 B1 | | 10/2003 | Okuda et al. | |
| 6,673,386 B1 | * | 1/2004 | Komyoji et al. | 427/8 |
| 2001/0028916 A1 | * | 10/2001 | Akahira | 427/8 |
| 2002/0044163 A1 | * | 4/2002 | Shigemura | 347/1 |

FOREIGN PATENT DOCUMENTS

| | | |
|---|---|---|
| JP | 59-75205 | 4/1984 |
| JP | 63-235901 | 9/1988 |
| JP | 1-217320 | 8/1989 |
| JP | 2-56822 | 2/1990 |
| JP | 5-96730 | 4/1993 |
| JP | 8-179110 | 7/1996 |
| JP | 9-281324 | 10/1997 |
| JP | 11-354015 | 12/1999 |
| JP | 2000-89019 | 3/2000 |

* cited by examiner

*Primary Examiner*—J. Casimer Jacyna
(74) *Attorney, Agent, or Firm*—Fitzpatrick, Cella, Harper & Scinto

(57) ABSTRACT

It is an object of this invention to make the amounts of liquid discharged from the nozzles of a liquid discharge head uniform. To achieve this object, there is provided a liquid discharge apparatus for discharging a liquid to a medium using a liquid discharge head having a plurality of nozzles for discharging the liquid, characterized by comprising a discharge amount changing device which can change the amounts of liquid discharged from the respective nozzles of the liquid discharge head independently of each of the plurality of nozzles, the discharge amount changing device including a voltage control device which can change a driving voltage value of a driving pulse to be supplied to each of the plurality of nozzles.

32 Claims, 42 Drawing Sheets

NOTE THAT FOREGOING CHART REPRESENTS REFERENCE EXAMPLE OF 2-PLS DRIVING
V1, V2, V3: SET DRIVING SIGNAL VOLTAGE, Δv1, Δv2 : CORRECTION VOLTAGE

FIG. 21

1. DATA MEASUREMENT WITHOUT CORRECTION OF DISCHARGE AMOUNT OF HEAD 1-1 MEASUREMENT OF DISCHARGE AMOUNT OF HEAD AND DRIVING CONDITION CHARACTERISTICS (1) CHANGE DRIVING CONDITIONS AT ARBITRARY TWO POINTS OR MORE AND PERFORM PRINTING UPON SETTING OF RESPECTIVE CONDITIONS

↓

(2) MEASURE DISCHARGE AMOUNT OF EACH NOZZLE FROM PRINTING RESULT IN (1)

↓

(3) CALCULATE CORRECTION SENSITIVITY CORRESPONDING TO DRIVING CONDITION FOR EACH NOZZLE FROM CHANGE IN DISCHARGE AMOUNT WITH RESPECT TO DRIVING CONDITION FOR EACH NOZZLE ON THE BASIS OF RESULT IN (2) :

$K = (Vd2 - Vd1) / (V2 - V1)$

WHERE K : CORRECTION SENSITIVITY, AND Vd1 AND Vd2 : DISCHARGE AMOUNTS AT ARBITRARY POINTS 1-2 CALCULATION OF CORRECTION VALUE (4) CALCULATE AVERAGE VALUE OF ALL NOZZLES FROM CORRECTION SENSITIVITY IN (3) AND DISCHARGE AMOUNT OF EACH NOZZLE UNDER DRIVING CONDITION IN PRINTING OPERATION, CALCULATE DIFFERENCE BETWEEN AVERAGE VALUE AND DISCHARGE AMOUNT OF EACH NOZZLE AND CORRECTION VALUE, AND SET CORRECTION VALUE CALCULATED FROM RESULTANT CORRECTION AMOUNT AND CORRECTION SENSITIVITY IN (3):

$VdX = \Sigma (Vdn1, ..., VdnN) / N$

WHERE VdX : AVERAGE DISCHARGE AMOUNT AND Vdn1 AND VdnN : DISCHARGE AMOUNT OF EACH NOZZLE AT ARBITRARY DRIVING VOLTAGES $Vdn1Y = K^*(Vdn1 - VdX)$ $Vdn2Y = K^*(Vdn2 - VdX)$ $\vdots$ $VdnNY = K^*(VdnN - VdX)$ WHERE Vd1Y,..., VdnY: CORRECTION VALUE FOR EACH NOZZLE

↓

(5) SET CORRECTION VALUE IN (4) TO DRIVING CONDITION AND PERFORM PRINTING OPERATION

2. DISCHARGE AMOUNT CORRECTION FOR EACH NOZZLE OF HEAD

↓

(6) REPEAT (4) AND (5) IF IT IS DETERMINED FROM PRINTING RESULT THAT DISCHARGE AMOUNT IS NOT TARGET DISCHARGE AMOUNT

↓

TERMINATE DISCHARGE AMOUNT CONTROL PROCESSING

LIQUID DISCHARGE METHOD AND APPARATUS AND DISPLAY DEVICE PANEL MANUFACTURING METHOD AND APPARATUS

FIELD OF THE INVENTION

The present invention relates to a technique of forming or printing a predetermined pattern by using a liquid discharge head (e.g., an ink-jet head).

BACKGROUND OF THE INVENTION

In general, liquid crystal display devices are mounted in personal computers, wordprocessors, pachinko machines, vehicle navigation systems, small-size TV sets, and the like, and have recently been in increasing demand. However, liquid crystal display devices are expensive, and hence demand for cost reduction has increased year by year. Of the components of a liquid crystal display device, a color filter exhibits a high cost ratio, and the demand for a reduction in the cost of the color filter has increased.

A color filter used in a liquid crystal display device is formed by arraying filter elements colored in, for example, red (R), green (G), and blue (B) on a transparent substrate. A black matrix (BM) for blocking light is provided around each filter element to improve the display contrast of the liquid crystal display device. BMs range from a BM using a Cr metal thin film to a recent resin BM using a black resin.

An overcoat layer (protective layer) made of an acrylic-based resin or epoxy-based resin and having a thickness of 0.5 to 2 μm is formed on a colored layer including a filter element to, for example, improve smoothness. A transparent electrode (ITO) film is further formed on this overcoat layer.

Various conventional methods of coloring the filter elements of a color filter are known, including, for example, a dyeing method, pigment dispersion method, electrodeposition method, and printing method.

In the dyeing method, a water-soluble polymer material as a dyeing material is formed on a glass substrate and patterned into a predetermined shape by photolithography. The obtained pattern is dipped in a dyeing solution. This process is repeated for R, G, and B to obtain color filters.

In the pigment dispersion method, a pigment-dispersed photosensitive resin layer is formed on a transparent substrate by a spin coater or the like. The resultant layer is then patterned. This process is performed once for each of R, G, and B, i.e., repeated a total of three times for R, G, and B, thereby obtaining R, G, and B color filters.

In the electrodeposition method, a transparent electrode is patterned on a substrate, and the resultant structure is dipped in an electrodeposition coating fluid containing a pigment, resin, electrolyte, and the like to be colored. This process is repeated for R, G, and B to form color filters.

In the printing method, a thermosetting resin in which a pigment-based coloring material is dispersed is colored by offset printing. This process is repeated for R, G, and B to form color filters.

The above color filter manufacturing methods have a common feature that the same process must be repeated three times to color layers in three colors, i.e., R, G, and B, and hence the cost is high. In addition, since a large number of processes are required, the yield decreases.

In order to eliminate these drawbacks, color filter manufacturing methods using an ink-jet system are disclosed in Japanese Patent Laid-Open Nos. 59-75205, 63-235901, and 1-217320. The ink-jet system is a method of forming filter elements by injecting coloring materials containing R, G, B color materials onto a transparent substrate using an ink-jet head and drying/fixing the coloring materials. In this method, since R, G, and B portions can be formed at once, simplification of the manufacturing process and a reduction in cost can be achieved. In addition, since the number of steps is smaller than those in the dyeing method, pigment dispersion method, electrodeposition method, printing method, and the like, an increase in yield can be achieved.

In a color filter used in a general liquid crystal display device, black matrix opening portions (i.e., pixels) for partitioning the respective pixels are rectangular, whereas ink droplets discharged from an ink-jet head are almost circular. It is therefore difficult to discharge ink in an amount required for one pixel at once and uniformly spread the ink in the entire opening portion of the black matrix. For this reason, a plurality of ink droplets are discharged to one pixel on a substrate to color it while the ink-jet head is scanned relative to the substrate.

As variations in the amounts of ink filled in the respective pixels are small, a high-quality color filter with reduced unevenness can be manufactured.

The amount of ink discharged from an ink-jet head may vary among nozzles even in discharge driving operation under the same discharge driving condition owing to variations in the structures of nozzles constituting the head or structures associated with discharging operation, driving mechanisms, and driving characteristics. In this case, even if the same numbers of ink droplets are discharged to the respective pixels, the amounts of ink filled in the respective pixels vary because of the use of different nozzles. The variations in the amounts of ink filled lead to unevenness among the pixels, resulting in reductions in the quality and yield of color filters.

In order to solve this problem of density unevenness, the following two methods (bit correction and shading correction) have been adopted. Consider here an ink-jet head for discharging ink using heat energy.

A method (to be referred to as bit correction hereinafter) of correcting the differences in ink discharge amount between the respective nozzles of an ink-jet head IJH which has a plurality of ink discharge nozzles shown in FIGS. 11 to 13 as disclosed in Japanese Patent Laid-Open No. 9-281324 will be described first.

First of all, as shown in FIG. 11, ink is discharged from, for example, three nozzles, i.e., nozzle 1, nozzle 2, and nozzle 3, of the ink-jet head IJH onto a predetermined substrate P, and the sizes of ink dots formed on the substrate P by the ink discharged from the respective nozzles are measured, thereby measuring the amounts of ink discharged from the respective nozzles. In this case, the width of a heat pulse applied to the heater of each nozzle is kept constant, and the width of a pre-heat pulse is changed. With this operation, a curve like the one shown in FIG. 12 can be obtained, which represents the relationship between the pre-heat pulse width and the ink discharge amount. Assume that all the amounts of ink discharged from the respective nozzles are to be unified to 20 ng. In this case, it is obvious from the curve shown in FIG. 12 that the width of a pre-heat pulse applied to nozzle 1 is 1.0 μs; to nozzle 2, 0.5 μs; and to nozzle 3, 0.75 μs. By applying pre-heat pulses with these widths to the heaters of the respective nozzles, all the amounts of ink discharged from the respective nozzles can be unified to 20 ng, as shown in FIG. 13. Correcting the amounts of ink discharged from the respective nozzles in this manner will be referred to as bit correction.

FIGS. 14 and 15 are views showing a method (to be referred to as shading correction hereinafter) of correcting density unevenness in the scanning direction of the ink-jet head by adjusting the ink discharge density from each ink discharge nozzle. Assume that as shown in FIG. 14, when the amount of ink discharged from nozzle 3 of the ink-jet head is set as a reference, the amount of ink discharged from nozzle 1 is −10%, and that from nozzle 2 is +20%. In this case, while the ink-jet head IJH is scanned, as shown in FIG. 15, a heat pulse is applied to the heater of nozzle 1 once for nine reference clocks, a heat pulse is applied to the heater of nozzle 2 once for 12 reference clocks, and a heat pulse is applied to nozzle 3 once for 10 reference clocks. With this operation, the number of ink droplets discharged in the scanning direction is changed for each nozzle, and the ink densities in the pixels of the color filter can be made constant in the scanning direction, as shown in FIG. 14. This makes it possible to prevent density unevenness of each pixel. Correcting ink discharge density in the scanning direction in this manner will be referred to as shading correction.

As methods of reducing density unevenness, the above two methods are known. For example, in a conventional color filter colored in the respective colors in a stripe pattern like the one disclosed in Japanese Patent Laid-Open No. 8-179110, the shading method, which is the latter of the above two methods, is used to adjust the discharge pitch on a pixel array basis so as to adjust the discharge amount for one pixel array. In this striped color filter, a color mixing prevention wall is provided between color pixel arrays to prevent ink of a predetermined color discharged to one pixel array from flowing into an adjacent pixel array of a different color.

In a color filter in which no color mixing prevention wall is provided between color pixel arrays and only a BM (black matrix) is provided as a partition between pixels, unlike a color filter as described above which is colored in a stripe pattern with a color mixing prevention wall being provided between color pixel arrays, when ink is discharged in the form of a line on a pixel array basis, the ink discharged onto the water-repellent BM flows into an adjacent pixel area, resulting in difficulty in managing the amount of ink discharged into each pixel.

That is, it is difficult to control the amount of ink applied into a pixel to a predetermined amount by using a method of adjusting discharge intervals as in the above shading correction.

With an increase in the resolution of color filter pixels, the pixel area tends to decrease. This makes it more difficult to control the amount of ink filled in each pixel.

For this reason, it is important to take new measures to improve the quality of a color filter in association with density unevenness by using the method (bit correction) of making discharge amounts uniform, which is the former method of the above two density unevenness reducing methods.

More specifically, in the form of adjusting ink filling amounts on a pixel basis instead of a pixel array basis, since it is expected that the amounts of ink filled in the respective pixels can be effectively made uniform by the above bit correction, it is required to realize uniformization of ink filling amounts by the bit correction using the simplest arrangement.

The first challenge to manufacture such a high-quality color filter is how to make the amounts of liquid filled in predetermined areas (pixels) uniform by bit correction.

The amount of ink discharged from one nozzle is influenced by whether or not ink is discharged from an adjacent nozzle at the same timing; the discharge amount changes depending on whether or not ink is discharged from the adjacent nozzle at the same timing. In this specification, this phenomenon will be referred to as nozzle crosstalk. In order to make ink discharge amounts uniform and eliminate unevenness between pixels, consideration is preferably given to discharge variations due to this adjacent nozzle crosstalk.

FIG. 35 shows a measurement result on adjacent nozzle crosstalk, by which the present invention is motivated.

FIG. 35 shows how the discharge amounts of a plurality of nozzles (80 ch in this case) of the ink-jet head vary when control is performed to advance and retard the discharge timing or make nozzles discharge or not discharge ink. FIG. 35 shows, in particular, the influence of the above adjacent nozzle crosstalk on discharge amount variations. More specifically, referring to FIG. 35, the discharge amount of the Nth nozzle (ch12), of all the nozzles (80 ch), is taken into consideration, and the discharge amount of this nozzle of interest is measured. In this discharge amount measurement, a voltage for driving the nozzle of interest (ch12), its current, and its pulse waveform are kept constant in all measuring operations. FIG. 35 shows a measurement result obtained when the discharge timings of neighboring nozzles are changed with respect to the discharge timing of the nozzle of interest (ch12).

Referring to FIG. 35, reference symbol (a) denotes the discharge amount of the ch12 nozzle obtained when ink is simultaneously discharged from all the nozzles (80 ch). This discharge amount is assumed to be 100 and is plotted as a right bar graph.

Reference symbol (b) denotes the discharge amount of the ch12 nozzle obtained when ink is discharged from selected half (40 ch) of all the nozzles (80 ch). In this nozzle selection, ink is simultaneously discharged from the ch11 and ch13 nozzles adjacent to the ch12 nozzle. In this case, the discharge amount is smaller than the discharge amount (a) by 1%.

Reference symbol (c) denotes the discharge amount of the ch12 nozzle obtained when ink is discharged from 40 ch nozzles, of the 80 ch nozzles, which are different from those selected in the case of "(b)". In this nozzle selection, no ink is discharged from the ch11 and ch13 nozzles which are adjacent to the ch12 nozzle. In this case, the discharge amount is smaller than the discharge amount (a) by 5%.

Reference symbol (d) denotes the discharge amount of the ch12 nozzle obtained when ink is discharged from the same nozzles as those selected in the case of "(c)" of the 80 ch nozzles. In this nozzle selection, no ink is discharged from the ch11 and ch13 nozzles which are adjacent to the ch12 nozzle. In addition, ink is discharged from the remaining nozzles (39 ch) other than the nozzle of interest (ch12) with a delay of 10 μsec relative to the nozzle of interest (ch12). In this case, the discharge amount is smaller than the discharge amount (a) by 7% and smaller than the discharge amount (c) by 2%.

Reference symbol (e) denotes the discharge amount of the ch12 nozzle obtained when ink is discharged from only the ch12 nozzle of the 80 ch nozzles. In this nozzle selection, the discharge amount becomes smaller than the discharge amount (a) by 12%. Conversely, when ink is simultaneously discharged from all the 80 ch nozzles, the discharge amount of the ch12 nozzle is larger by 12% than that when ink is discharged from the ch12 nozzle alone.

Reference symbol (f) denotes the discharge amount of the ch12 nozzle obtained when ink is discharged from selected 40 ch nozzles, of the 80 ch nozzles, which are different from those in the case of "(d)". In this nozzle selection, ink is discharged from the ch11 and ch13 nozzles adjacent to the ch12 nozzle. In this case, ink is discharged from the remaining nozzles (39 ch) other than the nozzle of interest (ch12) with a delay of 10 μsec relative to the nozzle of interest (ch12). In this case, the discharge amount is smaller than the discharge amount (e) by 7%.

In the case of "(g)", although ink is discharged from all the nozzles (80 ch), ink is discharged from all the nozzles other than the nozzle of interest (ch12), i.e., the remaining nozzles (79 ch), with a delay of 10 μsec relative to the nozzle of interest (ch12). In this case, the discharge amount is smaller than the discharge amount (e) by 9%.

The cause of the above phenomenon can be explained as inter-nozzle crosstalk due to the propagation of the pressure wave of ink from an ink chamber 114 to each liquid channel 110. That is, as compared with the case of "(e)" wherein ink is discharged from the nozzle of interest alone, in the case of "(a)" wherein ink is simultaneously discharged from the 80 ch nozzles, pressure waves of discharged ink from the remaining nozzles (79 ch) other than the nozzle of interest (ch12) enhance discharging of ink from the nozzle of interest (ch12), resulting in an increase in discharge amount in the case of "(a)".

In the cases of "(b)" and "(c)", since ink is simultaneously discharged from 40 ch nozzles, an increase in discharge amount is smaller than that in the case wherein ink is simultaneously discharged from 80 ch nozzles. As compared with the case of "(c)", in the case of "(b)", since ink is discharged from the adjacent nozzles, the discharge amount increases to the same extent as this difference between these two cases. That is, whether or not ink is simultaneously discharged from adjacent nozzles has the greatest influence on discharging of ink from the nozzle of interest (ch12).

When the cases of "(a)", "(e)", and "(g)" are compared, it is found that the discharge amount of the nozzle of interest (ch12) changes as the discharge timing of a nozzle other than the nozzle of interest (ch12) is changed. As compared with the case of "(e)", when ink is discharged from the remaining nozzles simultaneously with the nozzle of interest as in the case of "(a)", the discharge amount increases. In contrast to this, as compared with the case of "(e)", when ink is discharged from the remaining nozzles at a timing slightly retarded from the discharge timing of the ch12 nozzle as in the case of "(g)", the discharge amount of the nozzle of interest decreases. This is because the interference phase of pressure waves produced by the remaining nozzles is reversed and acts to cancel out the discharge pressure produced by the nozzle of interest.

Likewise, when the cases of "(b)", "(e)", and "(f)" are compared, it is found that the discharge amount of the nozzle of interest changes as the discharge timing of the remaining nozzles other than the nozzle of interest is changed.

In addition, when the cases of "(b)", "(e)", and "(f)" are compared, variations in the discharge amount of the nozzle of interest (ch12) with respect to the differences in discharge timing among the remaining nozzles are smaller than those when the cases of "(a)", "(e)", and "(g)" are compared, to the extent by which the number of remaining nozzles other than the nozzle of interest (ch12) is smaller.

In addition, variations in the discharge amount of the nozzle of interest (ch12) with respect to the differences in discharge timing among the nozzles other than the nozzle of interest are influenced most by the nozzle adjacent to the nozzle of interest. When the cases of "(c)" and "(d)" are compared, nozzles separated from the nozzle of interest by three of more nozzles have some influence on the variations in discharge amount.

As described above, discharging/non-discharging of ink from nozzles other than the nozzle of interest and the discharge timing of these nozzles influence the amount of ink discharged from the nozzle of interest. However, no consideration has been given to these influences. When the number of nozzles to be used, the combination of nozzles to be used, or the discharge timing of each nozzle changes, the discharge amount of each nozzle changes. Such discharge amount variations may cause density unevenness among pixels. When, therefore, a high-quality color filter is to be manufactured, it is preferable that consideration be given to discharge amount variations due to the above adjacent nozzle crosstalk.

In addition, even if the discharge amounts of the respective nozzles are made uniform by bit correction before a pattern is formed or printed, discharge amount variations may occur due to the above adjacent nozzle crosstalk. It is therefore preferable that consideration be given to this point.

As described above, the second challenge to manufacture a color filter with higher quality is how to make the amounts of liquid filled in predetermined areas (pixels) uniform in consideration of discharge amount variations due to adjacent nozzle crosstalk.

In the above description, a color filter has been exemplified as an object to be manufactured. However, the first and second challenges arise not only in the manufacture of color filters but also in a case wherein the amount of liquid applied to a predetermined area (pixel) on a substrate must be controlled to a predetermined amount. For example, similar challenges arise in a case wherein a predetermined amount of EL (electroluminescence) material liquid is applied from a liquid discharge head (ink-jet head) to a predetermined area on a substrate to manufacture an EL display device. In addition, similar challenges arise in a case wherein a predetermined amount of conductive thin film material liquid (liquid containing a metal element) is applied to a predetermined area on a substrate to manufacture an electron-emitting device obtained by forming a conductive thin film on a substrate or a display panel including a plurality of such devices.

SUMMARY OF THE INVENTION

The present invention has therefore been made in consideration of the above problems, and has as its object to make the amounts of liquid discharged from the respective nozzles of a liquid discharge head (e.g., an ink-jet head) uniform with a simple arrangement.

It is another object of the present invention to change the liquid discharge amount of each nozzle independently with a simple arrangement.

It is still another object of the present invention to easily control the amount of liquid applied to a predetermined area (e.g., a pixel) on a substrate to be a predetermined amount, thereby making the amount of liquid applied to the predetermined area (pixel) uniform. This makes the amount of liquid filled in each predetermined area (pixel) uniform, thereby manufacturing a display device panel such as a high-quality color filter with each pixel satisfying a required characteristic, or an EL display device, electron-emitting devices, or a display panel including the electron-emitting devices.

In order to solve the above problems and achieve the above objects, according to the first aspect of the present invention, there is provided a liquid discharge apparatus for discharging a liquid to a medium using a liquid discharge head having a plurality of nozzles for discharging the liquid, characterized by comprising a discharge amount changing device which can change the amounts of liquid discharged from the respective nozzles of the liquid discharge head independently of each of the plurality of nozzles, the discharge amount changing device including a voltage control device which can change a driving voltage value of a driving pulse to be supplied to each of the plurality of nozzles.

According to the second aspect of the present invention, there is provided a liquid discharge method of discharging a liquid to a medium using a liquid discharge head having a plurality of nozzles for discharging the liquid, characterized by comprising a step of discharging the liquid from the liquid discharge head which has only nozzles connected to a discharge amount changing device which can change the amount of liquid discharged from the nozzle by changing a driving voltage value of a driving pulse to be supplied to the nozzle.

According to the third aspect of the present invention, there is provided a display device panel manufacturing apparatus for manufacturing a display device panel by discharging, onto a substrate, from a liquid discharge head having a plurality of nozzles for discharging the liquid, characterized by comprising a discharge amount changing device which can change the amounts of liquid discharged from the respective nozzles of the liquid discharge head independently of each of the plurality of nozzles, the discharge amount changing device including a voltage control device which can change a driving voltage value of a driving pulse to be supplied to each of the plurality of nozzles.

According to the fourth aspect of the present invention, there is provided a display device panel manufacturing method of manufacturing a display device panel by discharging, onto a substrate, from a liquid discharge head having a plurality of nozzles for discharging the liquid, characterized in that a display device panel is manufactured by discharging the liquid from a liquid discharge head having only nozzles connected to a discharge amount changing device which can change a driving voltage value of a driving pulse to be supplied to a nozzle.

According to the fifth aspect of the present invention, there is provided a liquid discharge apparatus including a liquid discharge head having a plurality of nozzles including a nozzle whose liquid discharge amount can be changed, characterized by comprising a discharge amount control device which changes a discharge amount control value including at least one of conditions of a voltage value and pulse width of a driving pulse to be supplied to a predetermined nozzle whose liquid discharge amount can be changed in accordance with a change in a discharging condition for adjacent nozzles adjacent to the predetermined nozzle.

According to the sixth aspect of the present invention, there is provided a liquid discharge method of discharging a liquid, to a medium, from a liquid discharge head having a plurality of nozzles including a nozzle whose liquid discharge amount can be changed, characterized by comprising a discharge amount control step of changing a discharge amount control value including at least one of conditions of a voltage value of a driving pulse to be supplied to the nozzle and a pulse width with a change in at least one of conditions of a combination of nozzles to be used, the number of nozzles to be used, presence/absence of a faulty nozzle, a direction of relative movement of the head and the medium, and a speed of the relative movement of the head and the medium.

According to the seventh aspect of the present invention, there is provided a display device panel manufacturing method of manufacturing a display device panel by discharging a liquid, to a substrate, from a liquid discharge head having a plurality of nozzles including a nozzle whose liquid discharge amount can be changed, characterized by comprising a step of changing a discharge amount control value including at least one of conditions of a voltage value of a driving pulse to be supplied to the nozzle and a pulse width with a change in at least one of conditions of a combination of nozzles to be used, the number of nozzles to be used, presence/absence of a faulty nozzle, a direction of relative movement of the head and the medium, and a speed of the relative movement of the head and the medium.

According to the above arrangements, since the discharge amount changing devices are respectively connected to a plurality of nozzles, the discharge amount of each nozzle can be independently changed. Therefore, the discharge amounts of the respective nozzles can be easily made uniform. This makes it possible to control the amount of liquid filled in a predetermined area (e.g., a pixel) to be uniform.

In addition, since driving conditions such as the driving voltage values or pulse widths of driving pulses to be applied to the respective nozzles are controlled in consideration of whether or not a liquid is discharged from adjacent nozzles or the number of nozzles to be used, the discharge amounts of the respective nozzles can be made to coincide with a desired value with high precision.

Furthermore, since the amount of liquid applied to a predetermined area (e.g., a pixel) on a substrate can be easily controlled to be a predetermined amount, a display device panel such as a high-quality color filter in which the amount of liquid applied to each predetermined area (pixel) is made uniform, or an EL display device, electron-emitting devices, or a display panel including the electron-emitting devices can be manufactured.

In the present invention, as a liquid discharge head, an ink-jet head is used. However, a liquid other than ink may be discharged depending on the object to be manufactured. For example, although ink is discharged if the object to be manufactured is a color filter, an EL material liquid is discharged if the object to be manufactured is an EL device. Likewise, if the object to be manufactured is an electron-emitting device, a conductive thin film material liquid is discharged. As described above, the liquid discharge head defined in this specification includes a head for discharging a liquid other than ink. However, since an ink-jet system is used as a discharge system, even a liquid discharge head which discharges a liquid other than ink may be termed an ink-jet head.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 21 is a flow chart for explaining a discharge amount correction sequence;

DETAILED DESCRIPTION OF THE PREFERRED EMBODIMENTS

The preferred embodiments of the present invention will be described below with reference to the accompanying drawings.

The following embodiments will exemplify discharge amount correction in manufacturing display device panels such as color filters and EL devices, electron-emitting devices, and display panels including the devices. However, the present invention is not limited to the discharge amount correction in manufacturing these panels. The present invention may be applied to a case wherein the amounts of liquid discharged from nozzles are required to be made uniform with an accurate, simple arrangement. For example, the present invention can be applied to discharge amount correction in a home printer designed to print an image on a medium such as plain paper or an OHP sheet by discharging ink thereon.

Note that a display device panel defined in the present invention is a panel used for a display device, including, for example, a display panel including a plurality of color filters having colored portions, EL devices having light-emitting portions formed of a spontaneous emission material (EL material), or electron-emitting devices having conductive thin film portions.

A color filter defined in the present invention is a filter comprised of colored portions and base members and capable of obtaining output light upon changing the characteristics of input light. More specifically, in a liquid crystal display device, backlight light is transmitted through such a color filter to obtain light of the three primary colors, i.e., R, G, and B or C, M, or Y, from the backlight light. Note that the base member in this case includes a substrate made of a glass or plastic material or the like, and also includes a member having a shape other than a plate-like shape.

(First Embodiment)

Figure 1:
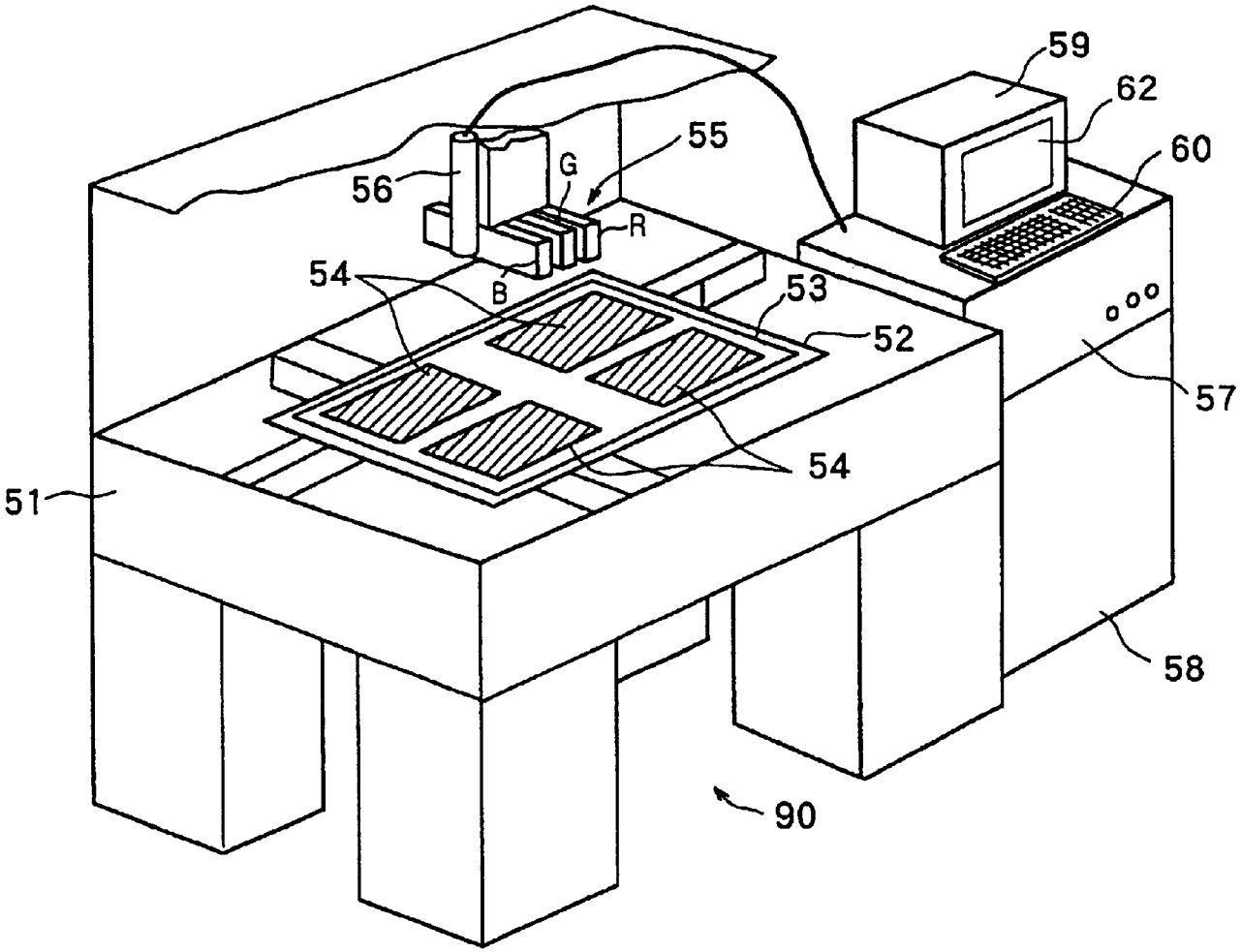
FIG. 1 is a perspective view showing the arrangement of an embodiment of a color filter manufacturing apparatus.

FIG. 1 is a schematic view showing the arrangement of a color filter manufacturing apparatus according to an embodiment.

Referring to FIG. 1, reference numeral 51 denotes an apparatus base; 52, an X-Y-θ stage disposed on the apparatus base 51; 53, a color filter substrate set on the X-Y-θ stage 52; 54, color filters formed on the color filter substrate 53; 55, red, green, and blue ink-jet heads for coloring the color filters 54; 58, a controller for controlling the overall operation of a color filter manufacturing apparatus 90; 59, a teaching pendant (personal computer) serving as the display unit of the controller; and 60, a keyboard serving as the operation unit of the teaching pendant 59.

Figure 2:
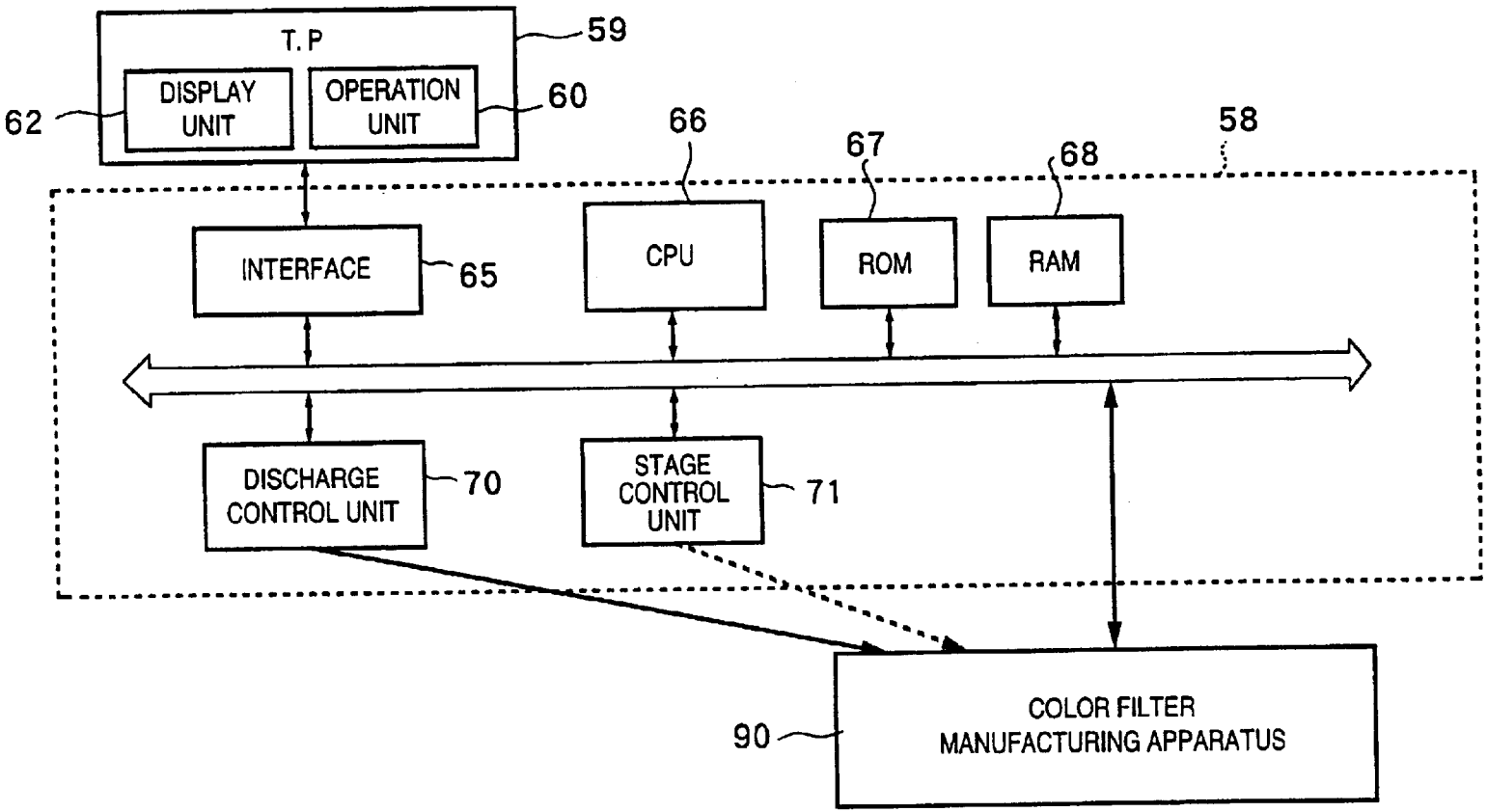
FIG. 2 is a block diagram showing the arrangement of a control unit for controlling the operation of the color filter manufacturing apparatus.

FIG. 2 is a block diagram showing the arrangement of the controller of the color filter manufacturing apparatus 90. Reference numeral 59 denotes a teaching pendant serving as the input/output device of the controller 58; 62, a display unit for displaying how a manufacturing process progresses, information indicating the presence/absence of a head abnormality, and the like. The operation unit (keyboard) 60 provides an instruction for operation of the color filter manufacturing apparatus 90 and the like.

The controller 58 controls the overall operation of the color filter manufacturing apparatus 90. Reference numeral 65 denotes an interface for exchanging data with the teaching pendant 59; 66, a CPU for controlling the color filter manufacturing apparatus 90; 67, a ROM storing control programs for operating the CPU 66; 68, a RAM for storing production information and the like; 70, a discharge control unit for controlling discharging of ink into each pixel of a color filter; and 71, a stage control unit for controlling the operation of the X-Y-θ stage 52 of the color filter manufacturing apparatus 90. The color filter manufacturing apparatus 90 is connected to the controller 58 and operates in accordance with instructions therefrom.

Figure 3:
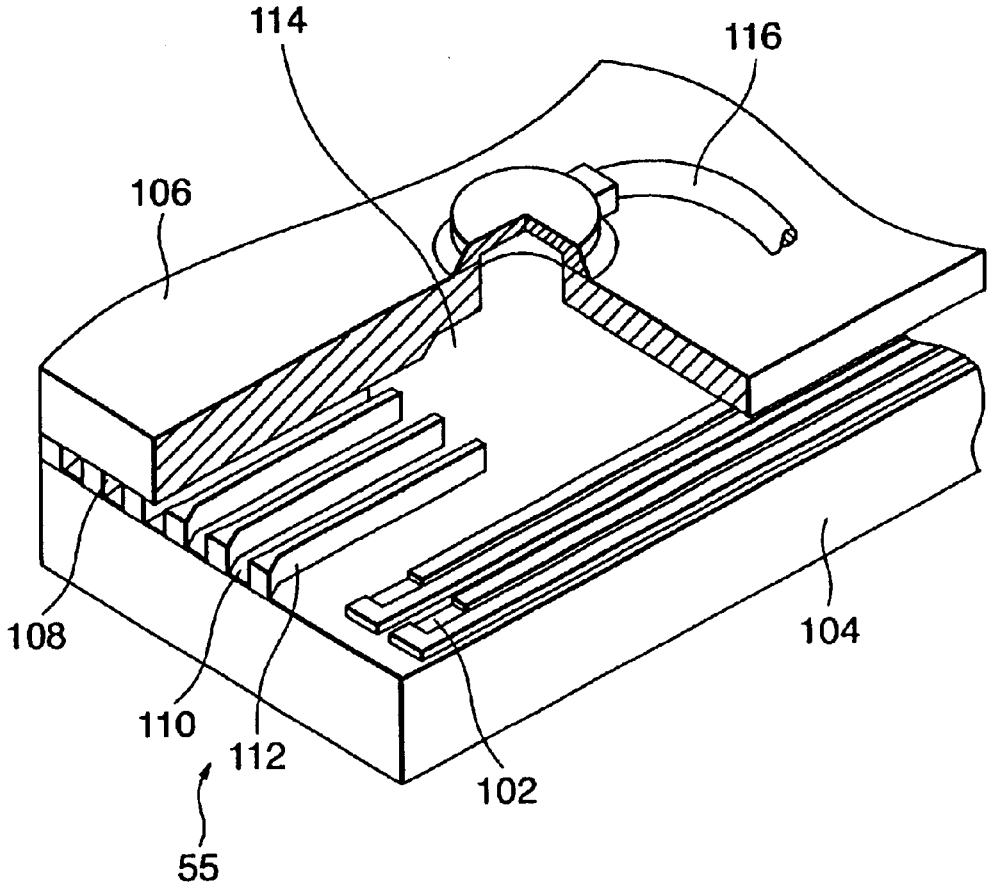
FIG. 3 is a perspective view showing the structure of an ink-jet head used in the color filter manufacturing apparatus.

FIG. 3 is a view showing the general structure of an ink-jet head IJH.

In the apparatus shown in FIG. 1, the three ink-jet heads 55 are arranged in correspondence with three colors, i.e., R, G, and B. Since these three heads have the same structure, FIG. 3 shows the structure of one of the three heads as a representative example.

Referring to FIG. 3, the ink-jet head IJH is mainly comprised of a heater board 104 as a board on which a plurality of heaters 102 for heating ink are formed, and a ceiling plate 106 mounted on the heater board 104. A plurality of orifices 108 are formed in the ceiling plate 106. Tunnel-like liquid channels 110 communicating with the orifices 108 are formed therebehind. The respective liquid channels 110 are isolated from the adjacent liquid channels via partition walls 112. The respective liquid channels 110 are commonly connected to one ink chamber 114 at the rear side of the liquid channels. Ink is supplied to the ink chamber 114 via an ink inlet 116. This ink is supplied from the ink chamber 114 to each liquid channel 110.

The heater board 104 and the ceiling plate 106 are positioned such that the position of each heater 102 coincides with that of a corresponding liquid channel 110, and are assembled into the state shown in FIG. 3. Although FIG. 3 shows only two heaters 102, a heater 102 is arranged in correspondence with each liquid channel 110. When a predetermined driving pulse is supplied to the heater 102 in the assembled state shown in FIG. 3, ink above the heater 102 boils to produce a bubble, and the ink is pushed and discharged from the orifice 108 upon volume expansion of the ink. Therefore, the size of a bubble can be adjusted by controlling a driving pulse applied to the heater 102, thereby controlling the volume of the ink discharged from each orifice. Parameters for control include, for example, power to be supplied to the heaters.

Figure 4:
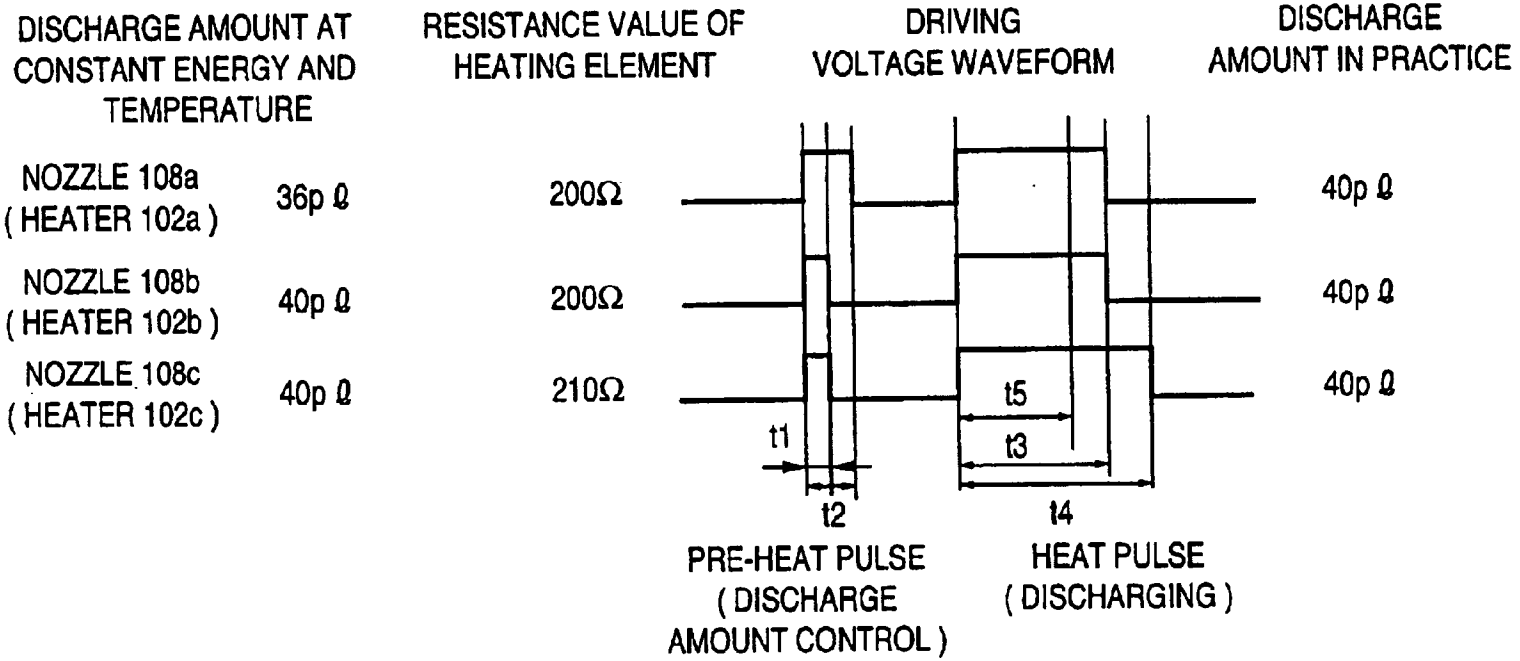
FIG. 4 is a view showing the waveforms of voltages applied to a heater of the ink-jet head.

FIG. 4 is a view for explaining a method of controlling the amount of ink discharged by changing the power to be supplied to a heater in this manner.

To adjust the amount of ink discharged, two kinds of low-voltage pulses are applied to the heater 102. As shown in FIG. 4, the two kinds of pulses are a pre-heat pulse and a main heat pulse (to be simply referred to as a heat pulse hereinafter). The pre-heat pulse is used to heat ink to a predetermined temperature before the ink is actually discharged. This pulse is set to a value shorter than a minimum pulse width t5 required to discharge ink. No ink is therefore discharged by this pre-heat pulse. A pre-heat pulse is applied to the heater 102 in advance to raise the initial temperature of ink to a predetermined temperature so as to keep the ink discharge amount always constant when a constant heat pulse is applied to the heater afterward. In contrast to this, the temperature of ink may be adjusted in advance by adjusting the length of a pre-heat pulse so as to change the amount of ink discharged even when the same heat pulse is applied to the heater. In addition, heating ink before application of a heat pulse will shorten the rise time for ink discharging operation upon application of a heat pulse, thereby improving the response.

A heat pulse is a pulse used to actually discharge ink, and set to a value longer than the minimum pulse width t5 required to discharge ink. The energy generated by the heater 102 is proportional to the width (application time) of a heat pulse. Variations in the characteristics of the heaters 102 can therefore be adjusted by adjusting the width of the heat pulse.

Note that controlling the diffused state of heat generated by a pre-heat pulse by adjusting the interval between the pre-heat pulse and a heat pulse can also adjust the amount of ink discharged.

As is obvious from the above description, the amount of ink discharged can be adjusted by adjusting the application times of a pre-heat pulse and heat pulse or by adjusting the application interval between a pre-heat pulse and a heat pulse. Therefore, the amount of ink discharged or the response of ink discharging operation with respect to an applied pulse can be arbitrarily adjusted by adjusting the application times of a pre-heat pulse and heat pulse or adjusting the application interval between a pre-heat pulse and a heat pulse as needed. In coloring a color filter, in particular, in order to suppress the occurrence of color unevenness, it is preferable that the coloring density (color density) between the respective filter elements or within one filter element be made almost uniform. For this purpose, the amount of ink discharged from each nozzle may be controlled to be uniform. If the amounts of ink discharged from the respective nozzles are the same, since the amounts of ink landed on the respective filter elements become the same, the coloring density between the filter elements can be made almost uniform. This can also reduce density unevenness within one filter element. Therefore, in order to adjust the amounts of ink discharged from the respective nozzles to the same amount, the above control for ink discharge amounts may be done.

FIGS. 5A to 5F are views showing a manufacturing process for a color filter. The manufacturing process for the color filter 54 will be described with reference to FIGS. 5A to 5F.

Figure 5A:
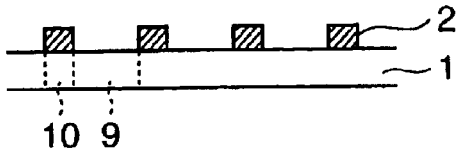
FIGS. 5A to 5F are views showing a manufacturing process for a color filter.
Figure 5B:
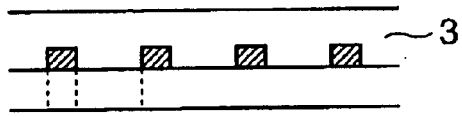
Figure 5C:
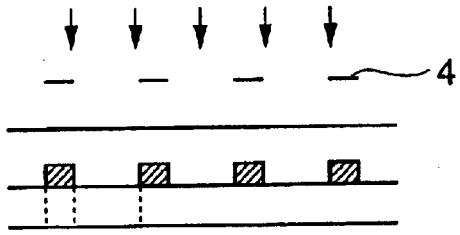

FIG. 5A shows a glass substrate 1 having a black matrix 2 forming light-transmitting portions 9 and light-shielding portions 10. A resin composition layer 3 is formed by coating the surface of the substrate 1, on which the black matrix 2 is formed, with a resin composition which is rich in ink receptivity by itself but decreases in ink receptivity under a certain condition (e.g., irradiation with light or irradiation with light and heat), and cures under a certain condition, and pre-baking the coating as needed (FIG. 5B). The resin composition layer 3 can be formed by a coating method such as spin coating, roller coating, bar coating, spraying, or dipping, and the present invention is not limited to them.

Figure 5D:
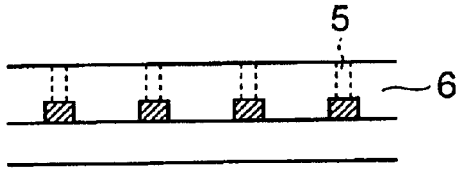

Pattern exposure is then performed on the resin layer on the light-transmitting portions 9 by using a photomask 4 to partly decrease the ink receptivity of the resin layer (FIG. 5C), thereby forming ink-receiving portions 6 and portions 5 with reduced ink receptivity in the resin composition layer 3 (FIG. 5D). In discharging ink while scanning the ink-jet head relative to the substrate a plurality of number of times, the ink-jet head may be fixed while the substrate is moved, or vice versa.

Figure 5E:
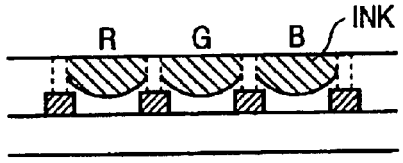

The resin composition layer 3 is then colored at once by discharging R (red), G (green), and B (blue) inks thereto by an ink-jet system, and the respective inks are dried as needed (FIG. 5E). The ink-jet system can be a system using heat energy and a system using mechanical energy. Either system can be suitably used. Inks to be used are not specifically limited as long as they can be used for the ink-jet system. As coloring agents for the inks, agents suited for transmission spectra required for R, G, and B pixels are properly selected from various kinds of dyes or pigments. Although ink discharged from the ink-jet head may adhere to the resin composition layer 3 in the form of a droplet, ink preferably adheres to the layer in the form of a column instead of being separated from the ink-jet head in the form of a droplet.

Figure 5F:
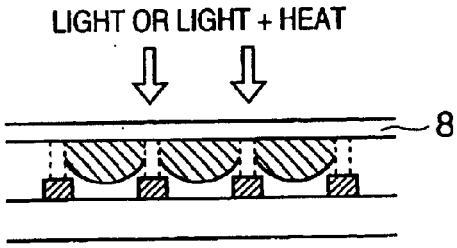

The colored resin composition layer 3 is cured by irradiation of light or irradiation of light and a heat treatment, and a protective layer 8 is formed as needed (FIG. 5F). The resin composition layer 3 can be cured under a condition different from that for the above ink repellency treatment, for example, increasing the exposure amount in performing irradiation of light, making the heating condition stricter, or performing both irradiation of light and a heat treatment.

Figure 6:
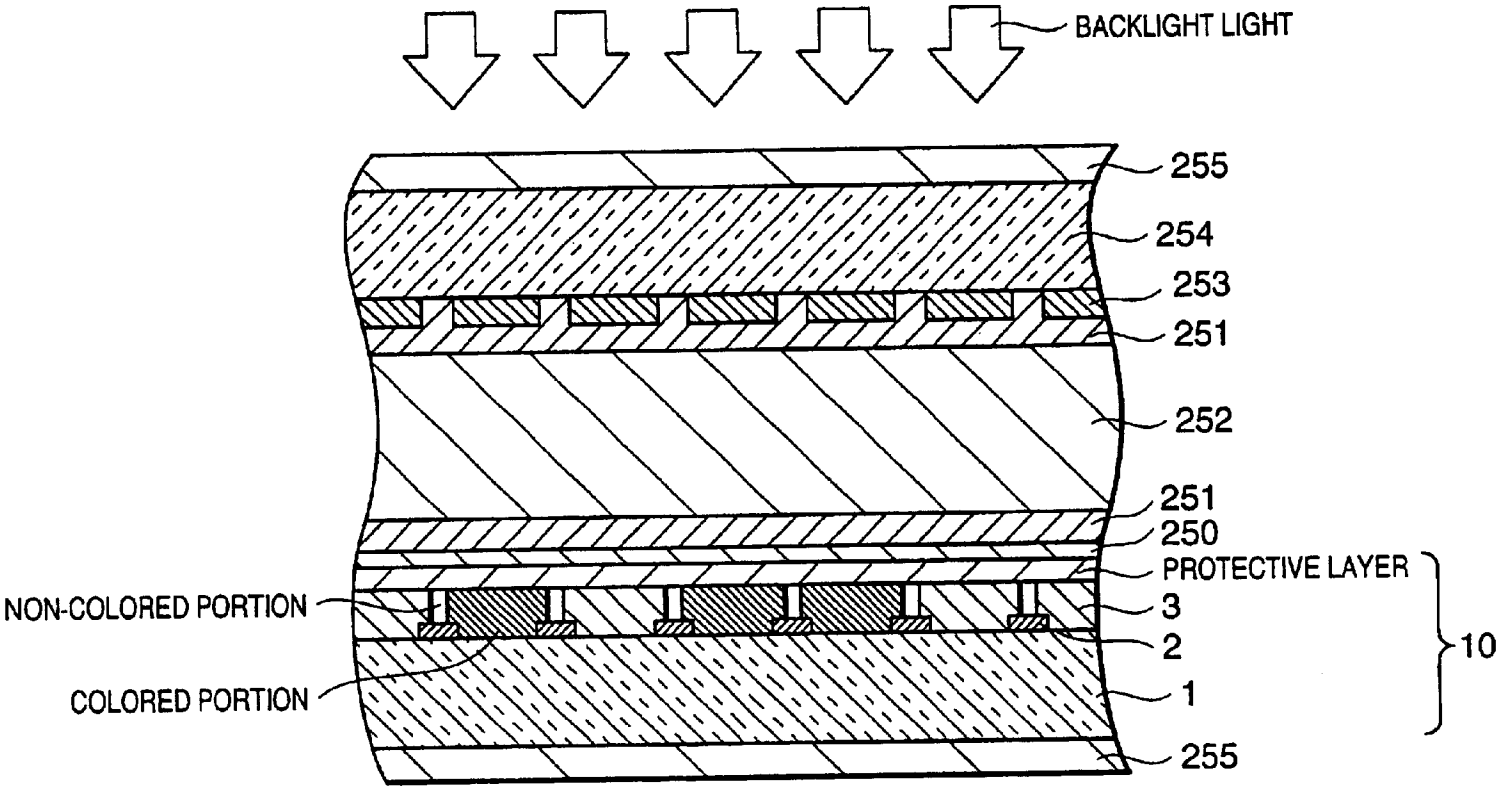
FIG. 6 is a sectional view showing the basic arrangement of a color liquid crystal display device incorporating a color filter according to an embodiment.
Figure 7:
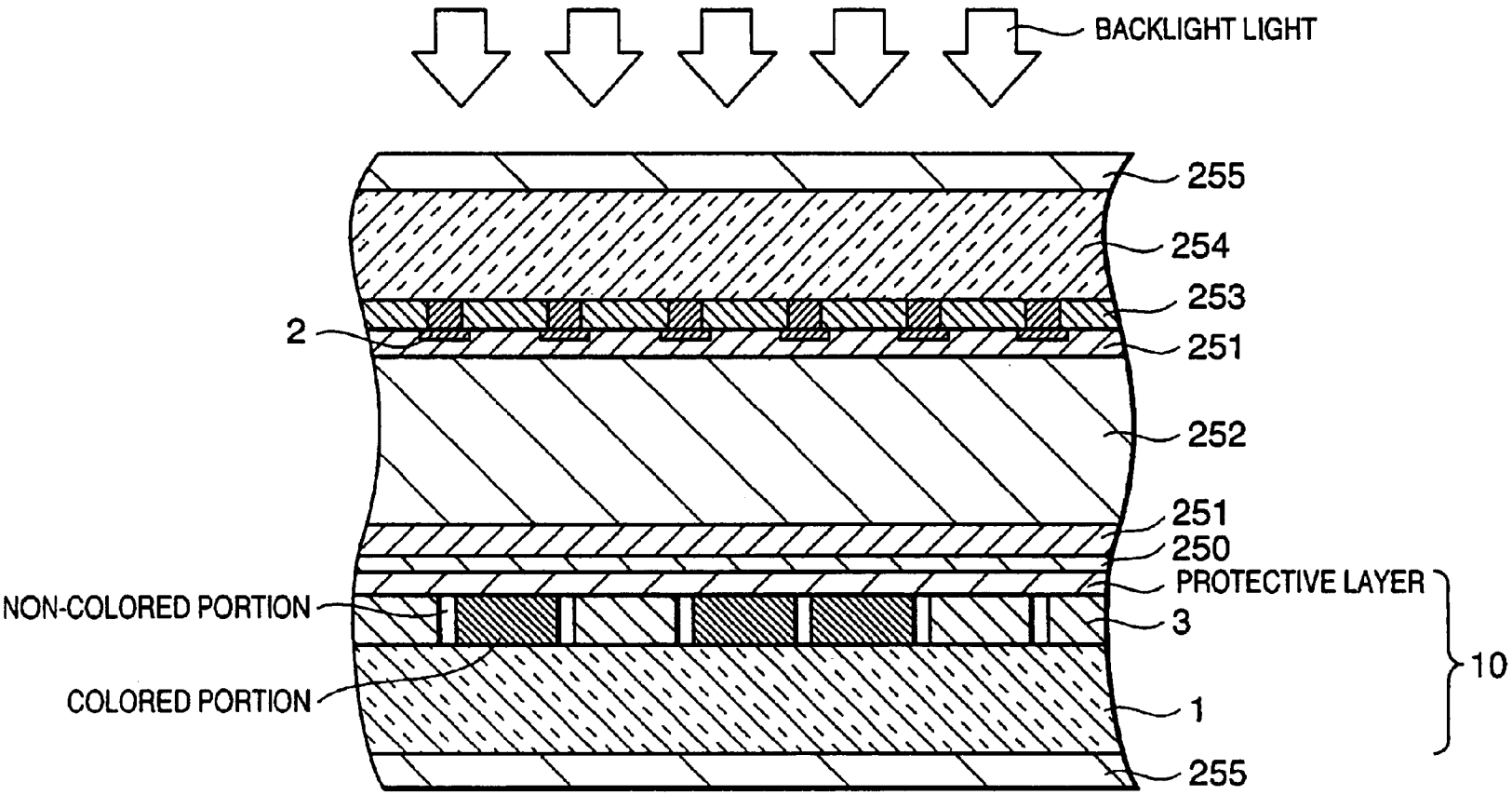
FIG. 7 is a sectional view showing the basic arrangement of a color liquid crystal display device incorporating a color filter according to a modification to the embodiment.

FIGS. 6 and 7 are sectional views showing the basic structure of a color liquid crystal display device 30 incorporating the above color filter.

A color liquid crystal display device is generally formed by joining the color filter substrate 1 and a counter substrate 251 together, and sealing a liquid crystal compound 252 therebetween. TFTs (Thin Film Transistors) (not shown) and transparent pixel electrodes 253 are formed on the inner surface of one substrate 251 of the liquid crystal display device in the form of a matrix. The color filter 10 is placed on the inner surface of the other substrate 1 such that R, G, and B coloring materials are positioned to oppose the pixel electrodes. A transparent counter electrode (common electrode) 250 is formed on the entire surface of the color filter. The black matrix 2 is generally formed on the color filter substrate 1 side (see FIG. 6). However, in a BM (Black Matrix) on-array type liquid crystal panel, such a black matrix is formed on the TFT substrate side opposing the color filter substrate (see FIG. 7). Aligning films 251 are formed within the planes of the two substrates. By performing a rubbing process for the aligning films, the liquid crystal molecules can be aligned in a predetermined direction. Polarizing plates 255 are bonded to the outer surfaces of the respective glass substrates. The liquid crystal compound 252 is filled in the gap (about 2 to 5 μm) between these glass substrates. As a backlight, a combination of a fluorescent lamp (not shown) and a scattering plate (not shown) is generally used. Display operation is performed by causing the liquid crystal compound to serve as an optical shutter for changing the transmittance for light emitted from the backlight.

A case wherein such a liquid crystal display device is applied to an information processing apparatus will be described below with reference to FIGS. 8 to 10.

Figure 8:
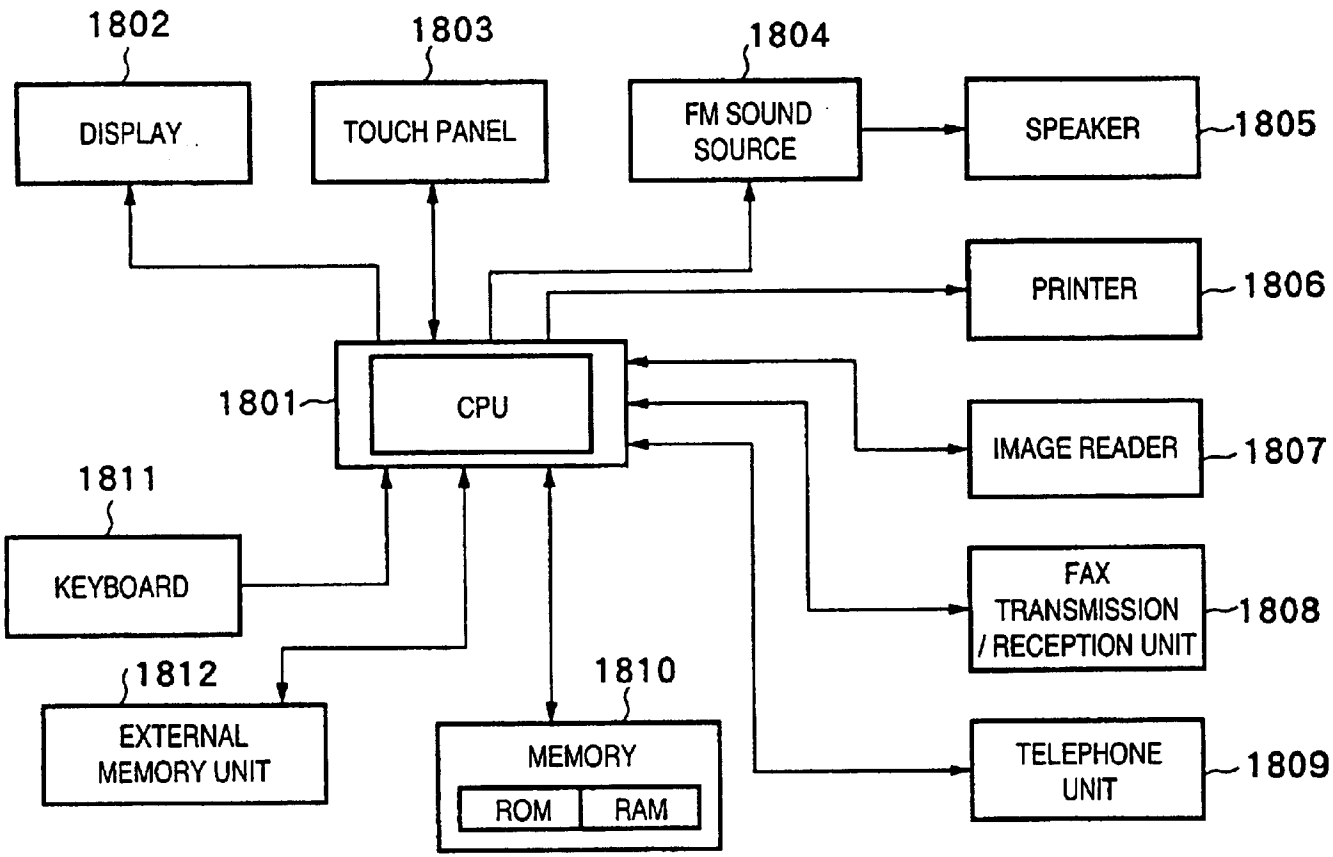
FIG. 8 is a block diagram showing an information processing apparatus in which a liquid crystal display device is used.

FIG. 8 is a block diagram showing the schematic arrangement of an information processing apparatus serving as a wordprocessor, a personal computer, a facsimile apparatus, and a copying machine, to which the above liquid crystal display device is applied.

Referring to FIG. 8, reference numeral 1801 denotes a control unit for controlling the overall apparatus. The control unit 1801 includes a CPU such as a microprocessor and various I/O ports, and performs control by outputting/inputting control signals, data signals, and the like to/from the respective units. Reference numeral 1802 denotes a display unit for displaying various menus, document information, and image data read by an image reader 1807, and the like on the display screen; and 1803, a transparent, pressure-sensitive touch panel mounted on the display unit 1802. By pressing the surface of the touch panel 1803 with a finger of the user or the like, item input operation, coordinate position input operation, or the like can be performed on the display unit 1802.

Reference numeral 1804 denotes an FM (Frequency Modulation) sound source unit for storing music information, created by a music editor or the like, in a memory unit 1810 or external memory unit 1812 as digital data, and reading out the information from such a memory, thereby performing FM modulation of the information. An electrical signal from the FM sound source unit 1804 is converted into an audible sound by a speaker unit 1805. A printer unit 1806 is used as an output terminal for a wordprocessor, a personal computer, a facsimile apparatus, and a copying machine.

Reference numeral 1807 denotes an image reader unit for photoelectrically reading original data. The image reader unit 1807 is placed midway along the original convey passage and designed to read originals for facsimile and copy operations and other various originals.

Reference numeral 1808 denotes a transmission/reception unit for the facsimile (FAX) apparatus. The transmission/reception unit 1808 transmits original data read by the image reader unit 1807 by facsimile, and receives and decodes a sent facsimile signal. The transmission/reception unit 1808 has an interface function for external units. Reference numeral 1809 denotes a telephone unit having a general telephone function and various telephone functions such as an answering function.

Reference numeral 1810 denotes a memory unit including a ROM for storing system programs, manager programs, application programs, fonts, and dictionaries, a RAM for storing an application program loaded from the external memory unit 1812 and document information, a video RAM, and the like.

Reference numeral 1811 denotes a keyboard unit for inputting document information and various commands.

Reference numeral 1812 denotes an external memory unit using a floppy disk, a hard disk, and the like. The external memory unit 1812 serves to store document information, music and speech information, application programs of the user, and the like.

Figure 9:
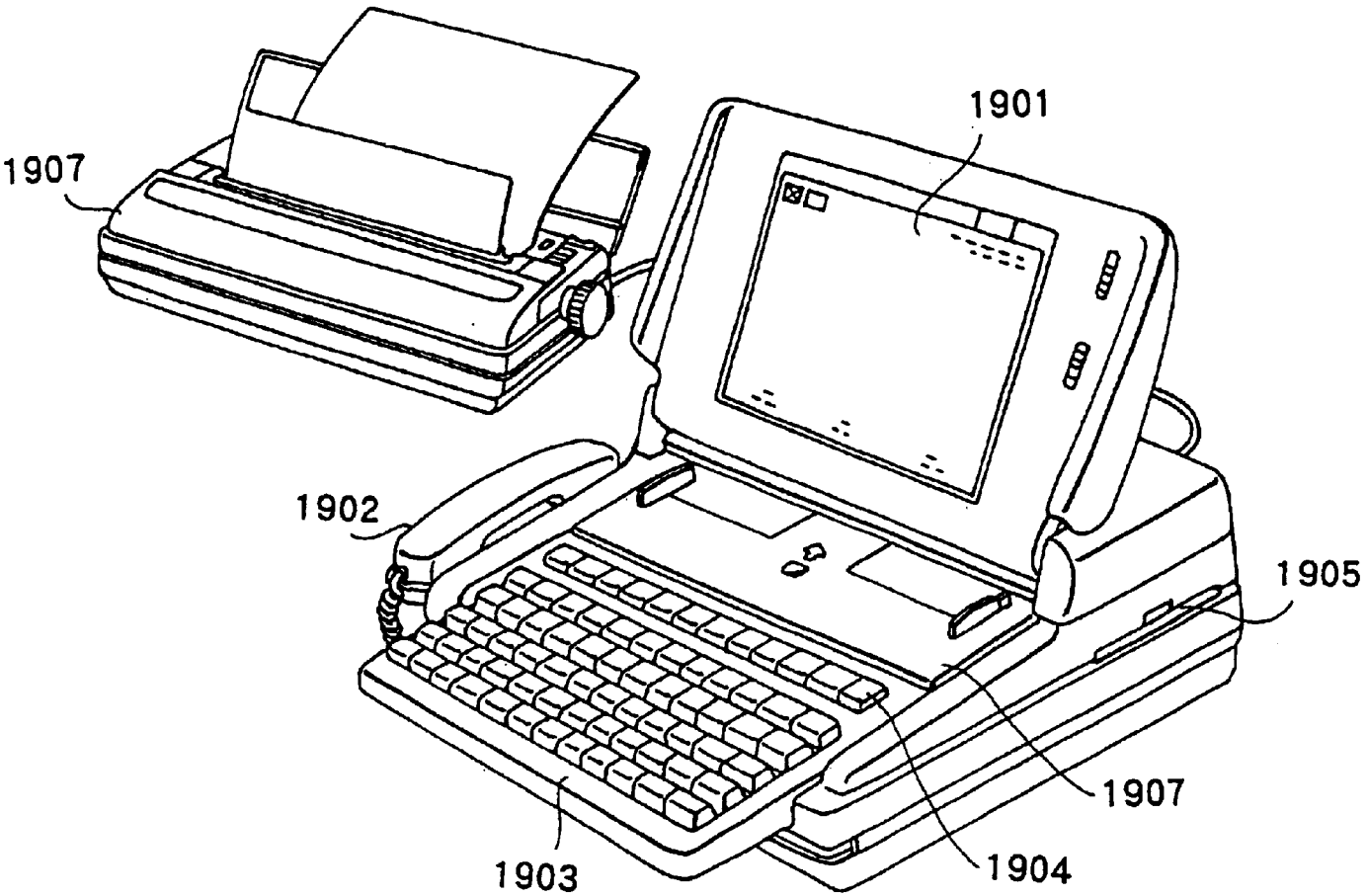
FIG. 9 is a perspective view showing the information processing apparatus in which the liquid crystal display device is used.

FIG. 9 is a schematic perspective view of the information processing apparatus in FIG. 8.

Referring to FIG. 9, reference numeral 1901 denotes a flat panel display using the above liquid crystal display device, which displays various menus, graphic pattern information, document information, and the like. Coordinate input or item designation input operation can be performed on the flat panel display 1901 by pressing the surface of the touch panel 1803 with a finger of the user or the like. Reference numeral 1902 denotes a handset used when the apparatus is used as a telephone set. A keyboard 1903 is detachably connected to the main body via a cord and is used to perform various document functions and input various data. This keyboard 1903 has various function keys 1904. Reference numeral 1905 denotes an insertion port through which a floppy disk is inserted into the external memory unit 1812.

Reference numeral 1906 denotes an original table on which an original to be read by the image reader unit 1807 is placed. The read original is discharged from the rear portion of the apparatus. In a facsimile receiving operation or the like, received data is printed out by an ink-jet printer 1907.

When the above information processing apparatus serves as a personal computer or a wordprocessor, various kinds of information input through the keyboard unit 1811 are processed by the control unit 1801 in accordance with a predetermined program, and the resultant information is output, as an image, to the printer unit 1806.

When the information processing apparatus serves as the receiver of a facsimile apparatus, facsimile information input through the transmission/reception unit 1808 via a communication line is subjected to reception processing in the control unit 1801 in accordance with a predetermined program, and the resultant information is output, as a received image, to the printer unit 1806.

When the information processing apparatus serves as a copying machine, an original is read by the image reader unit 1807, and the read original data is output, as an image to be copied, to the printer unit 1806 via the control unit 1801. Note that when the information processing apparatus serves as the receiver of a facsimile apparatus, original data read by the image reader unit 1807 is subjected to transmission processing in the control unit 1801 in accordance with a predetermined program, and the resultant data is transmitted to a communication line via the transmission/reception unit 1808.

Figure 10:
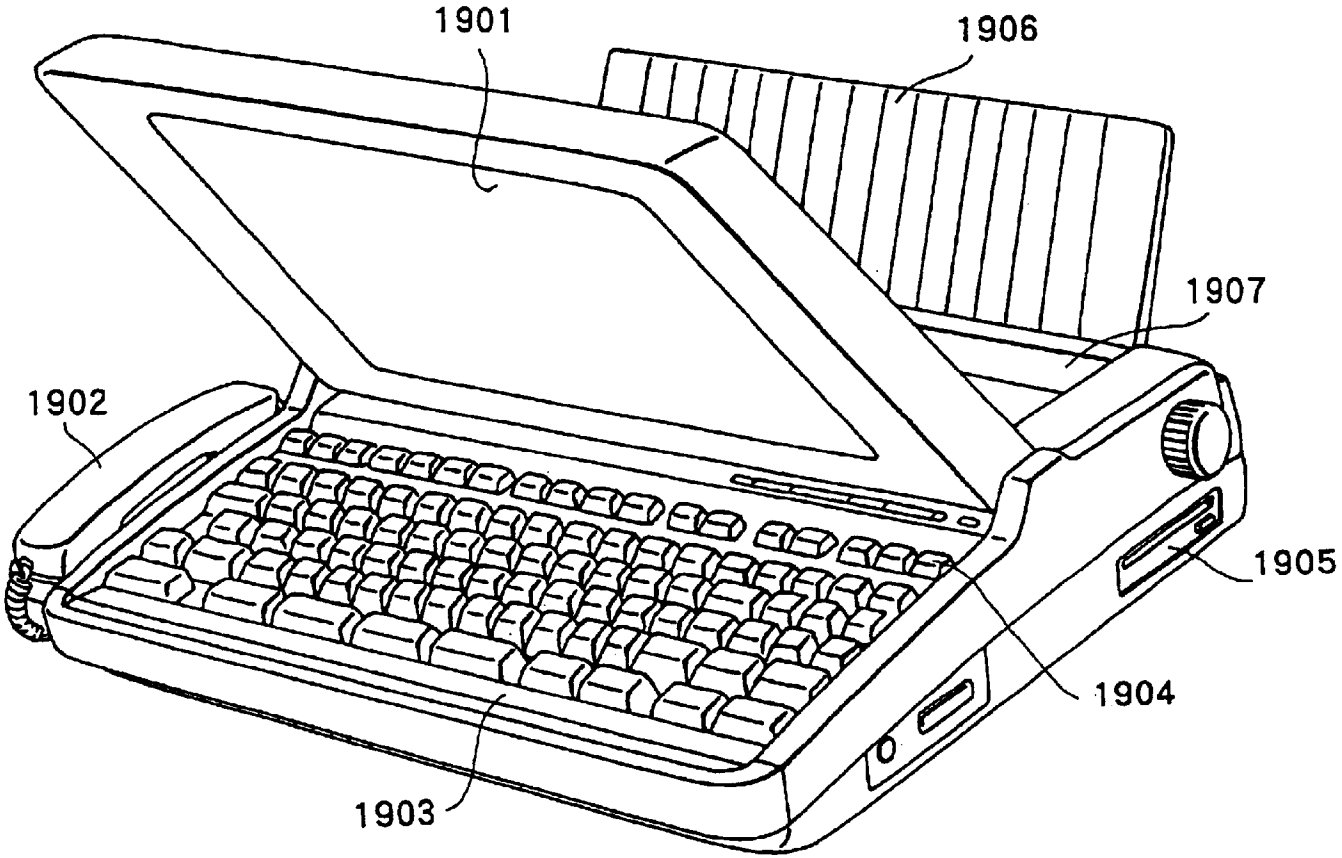
FIG. 10 is a perspective view showing the information processing apparatus in which the liquid crystal display device is used.

Note that the above information processing apparatus may be designed as an integrated apparatus incorporating an ink-jet printer in the main body, as shown in FIG. 10. In this case, the portability of the apparatus can be improved.

The same reference numerals in FIG. 10 denote parts having the same functions as those in FIG. 9.

Figure 18:
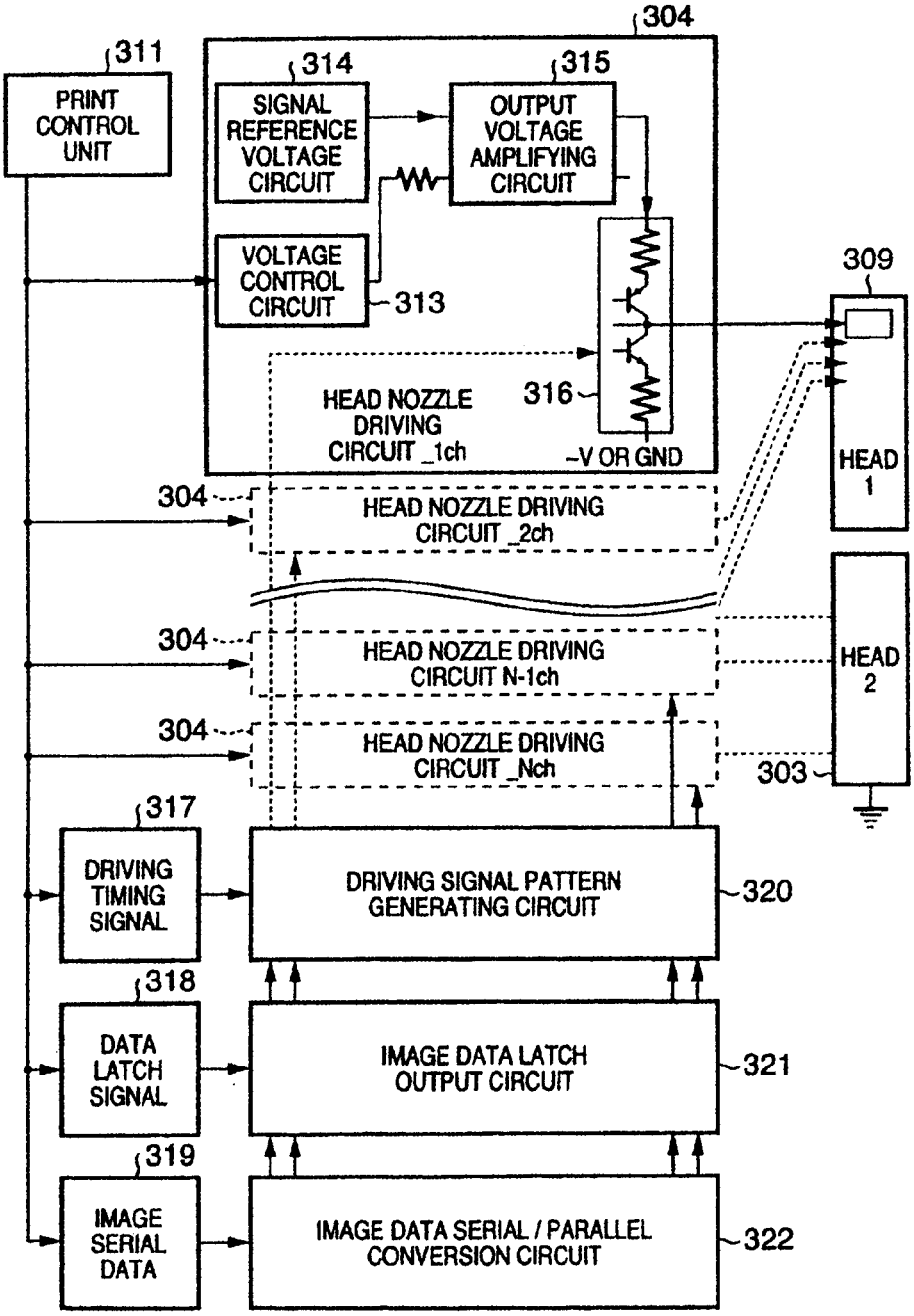
FIG. 18 is a block diagram for explaining the arrangement of a discharge control circuit.

FIG. 18 shows the arrangement of a discharge amount control circuit in this embodiment. Referring to FIG. 18, all the nozzles are respectively connected to the head nozzle driving circuits (voltage changing devices including DA converters and amplifying circuits). That is, all the nozzles are discharge amount changeable nozzles.

Referring to FIG. 18, a print control unit 311 supplies image serial data 319 to an image data serial/parallel conversion circuit 322, a data latch signal 318 to an image data latch output circuit 321, and a driving timing signal 317 to a driving signal pattern generating circuit 320. The print control unit 311 supplies a set control voltage command to a head nozzle driving circuit 304. Discharge amount control is performed on the basis of various kinds of signals from the print control unit 311. More specifically, first of all, the image serial data 319 for selecting charging or non-charging of each nozzle (ch) is converted into parallel data by the image data serial/parallel conversion circuit 322. This data is latched by the image data latch output circuit 321 in response to the data latch signal 318. Each nozzle is selected on the basis of this latched data. The driving signal pattern generating circuit 320 then supplies the driving timing signal 317 to the head nozzle driving circuit 304. The head nozzle driving circuit 304 supplies a driving signal to a discharge driving element 309 of the above selected nozzle.

Note that each discharge driving element is equivalent to a heater in a Bubble-jet (registered trademark) head. In a piezoelectric head, this element is equivalent to a piezoelectric element used on a discharge driving side wall of the ink chamber of a nozzle.

The above discharge amount control circuit performs discharge amount control by controlling the voltage of a driving signal supplied to each nozzle. This voltage control is performed by the head nozzle driving circuit 304. The head nozzle driving circuit 304 includes a voltage control circuit 313, a signal reference voltage circuit 314, output voltage amplifying circuit 315, and output charging/discharging circuit 316. The voltage control circuit 313 and signal reference voltage circuit 314 set a print control voltage for each nozzle upon reception of a set control voltage value command from the print control unit 311. More specifically, the signal reference voltage circuit 314 sets the center value of a driving voltage, and the voltage control circuit 313 sets a correction voltage for the center value of a driving voltage for each nozzle. That is, the voltage control circuit 313 corrects a driving voltage to change its voltage value.

The output voltage amplifying circuit 315 applies a driving voltage to the output charging/discharging circuit 316 on the basis of the corrected voltage value.

With the above operation, a corrected driving signal is supplied from the output charging/discharging circuit 316 to each nozzle to control the amount of ink discharged from each nozzle. Note that the head nozzle driving circuit 304 for voltage control is designed to change the voltage value of a driving signal, and hence can be referred to as a transformation circuit.

Figure 19:
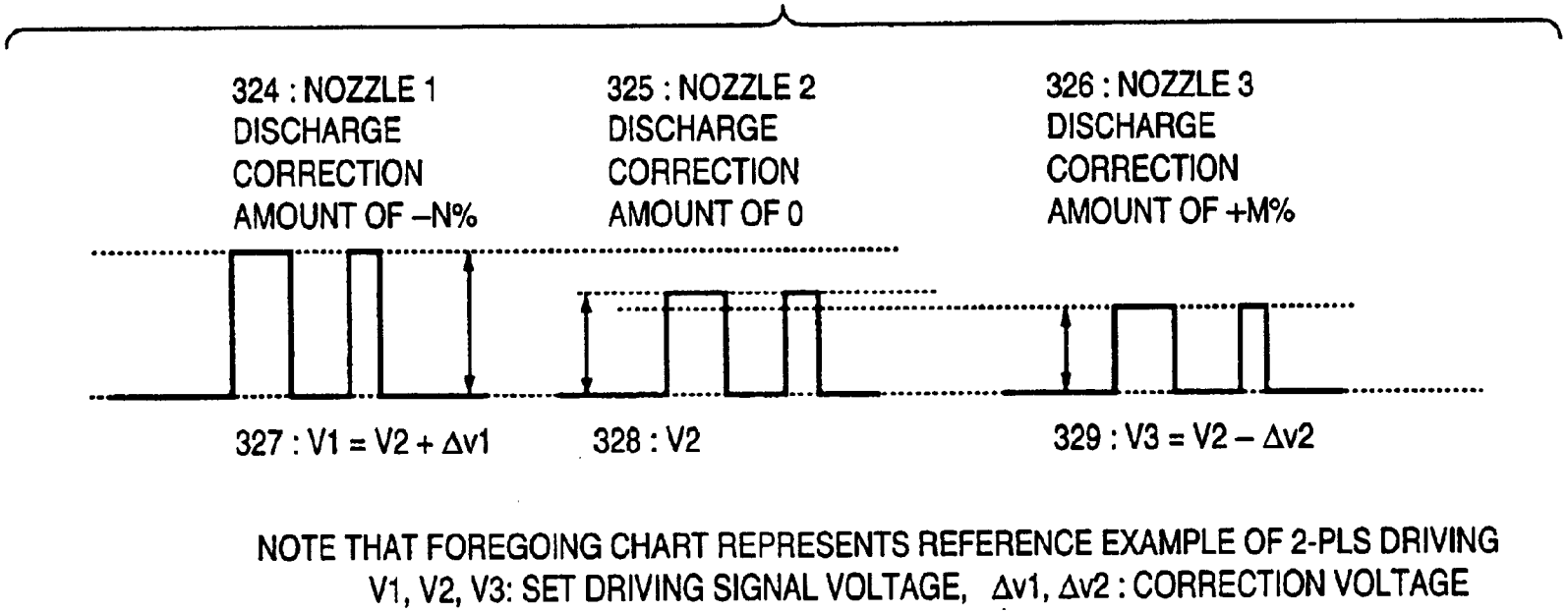
FIG. 19 is a view for briefly explaining how the voltage of a driving signal is changed.
Figure 20A:
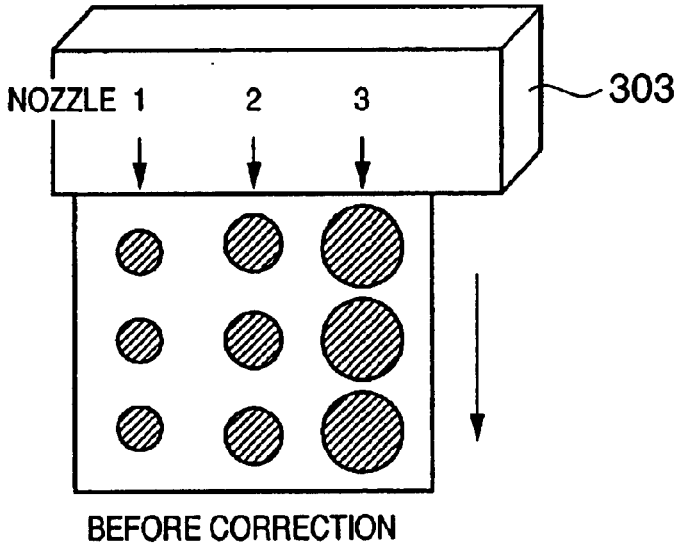
FIGS. 20A and 20B are views for explaining discharge states before and after discharge amount correction.
Figure 20B:
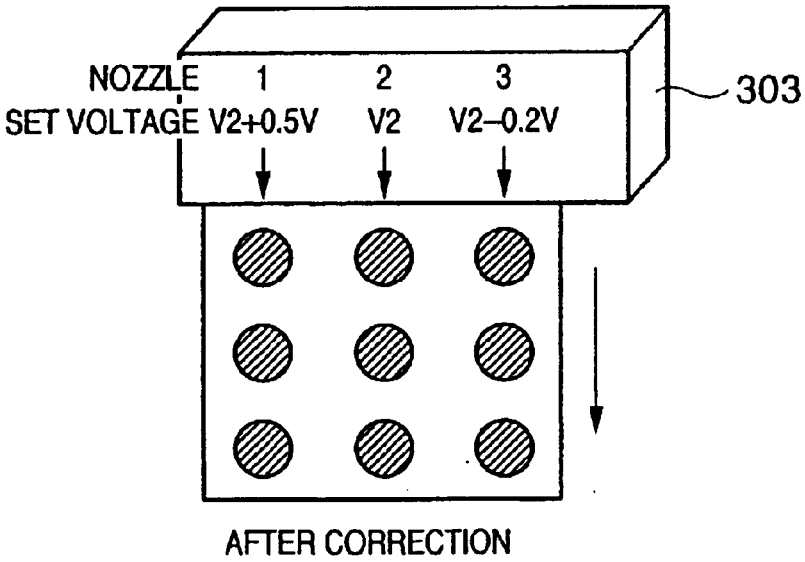

FIG. 19 shows a case wherein the voltage value of a driving signal to be supplied to each nozzle (nozzles 1 to 3) is corrected. FIGS. 20A and 20B respectively show printed states before and after driving voltages are corrected. The states of arbitrary nozzle 1 (324), nozzle 2 (325), and nozzle 3 (326) correspond to "before correction" in FIG. 20A. Referring to FIG. 20A, the discharge amount of nozzle 2 is equal to a target discharge amount, the discharge amount of nozzle 1 is smaller than the target discharge amount, and the discharge amount of nozzle 3 is larger than the target discharge amount.

As the voltages of driving signals to be supplied to the respective nozzles, a driving voltage ($V2+\Delta v1$) corrected to be higher than a driving voltage $V2$ for nozzle 2 (325) by $\Delta v1$ is applied to nozzle 1, and a driving voltage ($V2-\Delta v2$) corrected to be lower than the driving voltage $V2$ for nozzle 2 (325) by $\Delta v2$ is applied to nozzle 3 (326).

The discharge amount states set by voltage correction in the above manner correspond to "after correction" in FIG. 20B.

FIG. 21 shows a discharge amount correction sequence for making the discharge amount of each nozzle coincide with a target value.

In controlling the discharge amount of each nozzle, first of all, a variable characteristic representing the relationship between the discharge amount of each nozzle and a variable condition (a driving voltage in this case) is obtained.

This variable characteristic is obtained according to procedures (1) to (3) in FIG. 21. As described in (1), first of all, ink is discharged with a plurality of different driving voltage values obtained by changing a driving voltage value within the range of driving voltage values that can be used for printing operation. That is, a plurality of ink dots corresponding to the respective different driving voltage values are printed. For example, a voltage value with which the discharge amount is small and a voltage value with which the discharge amount is large are set at at least two points, and ink dots are printed on a glass substrate using driving signals having the same pulse width as that used in actual printing operation. This ink dot printing operation is individually performed for all the nozzles.

As described in "(2)", the amount of light transmitted through each ink dot printed on the glass substrate is measured, and each ink discharge amount is obtained on the basis of the measurement result.

Figure 22:
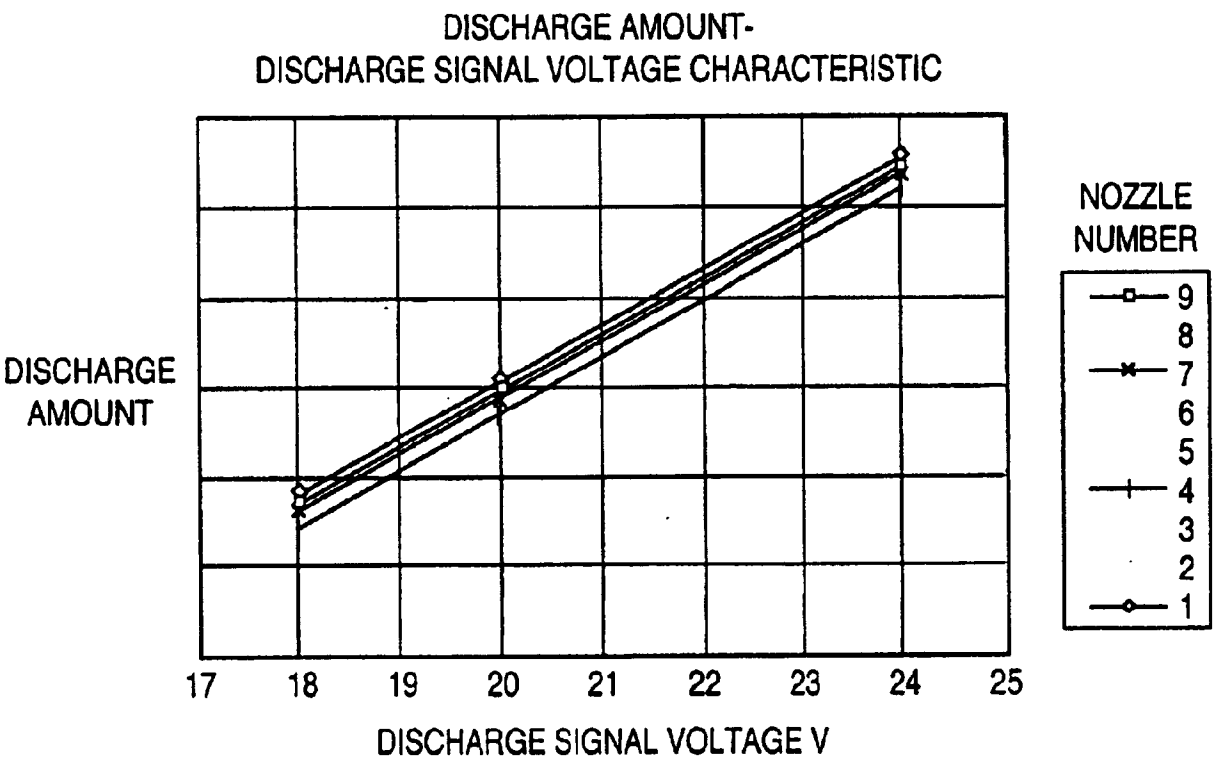
FIG. 22 is a graph showing the relationship between the discharge amount and the driving signal voltage.

As described in "(3)", a discharge amount change amount (to be referred to as a correction sensitivity K in this case) obtained when a voltage is changed is calculated from the difference between two points, i.e., a point Vd2 at which the discharge amount is large and a point Vd1 at which the discharge amount is small, and the difference between corresponding voltage values V2 and V1. Note that FIG. 22 shows the relationship between the voltage value and the corresponding ink discharge amount, and the correction sensitivity K corresponds to the gradient of the straight line shown in FIG. 22. In this case, the discharge amount of each nozzle is measured when driving signal voltages are set to 18 V, 20 V, and 24 V.

Subsequently, as described in "(4)", the discharge amounts of all the nozzles are measured under the same driving conditions as those used in actual printing operation, and an average discharge amount Vdx of all the nozzles is calculated. A correction value VdnNY is calculated for each nozzle on the basis of the difference between a discharge amount Vdn of each nozzle and the average discharge amount Vdx and the correction sensitivity K. The correction values VdnNY obtained in this manner are set in the signal voltage control circuit 313. After this setting, ink is discharged, and correction processing described in "(4)" and "(5)" in FIG. 21 is performed until a print result indicates that the discharge amount of each nozzle is corrected to a target discharge amount.

Figure 23:
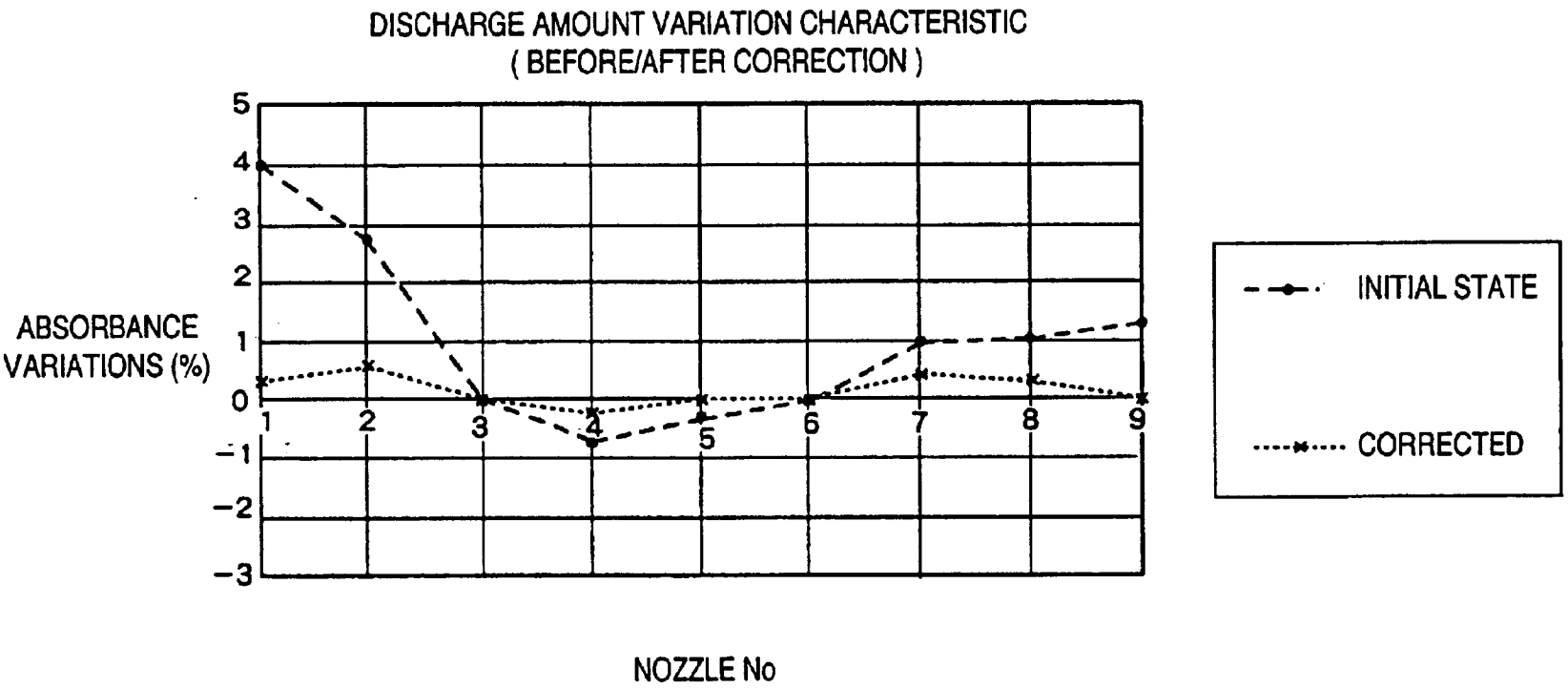
FIG. 23 is a graph showing states before and after the discharge amounts of nozzles are corrected.

FIG. 23 shows the relationship between the absorbance variations (discharge amount variations) in a state before the execution of the correction sequence shown in FIG. 21 and the absorbance variations (discharge amount variations) in a state after the execution of the correction sequence. The discharge amount variation data before correction is data indicating the discharge amount variations obtained when all driving voltages are set to 19 V. The variations reach +4%. Assume that the average discharge amount of all the nozzles is calculated, that a correction value is calculated for each nozzle on the basis of the difference between the average discharge amount and the discharge amount of each nozzle and the correction sensitivity K as described in FIG. 21, and that correction is made on the basis of the correction value. In this case, the discharge amount variations after correction are suppressed within ±1%. In this embodiment, when the set resolution of signal set voltages is set to about 100 mV, the discharge amount can be changed by 1%. As the set resolution is decreased, discharge amount control can be done in steps of about 0.5%.

Figure 16:
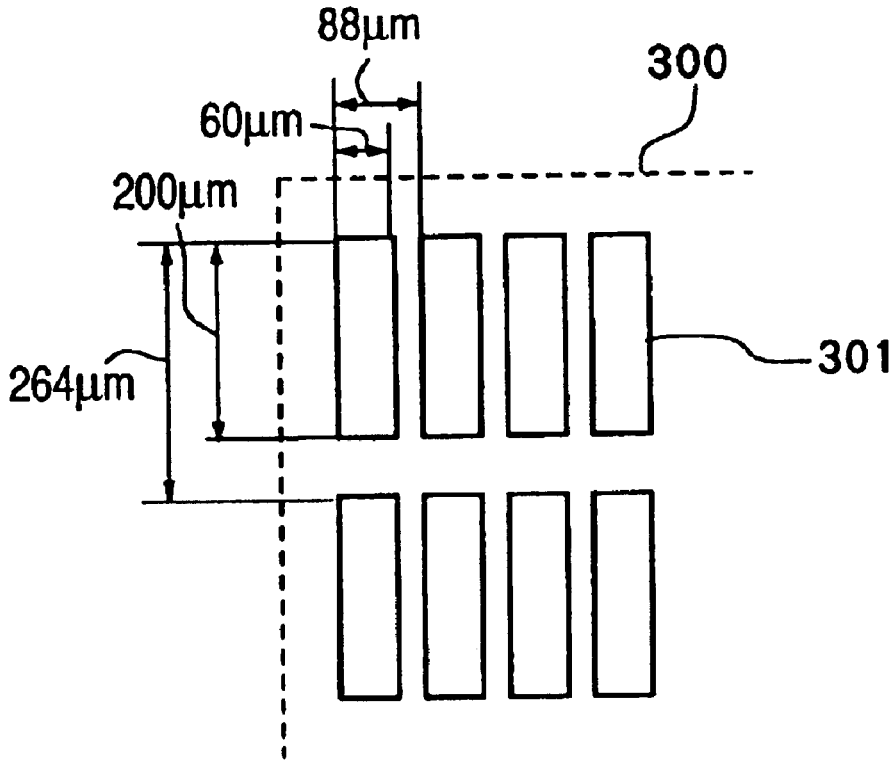
FIG. 16 is a view showing the arrangement of the pixel arrays of a color filter.
Figure 17:
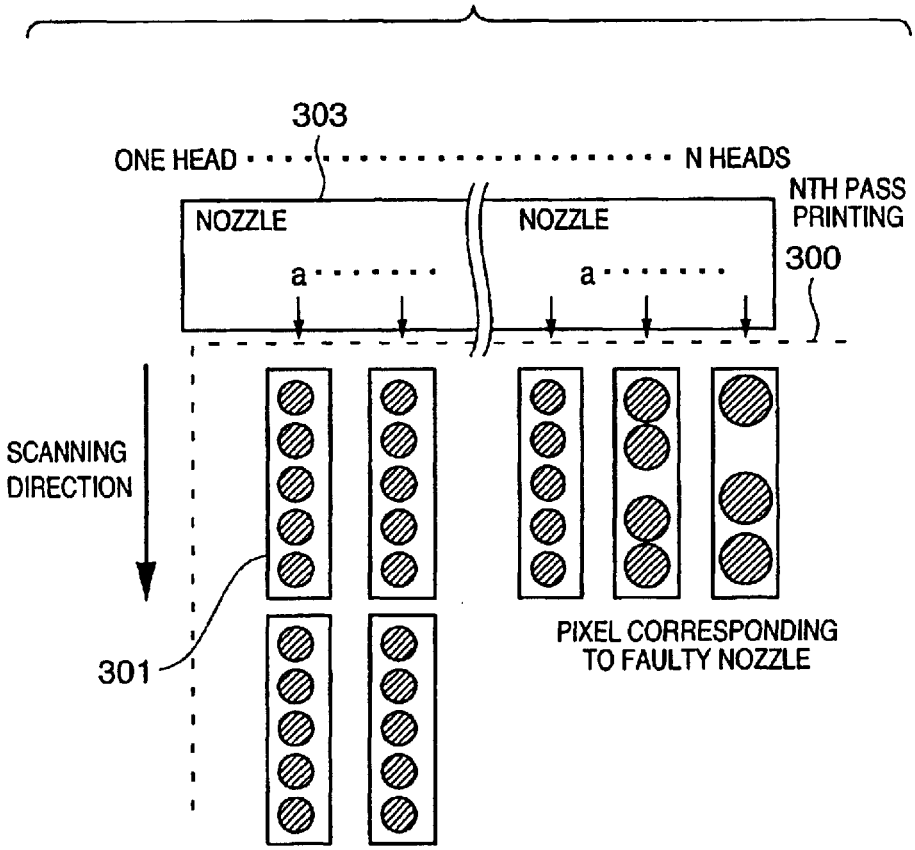
FIG. 17 is a view for explaining an example of a color filter printing method according to the first embodiment.

The amount of ink discharged from each nozzle is corrected in the above manner. A case wherein this discharge amount correction is actually applied to printing of a color filter will be described below. FIG. 16 is a view showing an array pattern of pixels of a color filter. FIG. 17 is a view showing a printed state after discharge amount correction. In this case, in order to make the amount of ink discharged from each nozzle coincide with a target value, the discharge amount of each nozzle is individually controlled to make the amounts of ink filled in the respective pixels uniform. More specifically, as shown in FIG. 17, driving voltages are corrected to make the amounts of ink discharged from the respective nozzles become the same, thereby making the discharge amounts of the respective nozzles per droplet uniform. This makes it possible to make the amounts of ink filled in the respective pixels uniform. According to this arrangement, since the amount of ink filled in the respective pixels can be made to become equal, a high-quality color filter without any density unevenness can be manufactured.

If a faulty nozzle that cannot discharge ink appears among the nozzles in use, the ink discharge amount per droplet is increased to compensate for a decrease in ink discharge amount accompanying the appearance of the faulty nozzle, thereby correcting the amount of ink discharged into the pixel to a target value (the amount of ink that should be discharged into one pixel), as indicated by the two pixels on the right side in FIG. 17. More specifically, referring to FIG. 17, five nozzles are made to oppose one pixel, and ink is discharged from the five nozzles drop by drop to completely fill the pixel with ink (see the three pixels on the left side in FIG. 17). If one of the five nozzles becomes faulty, one pixel is formed by four droplets from the four nozzles (see the second pixel from the right side). If the same ink discharge amount as that in normal operation in which five ink droplets are discharged is set for each nozzle, the amount of ink filled in the pixel inevitably decreases. In order to attain the target value with four ink droplets, the ink discharge amount per droplet is increased. In this case, the ink discharge amount per droplet may be set to 5/4 times that in normal operation in which five droplets are discharged for one pixel. Likewise, if two of five nozzles corresponding to one pixel become faulty, and one pixel is to be formed by three droplets (see the first pixel from the right side), the ink discharge amount per droplet may be set to 5/3 times that in normal operation to make the amount of ink discharged into the pixel coincide with the target value. Even if a faulty nozzle appears and the ink discharge amount is to be increased in this manner, driving voltages for the respective nozzles are set to make the amounts of ink discharged from each nozzle per droplet uniform.

Note that the present invention can also be equally applied to the manufacture of a color filter in which pixel arrays are arranged at right angles with respect to the scanning direction of the head unlike the color filter shown in FIG. 17.

The effect of discharge amount correction in actual color filter printing operation will be described below.

Figure 24:
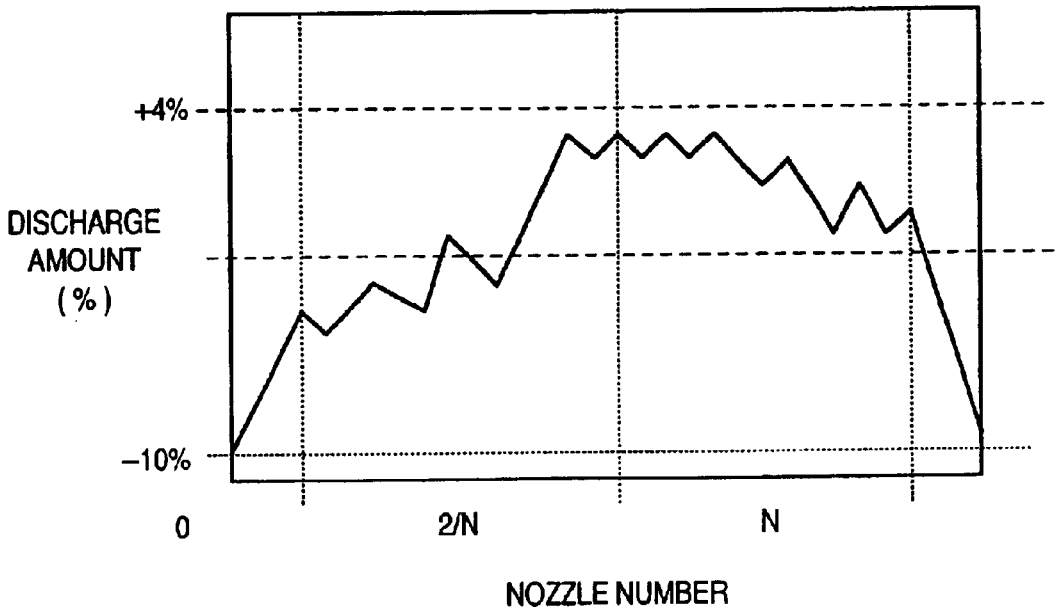
FIG. 24 is a graph showing how the discharge amount of the head without correction changes in color filter printing operation.

FIG. 24 is a graph showing how the discharge amounts of the respective nozzles vary when no correction is made. This graph shows an example of the discharge amount distribution of an arbitrary head. As shown in FIG. 24, discharge amount variations among the respective nozzles are large before correction.

Figure 25:
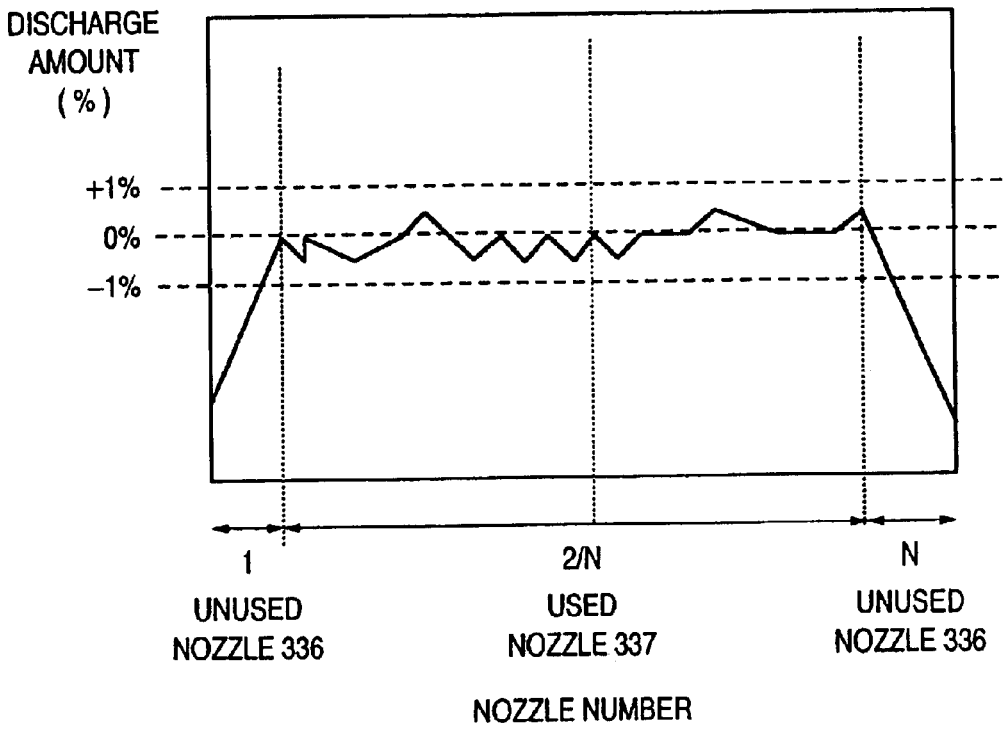
FIG. 25 is a graph for explaining how the discharge amounts of nozzles of the head change when correction is made for the nozzles in use in color filter printing operation.

FIG. 25 shows discharge amount variations after discharge amount correction is performed for nozzles to be used on the basis of the above discharge amount correction. As shown in FIG. 25, discharge amount variations after correction among the nozzles to be used in printing operation can be suppressed within ±1%. A high-quality color filter with little density unevenness can be manufactured by performing printing operation under this condition.

In the above embodiment, as a discharge amount changing device for changing the ink discharge amount, a voltage control device capable of variably setting the voltage value of a driving signal is used. This voltage control device is provided in correspondence with each nozzle, and the discharge amount of each nozzle is changed by changing the set voltage of a driving signal. However, the discharge amount changing device to be used is not limited to the above voltage control device. For example, discharge amount adjustment may be performed by changing the pulse width of a driving signal while keeping the voltage constant. In this form, as a discharge amount changing device, a driving pulse control device capable of variably setting the pulse width of a driving signal is used, and this driving pulse control device is provided in correspondence with each nozzle.

In addition, discharge amount control may be done for each nozzle independently under a variable condition based on an arbitrary combination of the driving voltage of a driving signal and its pulse width.

As described above, according to the first embodiment, discharge amount changing devices (more specifically, voltage control devices capable of changing the driving voltage values of driving pulses to be respectively supplied to a plurality of nozzles) are respectively connected to a plurality of nozzles so as to change the discharge amounts of the respective nozzles independently, thereby easily making the discharge amounts of the respective nozzles uniform. This makes it possible to control the amounts of ink filled in the respective pixels to be uniform. This eliminates the necessity to make adjustment or the like of the ink discharge interval like shading correction. In shading correction, the amount of ink filled in one pixel is corrected by adjusting the ink discharge interval (ink discharge count). In some cases, however, the amount of ink filled in one pixel cannot be made to accurately coincide with a target value by adjustment of an ink discharge count alone. In contrast, in the first embodiment, since the ink discharge amount per droplet can be changed by adjusting a driving voltage or driving pulse for each nozzle, the amount of ink filled in one pixel can be made to accurately coincide with a target value. Therefore, as compared with a case wherein a color filter is manufactured by shading correction, a high-quality color filter with less variations in ink filling amount among pixels can be manufactured.

(Modification to First Embodiment)

In this modification, a discharge amount correction method used when a plurality of color filters with different sizes are manufactured from one glass substrate will be described.

Figure 26:
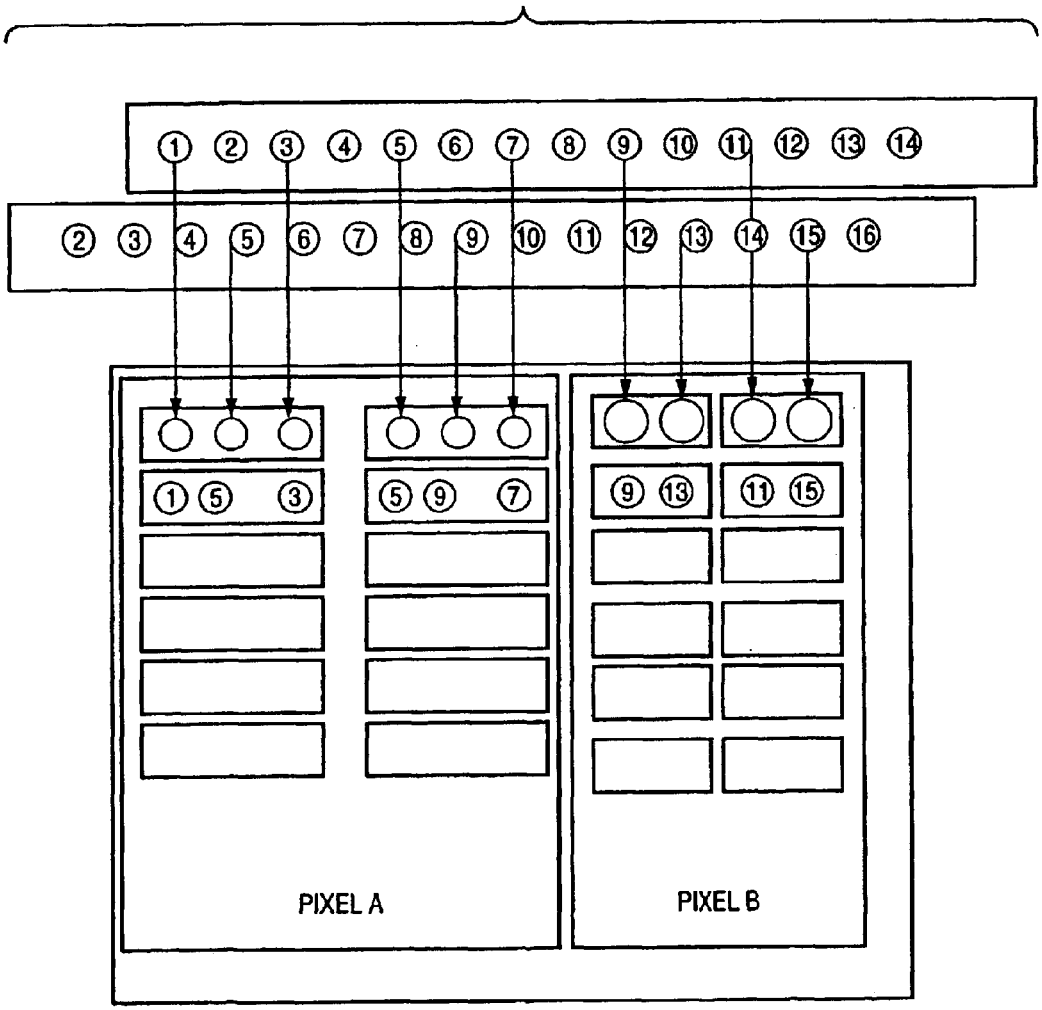
FIG. 26 is a view showing how a plurality of color filters having pixels with different sizes are manufactured from one glass substrate.

FIG. 26 is a view showing a case wherein a plurality of color filters (a color filter having pixels A and a color filter having pixels B) having pixels with different sizes are manufactured from one glass substrate.

When ink is to be discharged to such pixels with different sizes, the amount of ink discharged from a nozzle must be changed in accordance with the size of a pixel. Referring to FIG. 26, since a nozzle of No. 9 is used to discharge ink to both the pixel A and the pixel B, the discharge amount must be changed when ink is discharged to the respective pixels. In this case, only the nozzle of No. 9 is used for printing for both kinds of pixels. In practice, however, nozzles other than the nozzle of No. 9 are used for printing to both kinds of pixels. In addition, obviously, when different kinds of color filters are to be manufactured, different nozzles are used for printing to a plurality of kinds of pixels. In order to cope with various forms, an arrangement that can independently change the discharge amounts of all the nozzles is required. Note that in this modification, although the amounts of ink discharged from the respective nozzles are individually controlled, the discharge amount of all the nozzles is not made uniform. However, when printing is to be performed to pixels with the same size, control is performed to discharge ink in the same amount. That is, discharge amount control is performed such that ink is discharged to the pixel A in a discharge amount A, and ink is discharged to the pixel B in a discharge amount B. As in the first embodiment, in this modification, the amounts of ink discharged to pixels with the same size are made uniform.

Figure 27:
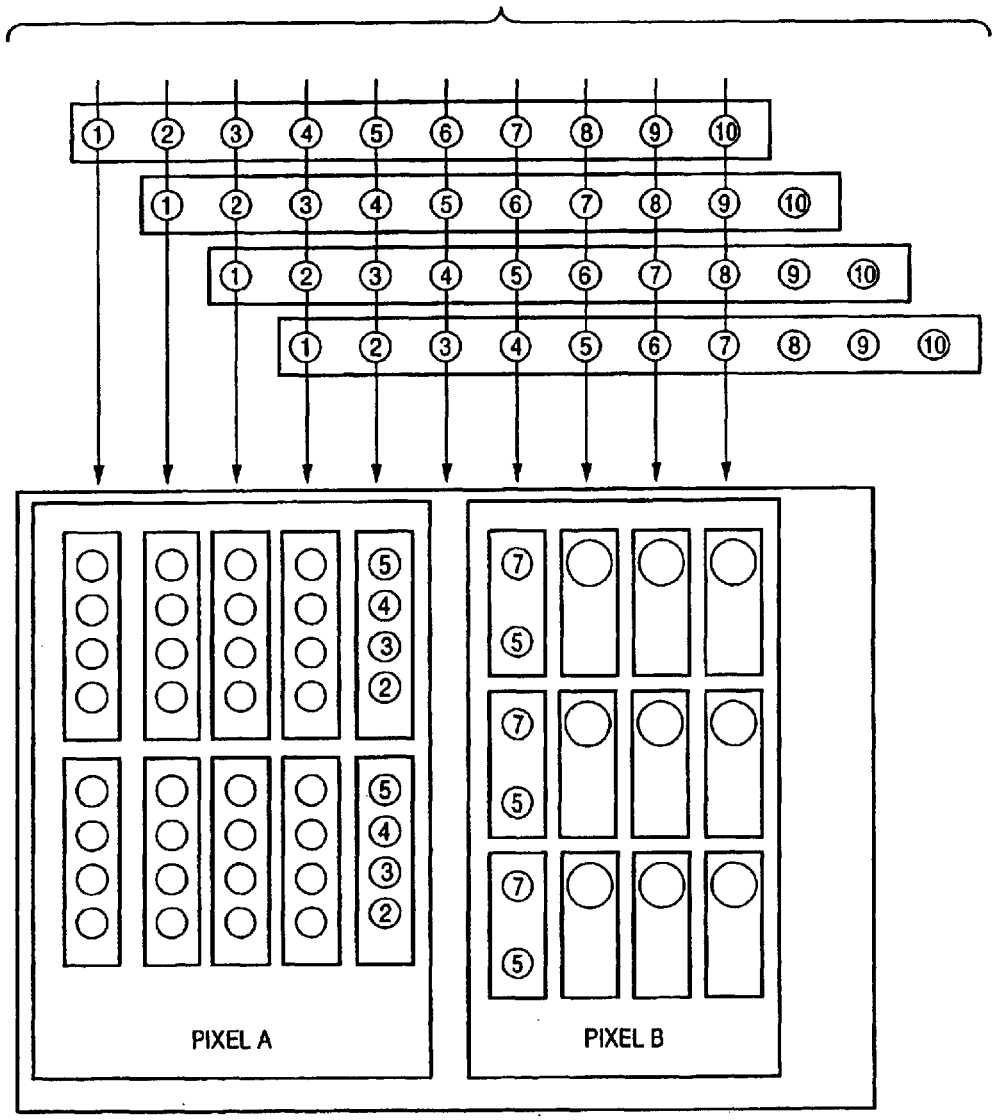
FIG. 27 is a view showing how a plurality of color filters having pixels with different sizes are manufactured from one glass substrate.

FIG. 27 is a view showing a case wherein the scanning direction of the ink-jet head is set to the longitudinal direction of pixels. In this case as well, a nozzle of No. 5 is used to print both a pixel A and a pixel B, the ink discharge amount per droplet must be changed. In this case, the scanning count must be changed as well as the ink discharge amount. That is, four scanning operations are performed for the pixel A, whereas two scanning operations are performed for the pixel B.

Figure 28:
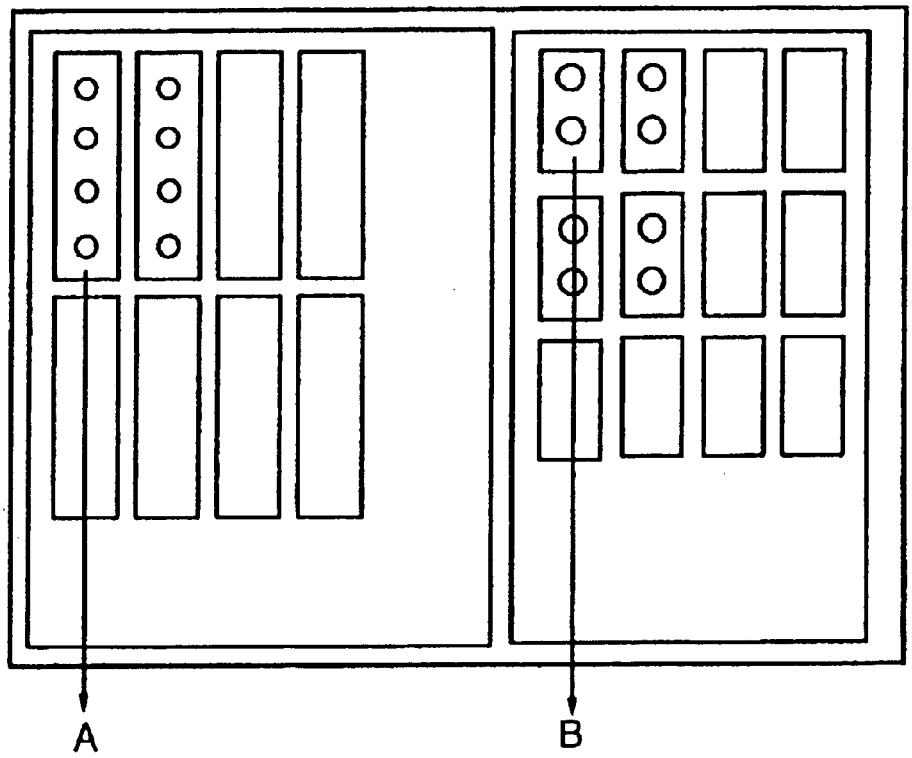
FIG. 28 is a view showing how a plurality of color filters having pixels with different sizes are manufactured from one glass substrate.

FIG. 28 also shows a case wherein both the printing count and the discharge amount must be changed for each nozzle.

As described above, according to this modification, a discharge amount changing device is provided in correspondence with each nozzle to independently change the discharge amount of each nozzle. With this arrangement, even if ink is to be discharged to pixels with different sizes by using the same nozzle, ink can be discharged in discharge amounts corresponding to the sizes of the respective pixels. Therefore, a target amount of ink can be filled in each pixel. This makes it possible to obtain a plurality of kinds of color filters having pixels with different sizes from one substrate by a simple method. That is, a plurality of kinds of color filters having pixels with different sizes can be obtained from a single substrate by using the simple method.

(Second Embodiment)

As described above, the amount of ink discharged from each nozzle is influenced by whether or not ink is discharged from adjacent nozzles and number of nozzles in use. The second embodiment is characterized in that driving conditions such as the driving voltage value applied to each nozzle and its pulse width are controlled in consideration of the influences of these factors. Other arrangements (e.g., the discharge amount control circuit shown in FIG. 18) are common to the first embodiment, and hence a description thereof will be omitted. In the second embodiment as well, a discharge amount changing device is provided in correspondence with each nozzle so as to independently change the ink discharge amount of each nozzle.

Figure 29:
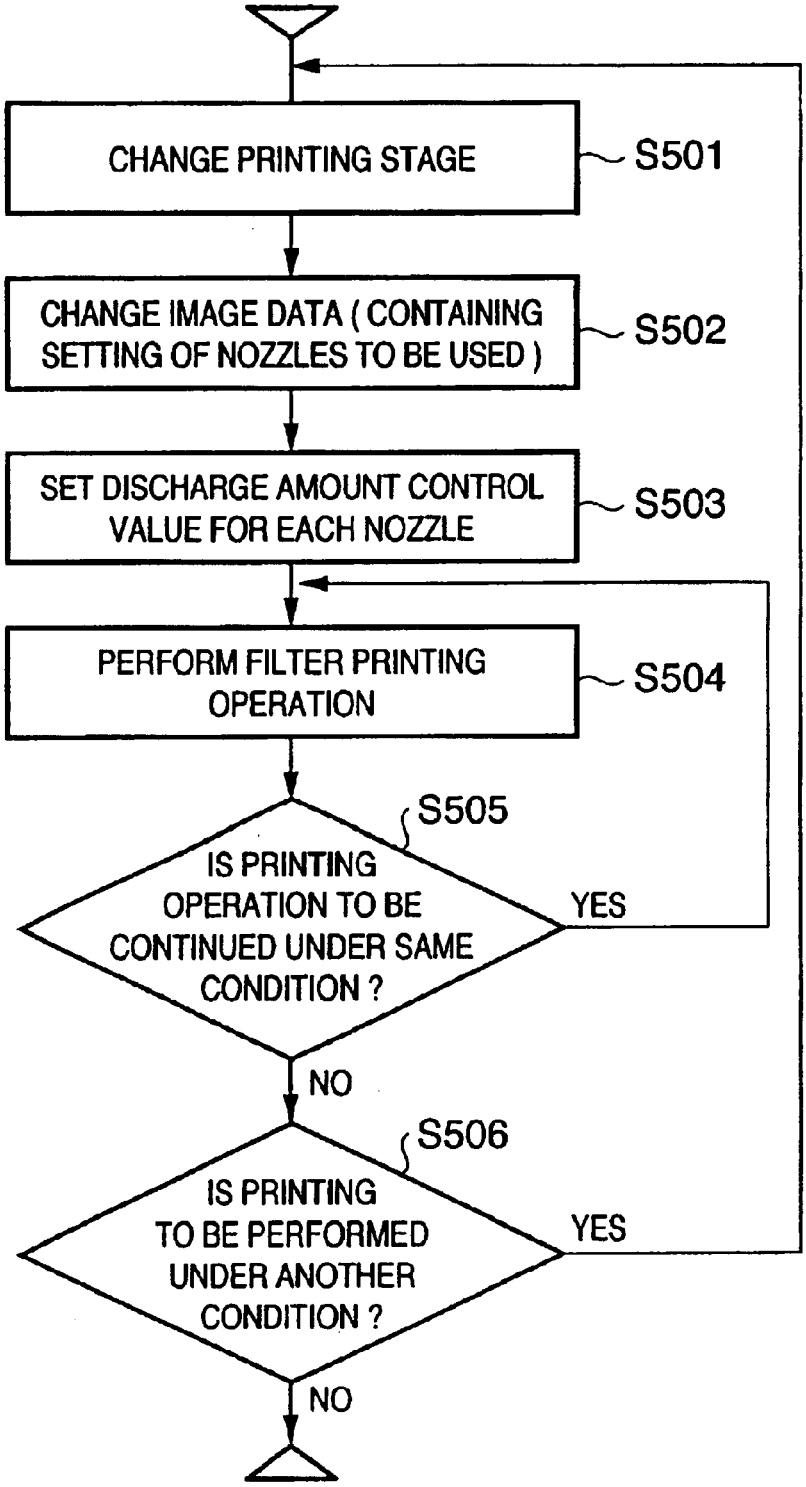
FIG. 29 is a flow chart showing an embodiment of the control method for a printing apparatus.

FIG. 29 is a flow chart showing color filter printing operation which is a characteristic feature of this embodiment. Referring to FIG. 29, "change printing stage" indicates that the size or resolution of a filter 54 to be formed, the shape or size of a glass substrate 53, or the like changes (step S501). When one of these conditions changes, the combination of nozzles to be used changes. In accordance with this change, the image data for printing operation using each nozzle is changed (step S502).

Figure 35:
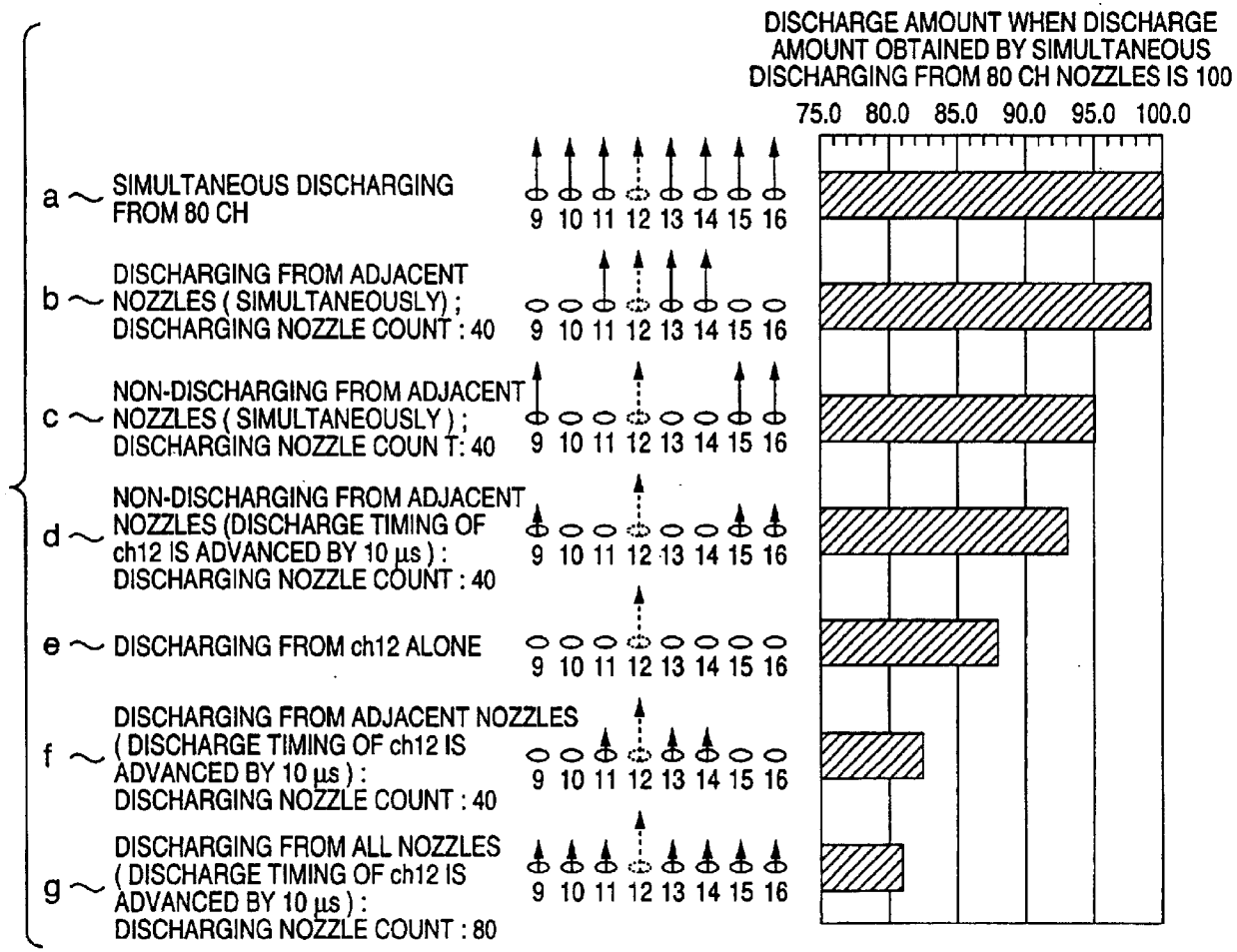
FIG. 35 is a graph showing an example of measurement on adjacent nozzle crosstalk amounts in the ink-jet head.
Figure 36:
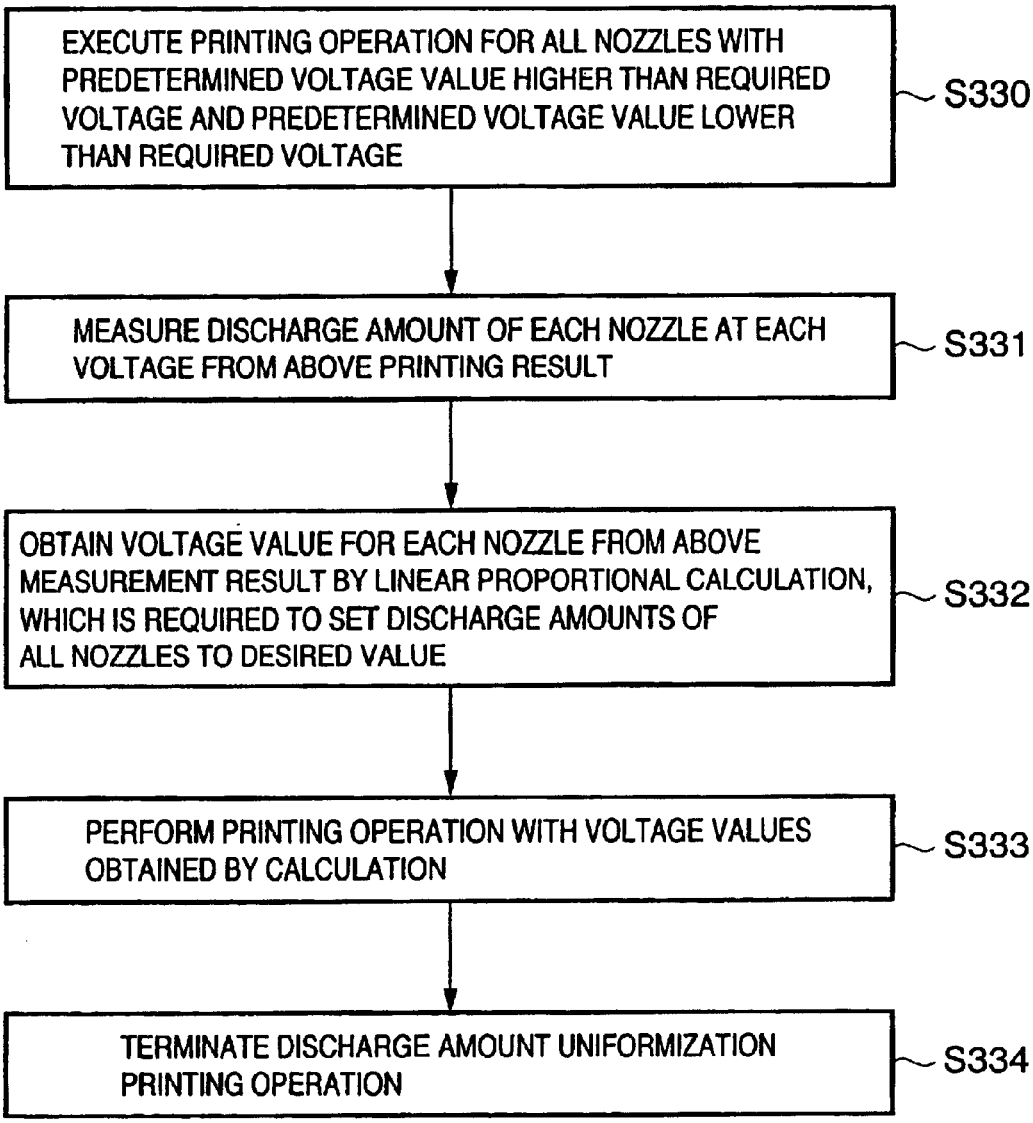
FIG. 36 is a flow chart for explaining a discharge amount correction sequence.

As described in "Background of Invention", when the combination of nozzles to be used changes, the discharge amount of a nozzle subjected to a change in the condition of whether or not the adjacent nozzles are used changes due to the influence of adjacent nozzle crosstalk even if ink is discharged under the same driving condition from an electrical viewpoint. In consideration of the influence of adjacent nozzle crosstalk, therefore, a corresponding discharge amount control value is set (step S503). More specifically, when a nozzle use condition like the one indicated by "(b)" in FIG. 35 is changed to a nozzle use condition like the one indicated by "(c)" in FIG. 35, the condition of whether or not the adjacent nozzles (ch11 and ch13) adjacent to the nozzle of interest (ch12) changes, and the nozzle of interest is influenced by adjacent nozzle crosstalk. In this case, the discharge amount of the nozzle of interest decreases. A condition (discharge amount control value) required to compensate for this decrease in discharge amount is set. As a discharge amount control value, therefore, a conditional value that can correct the change in discharge amount due to the influence of adjacent nozzle crosstalk can be used. For example, this condition includes a driving voltage value or pulse width. This discharge amount control value is obtained in advance.

After a discharge amount control value is set in the above manner, filter printing operation is performed (step S504). Filter printing operation can be performed by repeatedly using the same discharge amount control value as long as the advance nozzle crosstalk condition changes (YES in step S505).

If the size or resolution of the filter 54 to be formed, the shape or size of the glass substrate 53, or the like changes, the discharge amount of a nozzle of interest changes due to the influence of adjacent nozzle crosstalk even if ink is discharged under the same driving condition from an electrical viewpoint. A corresponding discharge amount control value is set again (YES in step S506).

According to the above arrangement, even if a use condition for a given nozzle is changed, since the nozzle is hardly influenced by adjacent nozzle crosstalk, the discharge amount of the nozzle changes. Therefore, the amount of ink discharged to each pixel of a color filter is kept constant.

Assume that ink is to be discharged to one pixel of a filter a plurality of number of times using a single nozzle or a plurality of nozzles. In this case, in order to keep the discharge amount of ink on a specific pixel of a filter constant, the discharge amounts of the respective nozzles need not always be kept constant. That is, the ink discharge amount in one of a plurality of ink discharging operations may be adjusted such that the total discharge amount in a plurality of ink discharging operations for a specific pixel becomes a target amount.

Figure 30:
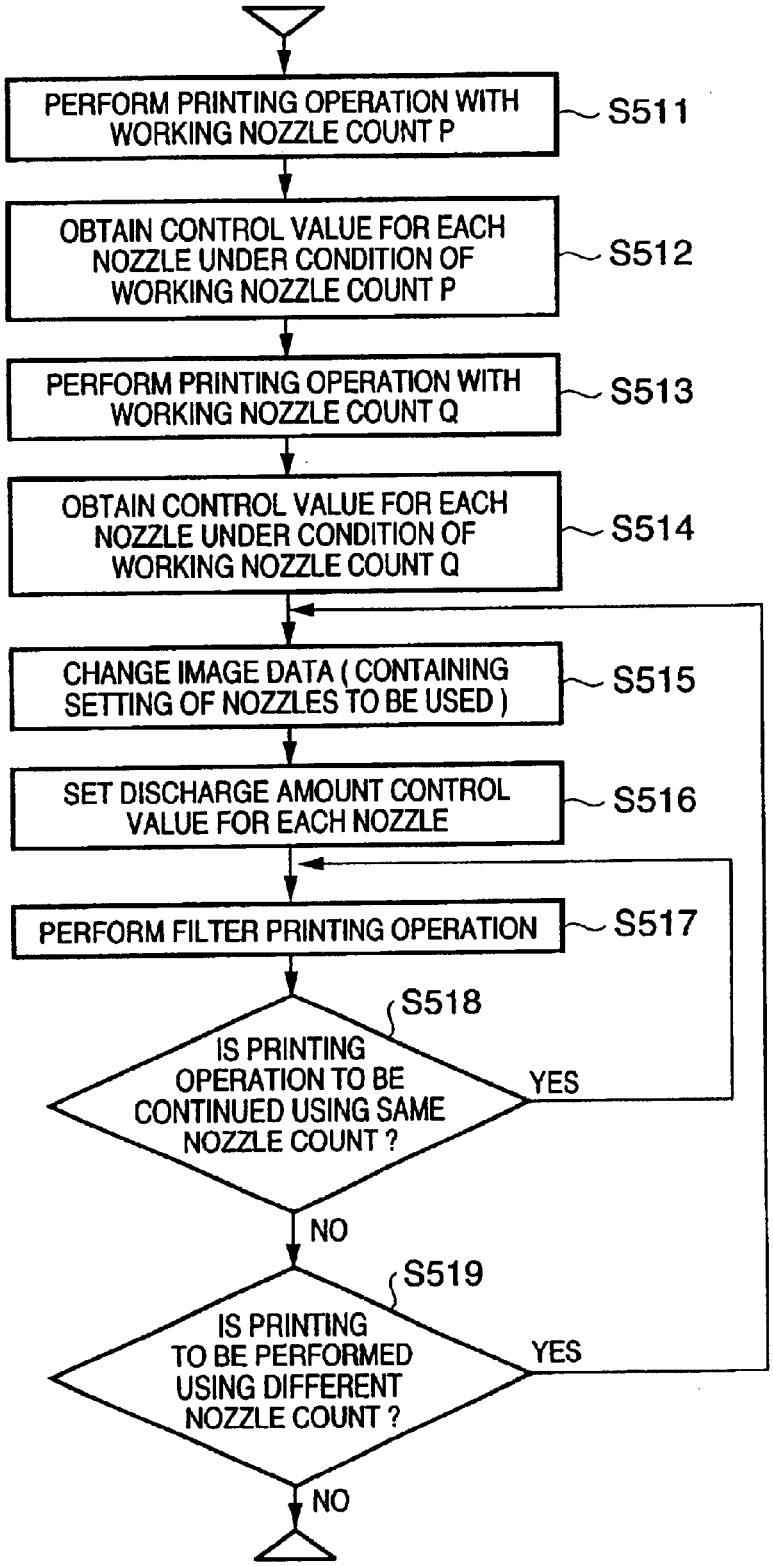
FIG. 30 is a flow chart showing another embodiment of the control method for the printing apparatus.

FIG. 30 is a flow chart for printing operation according to another embodiment. FIG. 30 shows operation to be performed when the condition of the number of nozzles to be used changes. Consider an ink-jet head having an array of 160 nozzles. When a color filter is printed by using this head, all the 160 nozzles are used for printing operation. In this operation, owing to the relationship between the size of the color filter and the number of nozzles, the print width decreases in printing operation for the last scanning area, resulting in the appearance of surplus nozzles that are not used. In this case, for example, only 100 nozzles of the 160 nozzles are used to perform printing operation in the last scanning operation alone.

Assume that printing is performed either with a working nozzle count P (160) or with a working nozzle count Q (100), and in the case with Q, the first to 100th nozzles are used, but the 101st to 160th nozzles are not used. Consider the 100th nozzle. In the case with P, since ink is almost simultaneously discharged from the adjacent nozzles, the discharge amount of the 100th nozzle is large. In the case with Q, since the 101st nozzle is not used although ink is almost simultaneously discharged from the 99th nozzle, the discharge amount of the 100th nozzle (nozzle of interest) becomes smaller than in the case with P.

Depending on the case with P or Q, therefore, the discharge amount control value set for each nozzle must be changed, as shown in FIG. 30. Such control values are calculated in advance (steps S512 and S514) from the result obtained by performing test printing under the respective conditions of P and Q and measuring discharge amounts in advance (steps S511 and S513). For the 100th nozzle, the correction value is switched to a value that increases the discharge amount in only printing operation in the last scanning area, thereby keeping the discharge amount of the nozzle of interest constant. In steps S511 to S514, data are generated in advance with respect to a plurality of combinations of P and Q.

After step S514, image data is changed in step S515 in accordance with a color filter to be manufactured, and a discharge amount control value for each nozzle is set in step S516 on the basis of the data obtained in steps S512 and 514. In step S517, printing operation for the color filter is performed. In steps S518 and S519, it is checked whether color filter printing operation is performed with the same number of nozzles as that used previously or the number of nozzles used previously is changed to perform printing operation with a different number of nozzles. If printing operation is to be continued with the same number of nozzles, no discharge amount control values are changed. If printing operation is to be performed with a different number of nozzles, the discharge amount control values are changed, and the flow returns to step S515.

By properly changing discharge amount control values in accordance with a change in the number of nozzles to be used, the amounts of ink discharged onto the pixels of a color filter are kept constant because the discharge amount of each nozzle does not change even if the influence of adjacent nozzle crosstalk thereon changes.

Figure 31:
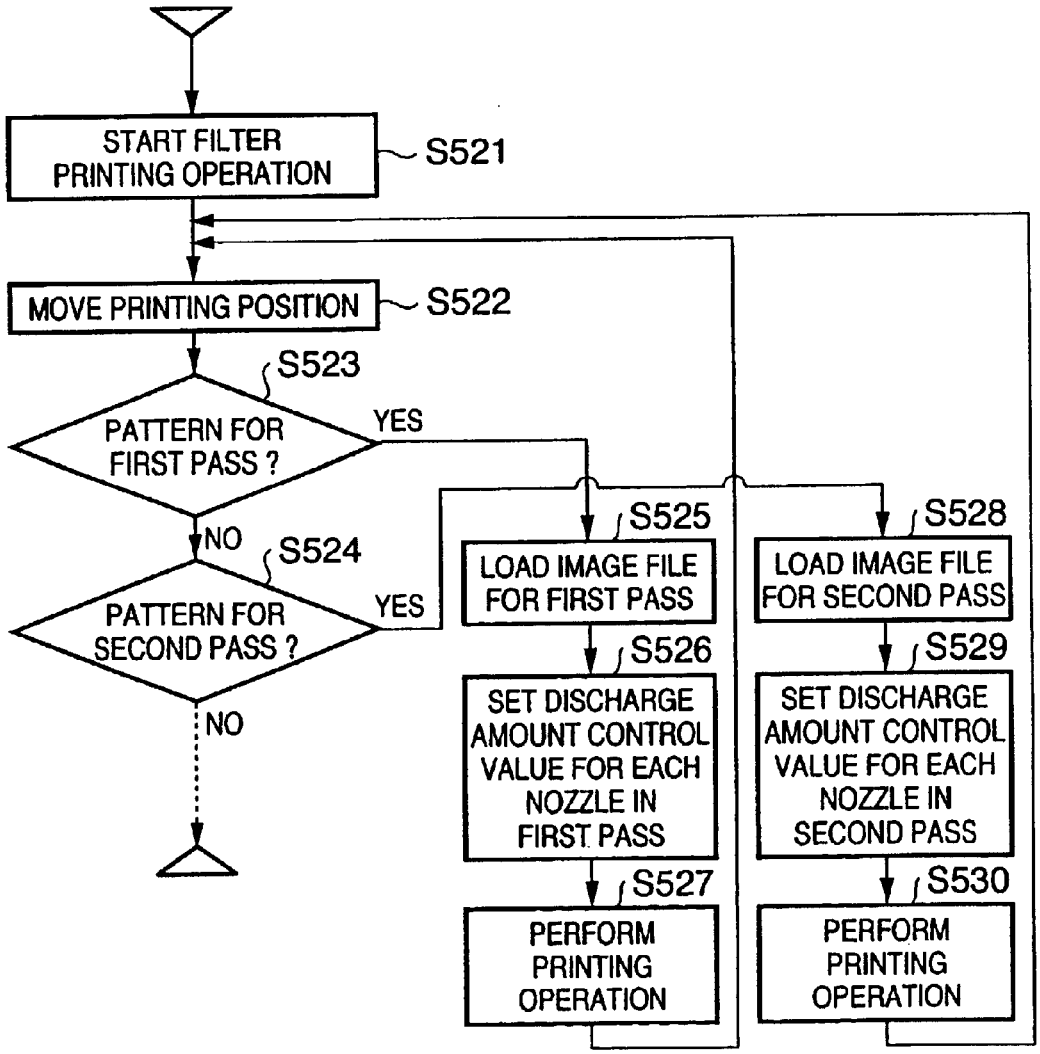
FIG. 31 is a flow chart showing still another embodiment of the control method for the printing apparatus.

FIG. 31 is a flow chart for printing operation according to still another embodiment. FIG. 31 shows operation to be performed when the combination of nozzles to be used changes for each printing pass. Consider in particular a case wherein the number of nozzles to be used in the first pass in which printing is performed by scanning the head over a substrate for the first time is different from that in the second pass in which printing is performed by scanning the head over the substrate for the second time.

Consider a given nozzle A which is used in both the first and second passes. The condition of whether or not the nozzles adjacent to the nozzle A (nozzle of interest) are used may differ in the first and second passes. That is, the nozzles adjacent to the nozzle A are used in the first pass, whereas the nozzles adjacent to the nozzle A are not used in the second pass, or vice versa. In such a case, the discharge amount of the nozzle A differs in the first and second passes owing to the influence of adjacent nozzle crosstalk described with reference to FIG. 35.

Different discharge amount control values are set for the nozzle A in the first and second passes so as to set the discharge amount of the nozzle A in the first pass and that in the second pass to a predetermined desired value. Such a change in discharge amount control value is applied to every nozzle on which the influence of adjacent nozzle crosstalk changes in the first and second passes.

As shown in FIG. 31, properly changing and setting the discharge amount control value for each nozzle in each pass in accordance with the adjacent nozzle discharging condition makes the discharge amount of each nozzle in the first pass equal to that in the second pass, thereby realizing uniformization of the discharge amounts of the nozzles.

When the combination of nozzles to be used is changed in each pass for printing operation by this method as well, the discharge amount of each nozzle is kept constant, and the amount of ink discharged to each pixel of a filter is kept constant.

More specifically, filter printing operation is started in step S521 in FIG. 31. When one scanning operation is completed, the position of the ink-jet head is shifted in the sub-scanning direction in step S522. In this case, if a pattern for the first pass can be used (YES in step S523), the image pattern for the first pass is loaded in step S525. In step S526, optimal first discharge amount control values are set for the respective nozzles to be used in the first pass. In step S527, color filter printing operation is performed in step S527. If it is determined in steps S523 and S524 that a pattern for the second pass is required, the image pattern for the second pass is loaded in step S528. In step S529, optimal second discharge amount control values are set for the respective nozzles to be used in the second pass. In step S530, color filter printing operation is performed.

According to this arrangement, when different nozzles are to be used in the respective passes, the discharge amount control values are properly changed in the respective passes. This prevents a change in the discharge amount of a nozzle (nozzle A of interest) subjected to a change in the use state of the adjacent nozzles in the respective passes.

Figure 32:
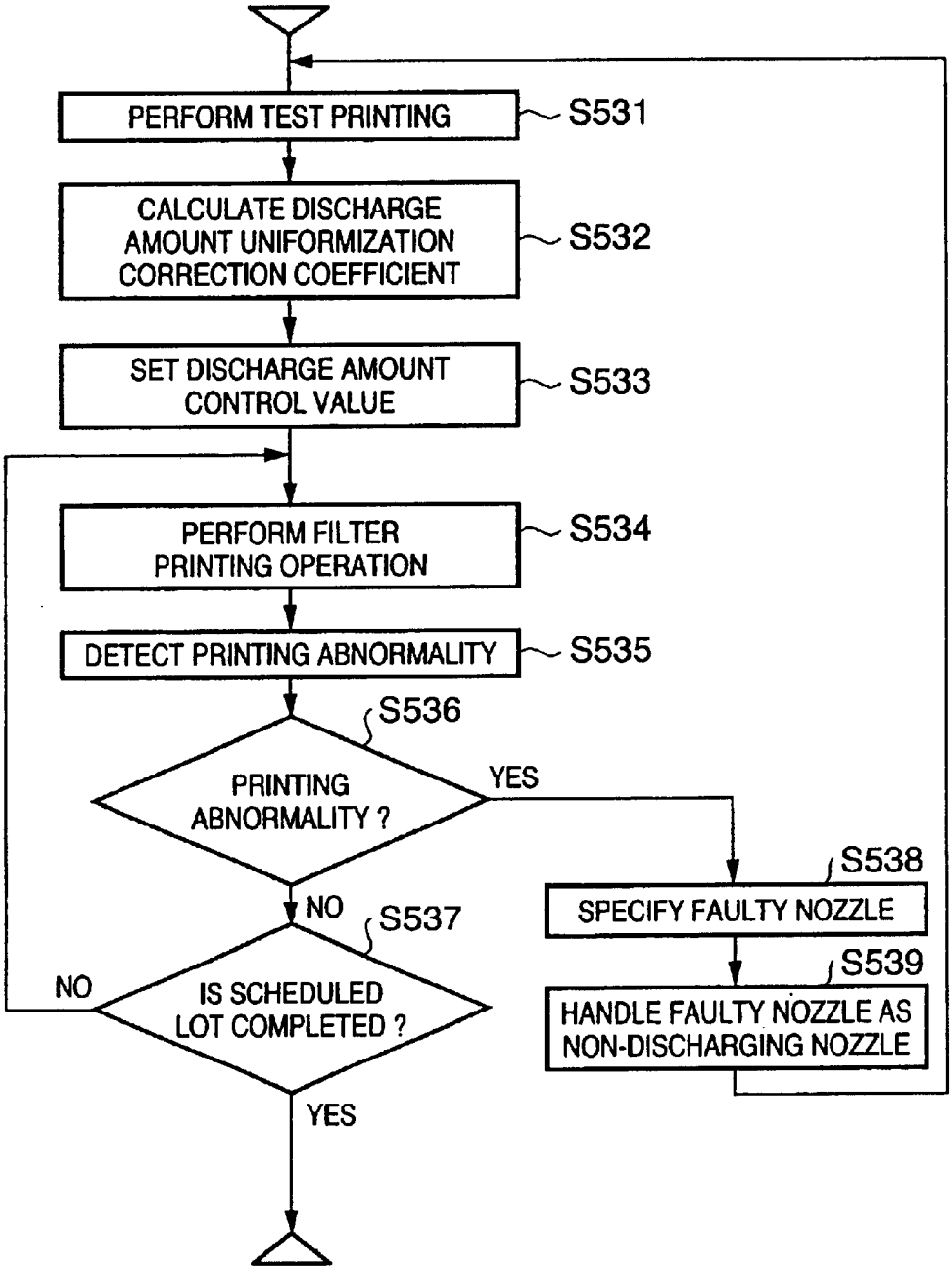
FIG. 32 is a flow chart showing still another embodiment of the control method for the printing apparatus.

FIG. 32 is a flow chart for printing operation according to still another embodiment. FIG. 32 shows operation to be performed when a given nozzle B of the ink-jet head becomes faulty, and printing is performed without using the nozzle B.

Several methods of performing color filter printing operation without using the nozzle B are available. Consider in this case a method of making the discharge amounts of all the nozzles in one discharging operation constant, and compensating for a pixel to be initially printed by the nozzle B by using another nozzle (for example, a nozzle A or nozzle C which is adjacent to the faulty nozzle B).

When the nozzle B is not used, the discharge amounts of the adjacent nozzles A and C become smaller than those when the nozzle B is used, owing to the principle of adjacent nozzle crosstalk in FIG. 35.

As shown in FIG. 32, therefore, the faulty nozzle B is specified as a non-discharging nozzle, and test printing is performed again (step S531) to obtain discharge amount uniformization correction coefficients for the adjacent nozzles A and B again (step S532). The obtained discharge amount uniformization correction coefficients are set again (step S533), and the filter printing operation is resumed (step S534). At this time, discharge amount control values for the nozzles A and C are so set as to make the discharge amount of the nozzles A and C equal to that of the remaining nozzles, i.e., the desired value. In printing operation in step S534, detection of a printing abnormality is continued (step S535). If a printing abnormality is detected (YES in step S536), a faulty nozzle is specified in step S538. In step S539, the specified faulty nozzle is set as a non-discharging nozzle, and the flow returns to step S531. If no printing abnormality is detected in step S536, the flow advances to step S537 to repeat steps S531 to S537 until filters are manufactured in a scheduled lot.

With this method in FIG. 32, even if the nozzle B becomes faulty and filter printing operation is performed without using the nozzle B, the discharge amount of the adjacent nozzles A and C is kept constant, and the amount of ink discharged onto each pixel of a filter is kept constant.

Figure 33:
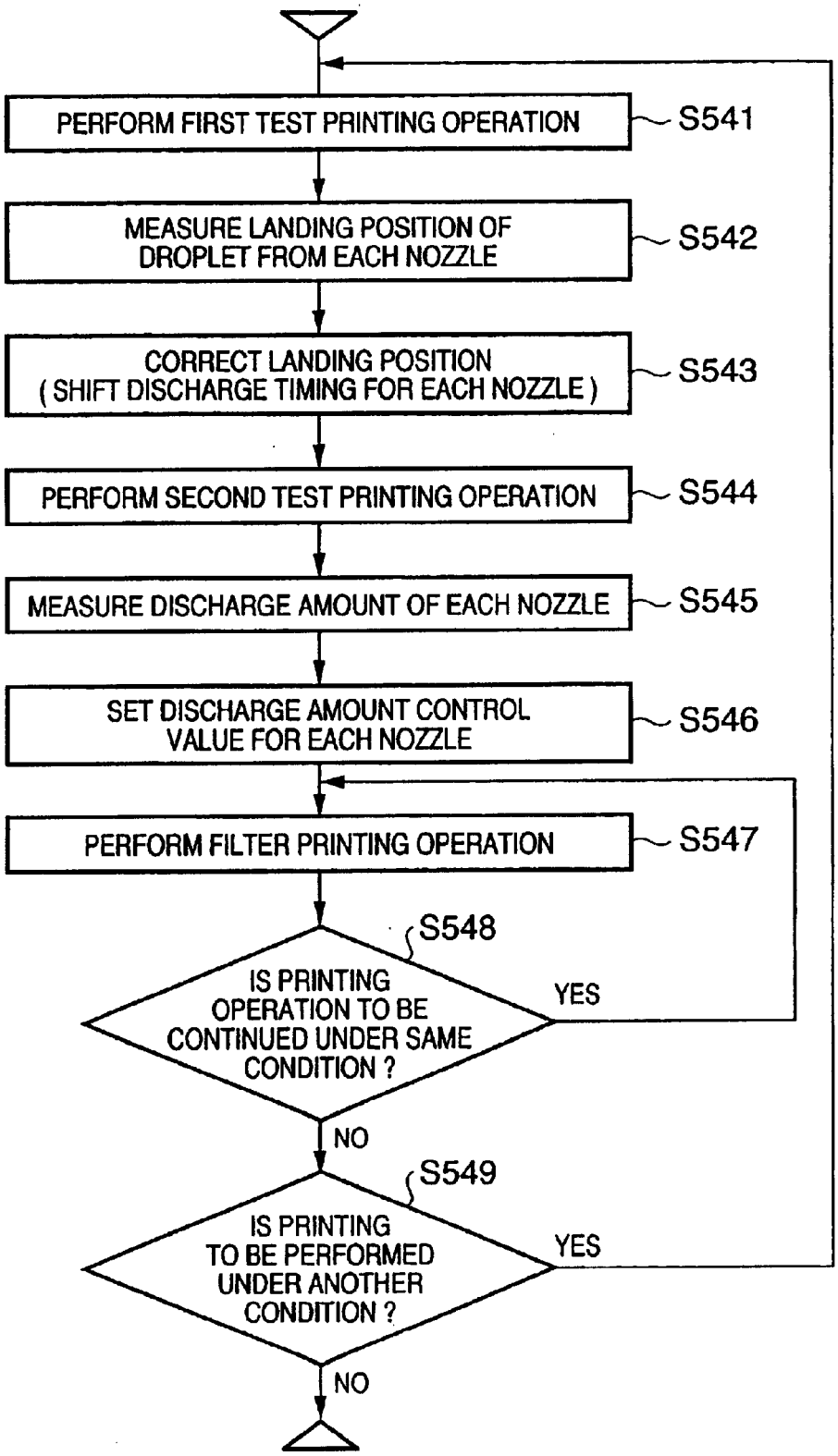
FIG. 33 is a flow chart showing still another embodiment of the control method for the printing apparatus.

FIG. 33 is a flow chart for printing operation according to still another embodiment. FIG. 33 shows operation to be performed when the landing position is corrected for each nozzle by slightly advancing and retarding the discharge timing of each nozzle.

In some cases, even if all nozzles are simultaneously driven, the landing positions for the respective nozzles vary due to manufacture precision variations among ink-jet heads. In this case, the landing position for each nozzle must be corrected by slightly advancing/retarding the driving timing of each nozzle. Consider such a case below.

In using the same nozzle B, when the driving timings of the nozzles A and C adjacent to the nozzle B are advanced/retarded, the discharge amounts of the nozzles A and C change due to the influence of adjacent nozzle crosstalk, as described with reference to FIG. 35. In order to compensate for this error amount, the discharge amount of the nozzle B is measured under the condition that the driving timings of the nozzles A and C are advanced/retarded, and a discharge amount control value for the nozzle B is obtained from the measurement value. At this time, a discharge amount control value for the nozzle B is so set as to make the discharge amount of the nozzle B equal to that of the remaining nozzles, which is a predetermined desired value.

Even in performing printing operation using the same ink-jet head, when, for example, the shape, size, or material of a filter changes, the moving speed (scanning speed) of the ink-jet head changes at the time of printing operation. Along with this change, a discharge timing for compensation for a landing position changes. As a consequence, the degree of influence of adjacent nozzle crosstalk changes, and the discharge amount changes. If, for example, the moving speed decreases, the difference in driving timing between adjacent nozzles increases. In this case, the discharge amount generally decreases. This decrease in amount is determined when the moving speed of the ink-jet head is determined. Therefore, a discharge amount control value that makes the discharge amount of each nozzle equal to a constant desired value can be determined.

With the method shown in FIG. 33, even when the moving speed of the ink-jet head changes, and the shift amount of the discharge amount timing for the correction of the landing position changes, the discharge amount of each nozzle is kept constant, and the amount of ink discharged to each pixel of the filter is kept constant.

More specifically, the first test printing is performed first (step S541), and the landing position of a droplet from each nozzle is measured (step S542). The landing position is corrected on the basis of this measurement result (step S543). Subsequently, the second test printing is performed (step S544), and the discharge amount of each nozzle is measured (step S545). A discharge amount control value for each nozzle is set (step S546). Filter printing operation is then performed (step S547). If filter printing is to be continued under this condition (YES in step S548), filter printing is repeated. If filter printing is to be performed under another condition (YES in step S549), the flow returns to step S541 to repeat the same operation.

Figure 34:
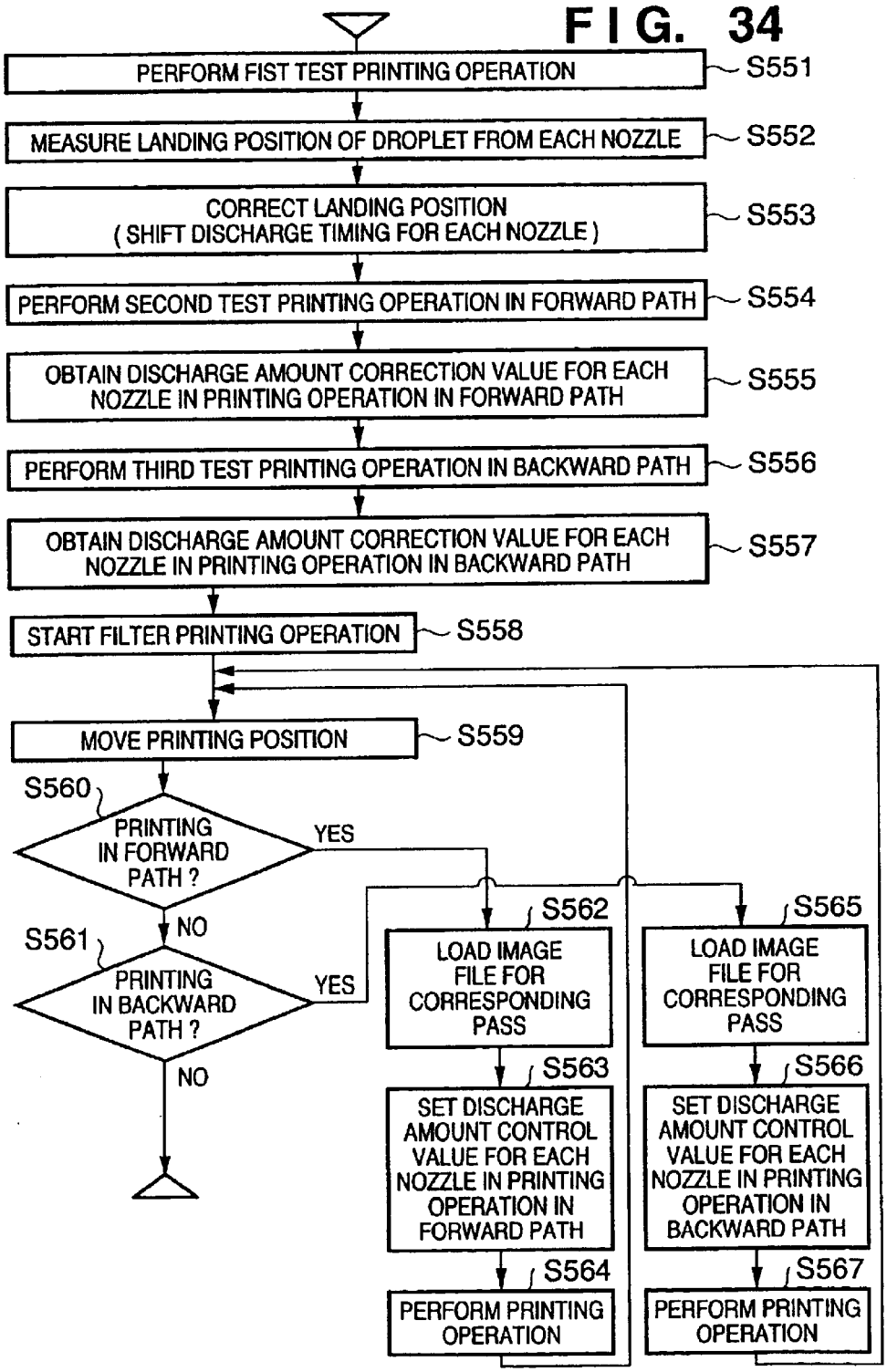
FIG. 34 is a flow chart showing still another embodiment of the control method for the printing apparatus.

FIG. 34 is a flow chart for printing operation according to still another embodiment. FIG. 34 shows operation to be performed when filter printing is performed in the forward and backward paths of movement of the ink-jet head in correcting the landing position of a droplet from each nozzle by slightly advancing/retarding the discharge timing of each nozzle.

As in the case shown in FIG. 33, even if all the nozzles are simultaneously driven, the landing positions of droplets from the respective nozzles may vary due to manufacture precision variations among ink-jet heads. For this reason, the landing position of a droplet from each nozzle is corrected by advancing/retarding the discharge timing of each nozzle little by little.

In order to shorten the time required for filter printing, it is required that printing be performed in both the forward and backward paths of movement of the ink-jet head. In this case, the discharge timing shift amount for the correction of a landing position for a given nozzle B reverses in sign. More specifically, if, for example, the driving timing of the nozzle B is advanced from that of the nozzles A and C by 1 μsec in printing operation in the forward path to correct the landing position for the nozzle B, the driving timing of the nozzle B must be retarded from that of the nozzles A and C by 1 μsec in printing operation in the backward path. The discharge amount of the nozzle B differs depending on whether the driving timing of the adjacent nozzles A and C is advanced or retarded by 1 μsec. In general, the discharge amount decreases when the driving timing is retarded by 1 μsec.

Referring to FIG. 34, test printing operations in the forward and backward paths of the ink-jet head are performed in advance to obtain a discharge amount control value for each nozzle in each test printing operation (steps S551 to S557). In printing in the forward path (YES in step S559), a discharge amount control value for printing in the forward path is set (steps S562 and S563). In printing in the backward path (YES in step S561), a discharge amount control value for printing in the backward path is set (steps S565 and S566). The above operation can compensate for the influence of adjacent nozzle crosstalk in the forward and backward paths, thereby making the discharge amount of a given nozzle in printing in the forward path equal to that in printing in the backward path.

With the method shown in FIG. 34, in correcting the landing position of a droplet from each nozzle by slightly advancing/retarding the discharge amount timing of each nozzle, even when printing for a filter is performed in both the forward and backward paths of movement of the ink-jet head, the discharge amount of each nozzle is kept constant, and the amount of ink discharged to each pixel of the filter is kept constant.

As described above, according to the second embodiment, since discharge amount control values (e.g., driving voltage values or pulse widths) are properly changed with changes in discharging conditions in consideration of the influence of adjacent nozzle crosstalk accompanying changes in discharging conditions of nozzles, printing operation is almost free from the influence of adjacent nozzle crosstalk, and the discharge amount of each nozzle undergoes no change. In controlling the discharge amount of a nozzle of interest, in particular, since a discharge amount control value for the nozzle of interest is properly changed with a change in a discharging condition for nozzles adjacent to the nozzle of interest (whether the adjacent nozzles are simultaneously driven, driven at a near time, or not driven), the discharge amount of each nozzle can always be kept uniform. This makes it possible to print an image without unevenness.

When color filters are manufactured by this method, high-quality color filters without unevenness can be stably manufactured at a high yield. In addition, this method can efficiently cope with changes in product specifications.

(Other Embodiments)

The present invention is not limited to the above embodiments, and various applications can be made.

For example, colored portions constituting a color filter are not limited to be formed on a glass substrate, and may be formed on pixel electrodes to let the resultant structure function as a color filter. A colored portion is formed on a pixel electrode either by forming an ink-receiving layer on the pixel electrode and applying ink to the ink-receiving layer or by directly applying resin ink containing a coloring material to the pixel electrode.

In addition, the present invention is not limited to the above color filter manufacturing method, and can also be applied to, for example, the manufacture of an EL (electroluminescence) display device. An EL display device has a structure in which a thin film containing inorganic and organic fluorescent compounds is sandwiched between a cathode and an anode. In this device, electrons and holes are injected into the thin film to recombine and generate excitons, and light is emitted by using fluorescence or phosphorescence that occurs when the excitons are deactivated. Of the fluorescent materials used for such EL display devices, materials that emit red, green, and blue light are used in the manufacturing apparatus of the present invention (the manufacturing apparatus including the liquid application apparatus which has the liquid discharge head and the discharge control circuit shown in FIG. 18 and can execute the flow charts shown in FIGS. 21 and 29 to 34) to form a pattern on a device substrate such as a TFT substrate by the ink-jet method, thereby manufacturing a spontaneous emission type full-color EL display device. The present invention incorporates such an EL display device, an EL display device manufacturing method and apparatus, and the like.

The manufacturing apparatus of the present invention may include a device for executing surface treatments such as a plasma process, UV process, and coupling process for a resin resist, pixel electrodes, and the surface of a lower layer to help adhesion of an EL material.

The EL display device manufactured by the manufacturing method of the present invention can be applied to the field of low information, such as segment display and still image display based on full-frame emission, and can also be used as a light source having a point/line/plane shape. In addition, a full-color display device with high luminance and excellent response can be obtained by using passive display devices and active devices such as TFTs.

Figure 37:
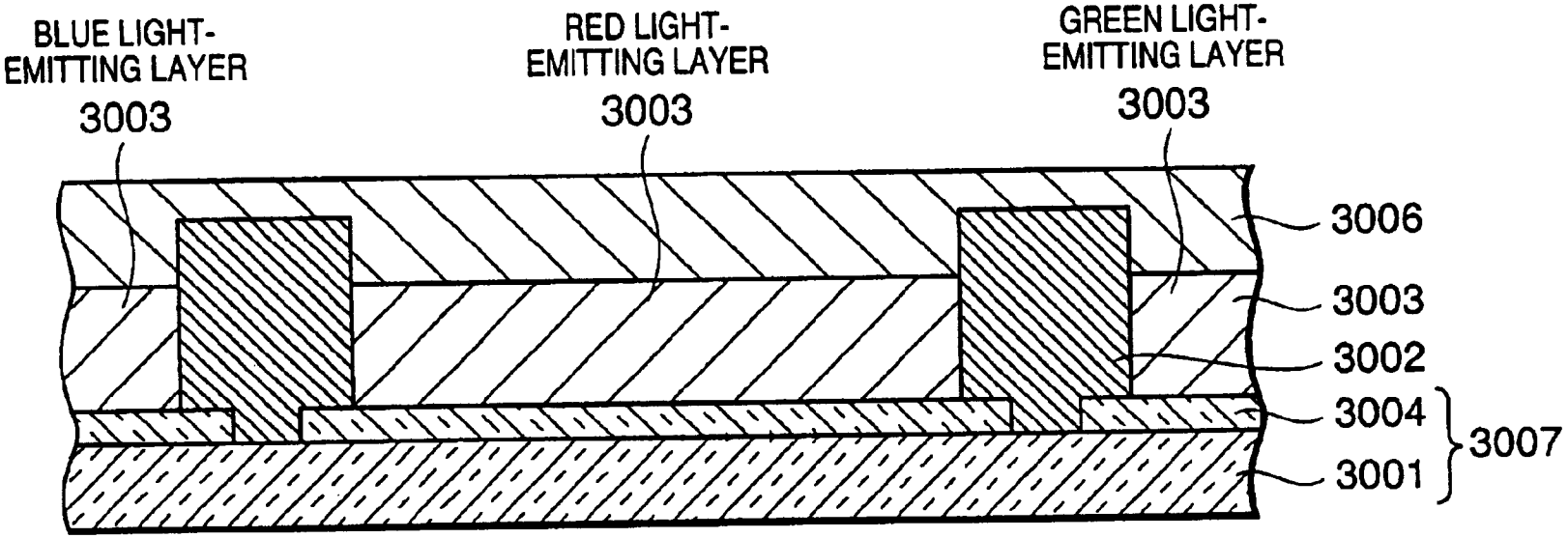
FIG. 37 is a view showing an example of the arrangement of an EL device.
Figure 38A:
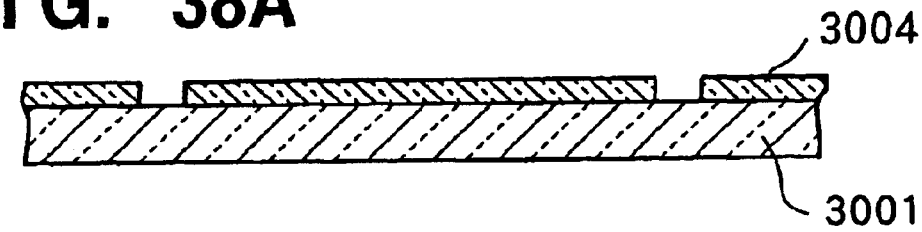
FIGS. 38A to 38D are views showing an example of a manufacturing process for an EL device.
Figure 38B:
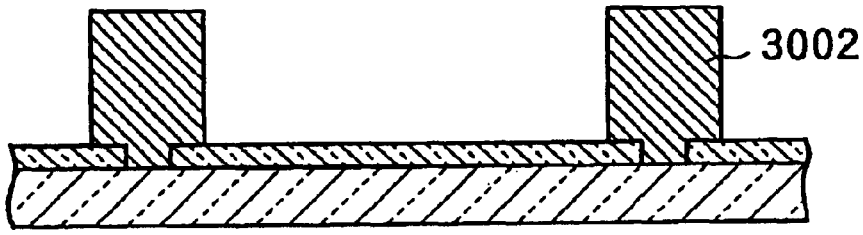
Figure 38C:
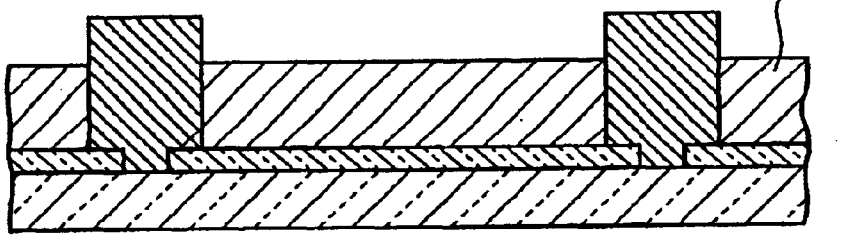
Figure 38D:
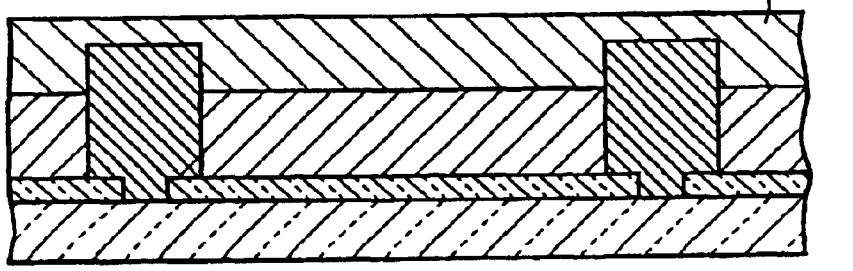

An example of the organic EL device manufactured by the present invention will be described below. FIG. 37 is a sectional view showing the multilayer structure of the organic EL device. The organic EL device shown in FIG. 37 is comprised of a transparent substrate 3001, partition walls (partitioning members) 3002, light-emitting layers (light-emitting portions) 3003, transparent electrodes 3004, and a metal layer 3006. Reference numeral 3007 denotes a portion constituted by the transparent substrate 3001 and transparent electrode 3004. This portion will be referred to as a driving substrate.

The transparent substrate 3001 is not limited to any specific substrate as long as it has the required characteristics of an EL display device, e.g., transparency and mechanical strength. For example, a light-transmitting substrate such as a glass substrate or plastic substrate can be used.

The partition wall (partitioning member) 3002 has the function of isolating pixels from each other to prevent mixing of a material for the luminescent layer 3003 between adjacent pixels when the material is applied from a liquid application head. That is, the partition wall 3002 serves as a color mixing prevention wall. When this partition wall 3002 is formed on the transparent substrate 3001, at least one recess portion (pixel area) is formed on the substrate. Note that no problem arises if a member having a multilayer structure exhibiting affinity different from that of the material is used as the partition wall 3002.

The luminescent layer 3003 is formed by stacking a material that emits light when a current flows therein, e.g., a known organic semiconductor material such as polyphenylene vinylene (PPV), to a thickness enough to obtain a sufficient light amount, e.g., 0.05 μm to 0.2 μm. The luminescent layer 3003 is formed by filling recess portions surrounded by the partition wall 3002 with a thin-film material liquid (spontaneous emission material) by the ink-jet system or the like and heating the resultant structure.

The transparent electrodes 3004 are made of a material having conductivity and transparency, e.g., ITO. The transparent electrodes 3004 are independently formed in the respective pixel areas to emit light on a pixel basis.

The metal layer 3006 is formed by stacking a conductive metal material, e.g., aluminum lithium (Al—Li), to a thickness of about 0.1 μm to 1.0 μm. The metal layer 3006 is formed to serve as a common electrode opposing the transparent electrodes 3004.

The driving substrate 3007 is formed by stacking a plurality of layers, e.g., a thin-film transistor (TFT), wiring film, and insulating film (neither is shown), and designed to allow voltages to be applied between the metal layer 3006 and the transparent electrodes 3004 on a pixel basis. The driving substrate 3007 is manufactured by a known thin-film process.

According to the organic EL device having the above layer structure, in the pixel area between the transparent electrode 3004 and the metal layer 3006 between which a voltage is applied, a current flows in the luminescent layer 3003 to cause electroluminescence. As a consequence, light emerges through the transparent electrode 3004 and transparent substrate 3001.

A process of manufacturing an organic EL device will be described below.

FIGS. 38A to 38D show an example of the process of manufacturing an organic EL device. Steps A to D will be described below with reference to FIGS. 38A to 38D.

Step A

First of all, a glass substrate is used as the transparent substrate 3001, and a plurality of layers, e.g., a thin-film transistor (TFT), wiring film, and insulating film (neither is shown), are stacked on each other. The transparent electrodes 3004 are then formed on the resultant structure to allow a voltage to be applied to each pixel area.

Step B

The partition walls 3002 are formed between the respective pixels. Each partition wall 3002 serves as a mixing prevention wall for preventing mixing of an EL material solution, which is formed into a luminescent layer, between adjacent pixels when the EL material solution is applied by the ink-jet method. In this case, each partition wall is formed by a photolithography method using a resist containing a black material. However, the present invention is not limited to this, and various materials, colors, forming methods, and the like can be used.

Step C

Each recess portion surrounded by the partition walls 3002 is filled with the EL material by the ink-jet system. The resultant structure is then heated to form the luminescent layer 3003.

Step D

The metal layer 3006 is further formed on the luminescent layer 3003.

A full-color EL device can be formed by a simple process through steps A to D described above. In forming a color organic EL device, in particular, an ink-jet system capable of discharging a desired EL material to arbitrary positions can be effectively used because luminescent layers that emit light of different colors, e.g., red, green, and blue, must be formed.

In the present invention, solid portions are formed by filling recess portions surrounded by partition walls with a liquid material. The colored portions of a color filter correspond to the above solid portions, whereas the luminescent portions of an EL device correspond to the solid portions. The solid portions including the above colored portions or luminescent portions are portions (display portions) used to display information and also portions for visual recognition of colors.

The colored portions of a color filter and the luminescent portions of an EL device are portions for producing colors (generating colors), and hence can be called color producing portions. In the case of a color filter, for example, light from a backlight passes through the colored portions to produce R, G, and B light. In the case of an EL device, R, G, and B light is reproduced when the luminescent portions spontaneously emit light.

The above ink and spontaneous emission materials are materials for forming the luminescent portions, and hence can be called color producing materials. In addition, the above ink and spontaneous emission materials are liquids, and hence can be generically called a liquid material. A head having a plurality of nozzles for discharging these liquids is defined as a liquid discharge head or ink-jet head.

The present invention is not limited to the manufacture of the above color filter and EL display device, and can be applied to, for example, the manufacture of an electron-emitting device obtained by forming a conductive thin film on a substrate, and an electron source substrate, electron source, and display panel which use the electron-emitting device.

A method of manufacturing an electron-emitting device and an electron source substrate, electron source, and display panel which use the device will be described as another application of the present invention. Note that the electron-emitting device and the electron source substrate, electron source, and display panel which use the electron-emitting device are used to, for example, perform display operation of a television set.

Figure 39A:
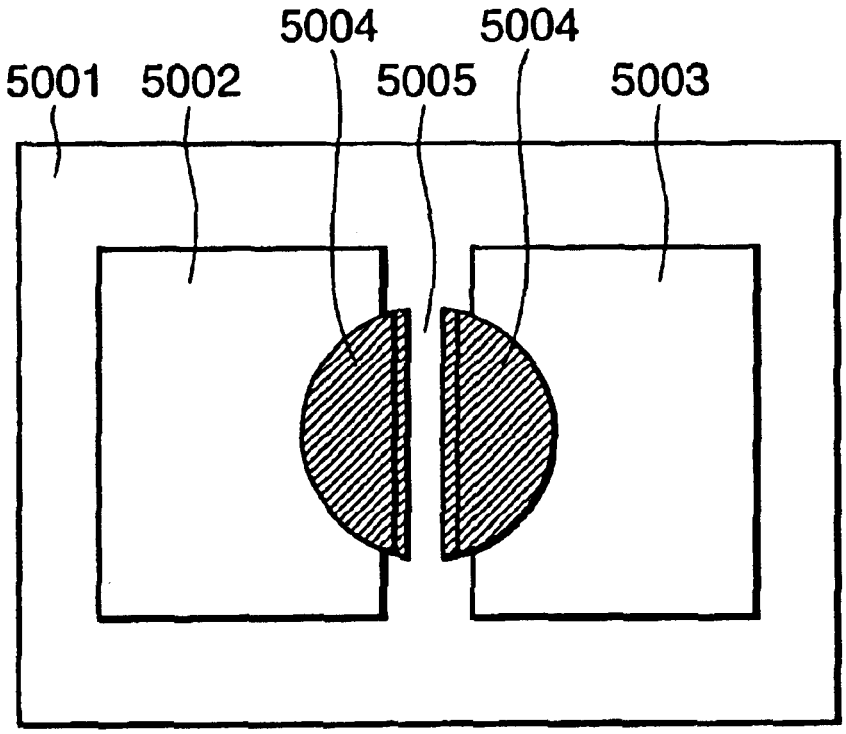
FIGS. 39A and 39B are views showing an example of the arrangement of a surface-conduction emission type electron-emitting device.
Figure 39B:
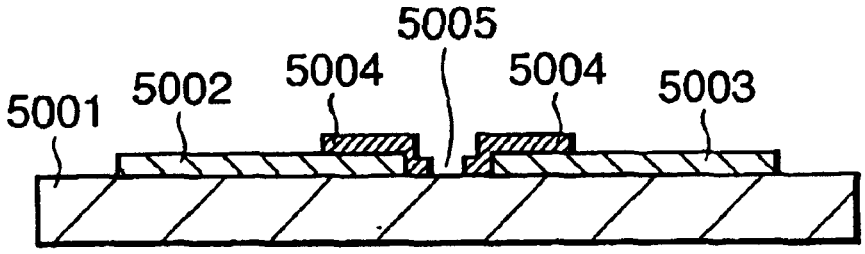

An electron-emitting device (e.g., a surface-conduction emission type electron-emitting device) used for an electron source substrate, electron source, display panel, or the like uses a phenomenon in which when a current flows in a small-area conductive thin film formed on a substrate in a direction parallel to the film surface, electron emission occurs. More specifically, a fissure is formed in advance in a portion of the conductive thin film, and a voltage is applied to the conductive thin film to flow a current therein, thereby emitting electrons from the fissure (to be referred to as the electron-emitting portion). FIGS. 39A and 39B show an example of the structure of such a surface-conduction emission type electron-emitting device.

FIGS. 39A and 39B are schematic views showing an example of the electron-emitting device (surface-conduction emission type electron-emitting device) that can be manufactured by using the manufacturing apparatus of the present invention (the manufacturing apparatus including the liquid application apparatus which has the liquid discharge head and the discharge control circuit shown in FIG. 18 and can execute the flow charts shown in FIGS. 21 and 29 to 34). FIGS. 40A to 40D are views showing an example of the process of manufacturing this surface-conduction emission type electron-emitting device.

Referring to FIGS. 39A, 39B, and 40A to 40D, reference numeral 5001 denotes a substrate; 5002 and 5003, device electrodes; 5004, a conductive thin film; 5005, an electron-emitting portion; 5007, a liquid application apparatus which has the liquid discharge head and the discharge control circuit shown in FIG. 18 and can execute the flow charts shown in FIGS. 21 and 29 to 34; 5024, a droplet of a conductive thin film material liquid discharged from the liquid application apparatus; and 5025, a conductive thin film before electroforming.

Figure 40A:
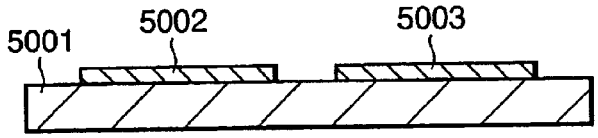
FIGS. 40A to 40D are views showing an example of the process of manufacturing a surface-conduction emission type electron-emitting device.
Figure 40B:
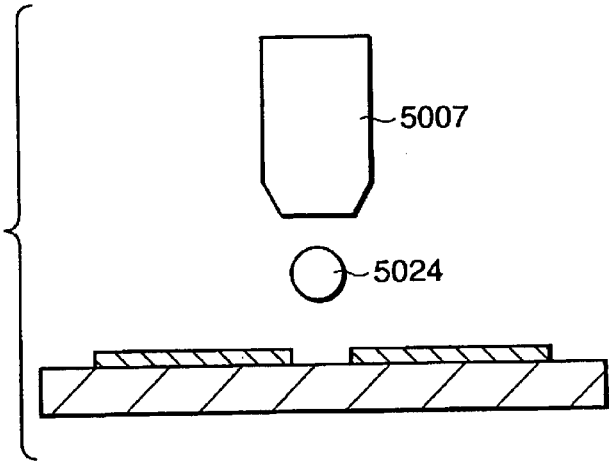
Figure 40C:
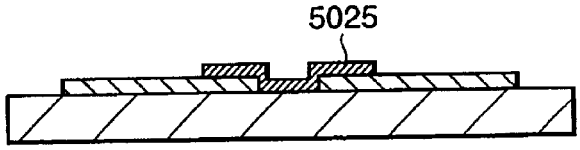
Figure 40D:
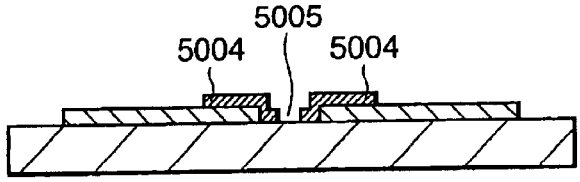

In this case, first of all, the device electrodes 5002 and 5003 are formed on the substrate 5001 at a certain distance L1 (FIG. 40A). The conductive thin film material liquid (more specifically, a liquid containing a metal element) 5024 serving as a liquid material for forming the conductive thin film 5004 is discharged from the liquid discharge head (ink-jet head) 5007 (FIG. 40B) to form the conductive thin film 5004 in contact with the device electrodes 5002 and 5003 (FIG. 40C). A fissure is then formed in the conductive thin film by, for example, a forming process (to be described later), thereby forming the electron-emitting portion 5005 (FIG. 40D).

Since a minute droplet of a liquid containing a metal element can be selectively formed at only a desired position (predetermined area) by using such a liquid application method, no material for an electron-emitting portion is wasted. In addition, there is no need to perform a vacuum process requiring an expensive apparatus or patterning by photolithography including many steps, and hence the production cost can be decreased.

Although any apparatus capable of discharging an arbitrary droplet can be used in practice as the liquid application apparatus 5007, an ink-jet apparatus is preferably used, which can control the amount of liquid within the range of ten odd ng to several ten ng and can easily discharge a droplet of a small amount of about 10 ng to several ten ng. Note that a method of manufacturing a surface-conduction emission type electron-emitting device using an ink-jet liquid application apparatus is disclosed in Japanese Patent Laid-Open No. 11-354015.

As the conductive thin film 5004, a fine-grained film is especially preferable, which is formed of fine particles, in order to obtain good electron emission characteristics. The thickness of this film is properly set in accordance with step coverage for the device electrodes 5002 and 5003, the resistance value between the device electrodes 5002 and 5003, electroforming conditions (to be described later), and the like. This thickness is preferably set to several Å to several thousand Å, and more preferably, 10 Å to 500 Å. The sheet resistance of this film is $10^3$ to $10^7$ Ω/□.

As a material for the conductive thin film 5004, one of the following materials can be used: metals such as Pd, Pt, Ru, Ag, Au, Ti, In, Cu, Cr, Fe, Zn, Sn, Ta, W, and Pb, oxides such as PdO, $SnO_2$, $In_2O_3$, PbO, and $Sb_2O_3$, borides such as $HfB_2$, $ZrB_2$, $LaB_6$, $CeB_6$, $YB_4$, and $GdB_4$, carbides such as TiC, ZrC, HfC, TaC, SiC, and WC, nitrides such as TiN, ZrN, and HfN, semiconductors such as Si and Ge, and carbon.

The fine-grained film in this case is a film formed from an aggregation of fine particles. This film includes not only a film having a fine structure in which fine particles are separately dispersed but also a film having a fine structure in which adjacent fine particles are located adjacent to each other or overlap (including a structure in which particles exist in the form of islands). The diameter of a fine particle is several Å to several thousand Å, and more preferably, 10 Å to 200 Å.

A liquid from which the droplet 5024 is formed includes a liquid obtained by dissolving the above conductive thin film material in water, a solvent, organometallic solution, or the like.

As the substrate 5001, one of the following is used: a quartz glass substrate, a glass substrate containing a small amount of an impurity such as Na, a soda-lime glass substrate, a glass substrate having $SiO_2$ formed on its surface, and a ceramic substrate made of alumina or the like.

As a material for the device electrodes 5002 and 5003, a general conductor is used; for example, one of the following materials is properly selected: metals such as Ni, Cr, Au, Mo, W, Pt, Ti, Al, Cu, and Pd or their alloys, metals or metal oxides such as Pd, Ag, Au, $RuO_2$, and Pd—Ag, printed conductors made of glass materials and the like, transparent conductors such as $In_2O_3$—$SnO_2$, and semiconductor materials such as polysilicon.

The electron-emitting portion 5005 is a high-resistance fissure formed in a portion of the conductive thin film 5004 by electroforming or the like. The fissure may contain conductive fine particles having diameters of several Å to several hundred Å. These conductive fine particles contain at least some of the elements of the material for the conductive thin film 5004. In addition, the electron-emitting portion 5005 and the nearby conductive thin film 5004 may contain carbon and carbides.

The electron-emitting portion 5005 is formed by applying an energization process called electroforming to the device constituted by the conductive thin film 5004 and device electrodes 5002 and 5003. As disclosed in Japanese Patent Laid-Open No. 2-56822, electroforming is performed by supplying a current from a power supply (not shown) to between the device electrodes 5002 and 5003 so as to locally destroy, deform, or degenerate the conductive thin film 5004, thereby forming a portion whose structure has been changed. This portion obtained by locally changing the structure of the film is called the electron-emitting portion 5005. A voltage waveform for electroforming preferably has a pulse-like shape, in particular. Electroforming is performed either by consecutively applying voltage pulses having a constant peak value or by applying voltage pulses while increasing the peak value.

When voltage pulses are to be applied while the peak value is increased, voltage pulses are applied in a proper vacuum atmosphere while the peak value (the peak voltage in electroforming) is increased in about 0.1-V steps.

In this electroforming process, a device current is measured, and a resistance value is obtained at a voltage not so high as to locally destroy/deform the conductive thin film 5004, e.g., a voltage of about 0.1 V. When, for example, the resistance becomes 1 MΩ or more, the electroforming process is terminated.

A process called an activation process is preferably applied to the device having undergone the electroforming. The activation process is a process of repeatedly applying a voltage pulse with a constant peak value in a vacuum of about $10^{-4}$ to $10^{-5}$ Torr as in electroforming. In this process, carbon and carbides originating from organic substances existing in the vacuum are deposited on the conductive thin film to greatly change a device current If and discharge current Ie. In the activation process, the device current If and discharge current Ie are measured. When, for example, the discharge current Ie is saturated, this process is terminated.

In this case, the carbon and carbides include graphite (both single crystal and polycrystal) amorphous carbon (a mixture of amorphous carbon and polycrystalline graphite). The thickness of this film is preferably 500 Å or less, and more preferably, 300 Å or less.

The electron-emitting device manufactured in this manner is preferably operated in an atmosphere with a higher vacuum than in the electroforming process and activation process. In addition, this device is preferably operated after being heated to 80° C. to 150° C. in a higher vacuum atmosphere.

Note that the vacuum higher than those in the electroforming process and activation process is, for example, about $10^{-6}$ Torr or more, and more preferably, an ultra-high vacuum, in which carbon and carbides are hardly deposited on the conductive thin film. This makes it possible to stabilize the device current If and discharge current Ie.

A flat surface-conduction emission type electron-emitting device can be manufactured in the above manner.

Figure 41:
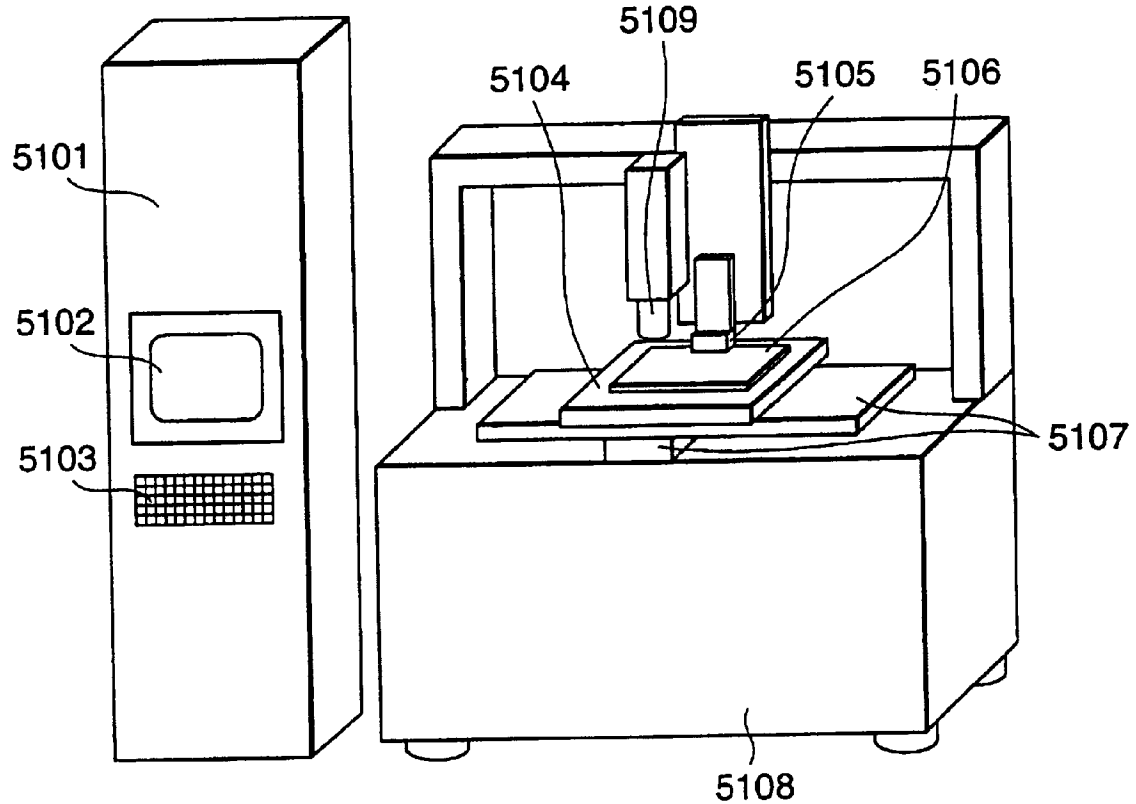
FIG. 41 is a perspective view showing a manufacturing apparatus including a liquid discharge apparatus for manufacturing a surface-conduction emission type electron-emitting device.

FIG. 41 is a perspective view of a manufacturing apparatus including a liquid discharge apparatus for manufacturing a surface-conduction emission type electron-emitting device. Referring to FIG. 41, reference numeral 5101 denotes a housing; 5102, the monitor of a personal computer housed in the housing; 5103, a personal computer keyboard or operation panel; 5104, a stage on which a substrate 5106 is mounted; 5105, a liquid discharge head 5105 (ink-jet head) for discharging a liquid to the substrate 5106 on which a surface-conduction emission type electron-emitting device is formed; 5107, an X-Y stage which can freely move in the vertical and horizontal directions to apply a droplet to an arbitrary position on the substrate 5106; 5108, a surface plate which holds the overall liquid discharge apparatus; and 5109, an alignment camera for aligning the discharge position of a droplet on the substrate 5106. The manufacturing apparatus having this arrangement is basically operated in the same manner as the color filter manufacturing apparatus described with reference to FIG. 1. Note that as an alignment method for a substrate, a conductive thin film forming method, and a forming method, the methods disclosed in Japanese Patent Laid-Open No. 11-354015 can be used.

Figure 42:
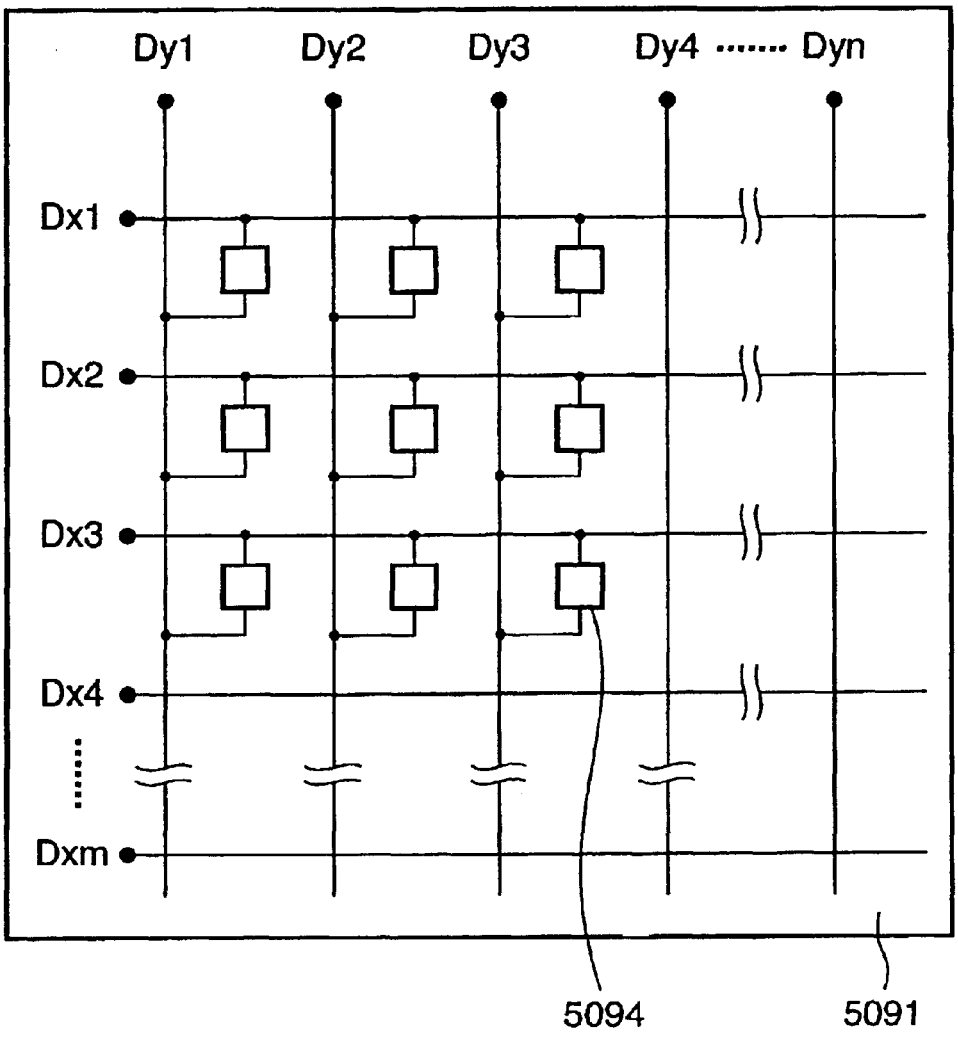
FIG. 42 is a view showing an example of a display panel including a plurality of electron-emitting devices.

A plurality of surface-conduction emission type electron-emitting devices manufactured in the above manner are arrayed on a substrate to form a display panel. FIG. 42 is a view showing a display panel 5091 including a plurality of surface-conduction emission type electron-emitting devices 5094. The plurality of surface-conduction emission type electron-emitting devices on this display panel are arranged, for example, in the form of an m (rows)×n (columns) matrix. Television display can be performed by driving the surface-conduction emission type electron-emitting devices in the display panel on the basis of an image signal (e.g., an NTSC TV signal). Note that the method disclosed in Japanese Patent Laid-Open No. 11-354015 can be used to manufacture a display panel.

By executing the above discharge amount uniformization control operation according to the present invention, the shapes of the conductive thin films of all the electron-emitting devices included in the display panel can be made uniform. If, therefore, the electron-emitting devices of display panel are manufactured by the present invention, conductive thin films forming the electron-emitting devices can be uniformly arranged. This makes it possible to manufacture a display panel with high image quality.

As has been described above, according to the above embodiments, the amounts of liquid discharged from the respective nozzles of the liquid discharge head can be made uniform. In addition, the amount of liquid discharged from each nozzle can be independently changed.

Furthermore, since the amount of liquid applied to each predetermined area (e.g., each pixel) on a substrate can be easily controlled to a predetermined amount, a display device panel such as a high-quality color filter in which the amount of liquid discharged to each predetermined area (pixel) is made uniform, or an EL display device, electron-emitting devices, or a display panel including the devices can be manufactured.

As many apparently widely different embodiments of the present invention can be made without departing from the spirit and scope thereof, it is to be understood that the invention is not limited to the specific embodiments thereof except as defined in the appended claims.

What is claimed is:

1. A liquid discharge apparatus for discharging a liquid to a medium using a liquid discharge head having a plurality of nozzles for discharging the liquid, comprising:

a voltage control device which can independently change respective driving voltage values of respective driving pulses to be supplied to each of the plurality of nozzles, wherein said voltage control device changes a driving voltage value so as to correct a liquid discharge amount change caused by a change in at least one of conditions including a combination of nozzles to be used for performing a liquid discharge operation to a sheet of the medium, the number of nozzles to be used for performing a liquid discharge operation to a sheet of the medium, a liquid discharge timing from the nozzle, a direction of relative movement of the head and the medium, and a speed of the relative movement of the head and the medium.

2. A liquid discharge method of discharging a liquid to a medium using a liquid discharge head having a plurality of nozzles for discharging the liquid, comprising:

a step of discharging the liquid from the liquid discharge head which has only nozzles connected to a voltage control device which can independently change respective driving voltage values of respective driving pulses to be supplied to each of the plurality of nozzles, wherein the voltage control device changes a driving voltage value so as to correct a liquid discharge amount change caused by a change in at least one of conditions including a combination of nozzles to be used for performing a liquid discharge operation to a sheet of the medium, the number of nozzles to be used for performing a liquid discharge operation to a sheet of the medium, a liquid discharge timing from the nozzle, a direction of relative movement of the head and the medium, and a speed of the relative movement of the head and the medium.

3. A panel manufacturing apparatus for manufacturing a panel used for a display device by discharging, onto a substrate, a liquid from a liquid discharge head having a plurality of nozzles for discharding the liquid, comprising:

a voltage control device which can change a driving voltage value of a driving pulse to be supplied to each of the plurality of nozzles, wherein said voltage control device changes the driving voltage value so as to correct a liquid discharge amount change caused by a change in at least one of conditions including a combination of nozzles to be used for performing a liquid discharge operation to a sheet of the substrate, the number of nozzles to be used for performing a liquid discharge operation to a sheet of the substrate, a liquid discharge timing from the nozzle, a direction of relative movement of the head and the substrate, and a speed of the relative movement of the head and the substrate.

4. A panel manufacturing method of manufacturing a panel used for a display device by discharging, onto a susbstrate, a liquid from a liquid discharge head having a plurality of nozzles for discharging the liquid, wherein the panel is manufactured by discharging the liquid from the liquid discharge head having only nozzles connected to a voltage control device which can change a driving voltage value of a driving pulse to be supplied to a nozzle, and wherein the voltage control device changes the driving voltage value so as to correct a liquid discharge amount change caused by a change in at least one of conditions including a combination of nozzles to be used for performing a liquid discharge operation to a sheet of the substrate, the number of nozzles to be used for performing a liquid discharge operation to a sheet of the substrate, a liquid discharge timing from a nozzle, a direction of relative movement of the head and the substrate, and a speed of the relative movement of the head and the substrate.

5. The method according to claim 4, wherein the panel comprises a color filter manufactured by discharging ink as the liquid from the liquid discharge head to a pixel area on the substrate, the pixel area being partitioned by a black matrix.

6. The method according to claim 4, wherein the panel comprises an electroluminescence device manufactured by discharging an electroluminescence material as the liquid from the liquid discharge head to a pixel area on the substrate.

7. The method according to claim 4, wherein the panel comprises an electron-emitting device manufactured by discharging a conductive thin film material as the liquid discharge head to the substrate.

8. The method according to claim 4, wherein the panel comprises a display panel including a plurality of electron-emitting devices manufactured by discharging a conductive thin film material as the liquid from the liquid discharge head to the substrate.

9. A color filter manufacturing method for manufacturing a color filter by discharging a liquid, to a substrate, from a liquid discharge head having a plurality of nozzles including a predetermined nozzle whose liquid discharge amount can be changed, wherein a discharge amount control device changes a liquid discharge amount of the predetermined nozzle by changing at least one of a voltage value and pulse width of a driving pulse to be supplied to the pretermined nozzle in accordance with a change in a discharging condition for adjacent nozzles adjacent to the predetermined nozzle.

10. The method according to claim 9, wherein the discharge amount control device changes at least one of the voltage value and the pulse width of the driving pulse to be supplied to the predetermined nozzle depending on whether or not the liquid is discharged from the adjacent nozzle at substantially the same timing as a discharge timing of the predetermined nozzle.

11. The method according to claim 9, wherein when the predetermined nozzle is a nozzle B, and the adjacent nozzles are nozzles A and C, said discharge amount control device changes at least one of the voltage value and the pulse width of the driving pulse to be supplied to the nozzle B if one of the discharging conditions is changed, the discharging conditions being associated with whether a liquid is discharged from at least one of the nozzles A and C at substantially the same time as the nozzle B, a liquid is discharged from at least one of the nozzles A and C at a time so near to a discharge time of the nozzle B as to influence the liquid discharge amount of the nozzle B, or no liquid is discharged from either of the nozzles A and C at the time near the discharge timing of the nozzle B.

12. The method according to claim 9, wherein the discharge amount control device changes at least one of the voltage value and the pulse width of the driving pulse to be supplied to the predetermined nozzle so as to keep the liquid discharge amount of the predetermined nozzle unchanged when the discharging condition for the adjacent nozzles is changed.

13. The method according to claim 9, wherein when the number of nozzles to be used is changed, the discharge amount control device changes at least one of the voltage value and the pulse width of the driving pulse to be supplied to the predetermined nozzle located at an end portion among the nozzles to be used.

14. The method according to claim 9, wherein when a combination of nozzles to be used is changed, said discharge amount control device changes at least one of the voltage value and the pulse width of the driving pulse to be supplied to the predetermined nozzle, adjacent nozzles of which have undergone a change in a use state.

15. The method according to claim 9, wherein when the predetermined nozzle of the plurality of nozzles of the liquid discharge head becomes a faulty nozzle, and a combination of nozzles to be used changes as use of the predetermined nozzle is inhibited, the discharge amount control device changes at least one of the voltage and the pulse width of the driving pulse to be supplied to the adjacent nozzles on both sides of the predetermined nozzle.

16. The method according to claim 9, wherein when a discharge timing of the predetermined nozzle of the plurality of nozzles of the liquid discharge head is shifted, the discharge amount control device changes at least one of the voltage value and the pulse width of the driving pulse to be supplied to the predetermined nozzle and changes at least one of the voltage value and the pulse width of the driving pulse to be supplied to the adjacent nozzles on both sides of the predetermined nozzle.

17. A liquid discharge method of discharging a liquid, to a medium, from a liquid discharge head having a plurality of nozzles including a nozzle whose liquid discharge amount can be changed, comprising:

a step of changing at least one of a voltage value and a pulse width of a driving pulse to be supplied to the nozzle so as to correct a change of the liquid discharge amount caused by a change in at least one of conditions including a combination of nozzles to be used for performing a liquid discharge operation to a sheet of the medium, the number of nozzles to be used for performing a liquid discharge operation to a sheet of the medium, a liquid discharge timing from the nozzle, a direction of relative movement of the head and the medium, and a speed of the relative movement of the head and the medium.

18. A panel manufacturing method of manufacturing a panel used for a display device by discharging a liquid, to a substrate, from a liquid discharge head having a plurality of nozzles including a nozzle whose liquid discharge amount can be changed, comprising:

a step of changing at least one of a voltage value and a pulse width of a driving pulse to be supplied to the nozzle so as to correct a change of the liquid discharge amount caused by a change in at least one of the conditions including a combination of nozzles to be used for performing a liquid discharge operation to a sheet of the substrate, the number of nozzles to be used for performing a liquid discharge operation to a sheet of the substrate, a liquid discharge timing from the nozzle, a direction of relative movement of the head and the substrate, and a speed of the relative movement of the head and the substrate.

19. The method according to claim 18, wherein the panel comprises a color filter.

20. The method according to claim 18, wherein the panel comprises an electroluminescence device.

21. The method according to claim 18, wherein the panel comprises a plurality of electron-emitting devices having thin conductive film portions.

22. A color filter manufacturing method which manufactures a color filter by discharging a liquid, to a substrate, from a liquid discharge head having a plurality of nozzles including a nozzle whose liquid discharge amount can be changed, comprising:

a step of changing at least one of a voltage value and a pulse width of a driving pulse to be supplied to the nozzle so as to correct a change of the liquid discharge amount caused by a change in at least one of conditions including a combination of nozzles to be used for performing a liquid discharge operation to a sheet of the substrate, the number of nozzles to be used for performing a liquid discharge operation to a sheet of the substrate, a liquid discharge timing from the nozzle, a direction of relative movement of the head and the substrate, and a speed of the relative movement of the head and the substrate.

23. A method of manufacturing a liquid crystal display panel having a color filter, comprising the steps of:

providing a color filter manufactured by the method according to claim 22, and inserting a liquid crystal compound into a space between the color filter and a counter substrate.

24. A method of manufacturing an apparatus having a liquid crystal display panel, comprising the steps of:

providing a liquid crystal display panel manufactured by the method according to claim 23, and connecting the liquid crystal display panel to a signal supply means which supplies the signal to the liquid crystal display panel.

25. A panel manufacturing method of manufacturing a panel used for a display device by discharging a liquid, to a substrate, from a liquid discharge head having a plurality of nozzles including a nozzle whose liquid discharge amount can be changed comprising:

a step of changing at least one of a voltage value and a pulse width of a driving pulse to be supplied to the predetermined nozzle in accordance with a change in a discharging condition for at least one nozzle adjacent to the predetermined nozzle.

26. The method according to claim 25, wherein the discharging condition includes at least one of conditions including a combination of nozzles to be used for performing a liquid discharge operation to a sheet of the substrate, the number of nozzles to be used for performing a liquid discharge operation to a sheet of the substrate, a liquid discharge timing from the nozzle, a direction of relative movement of the head and the substrate, and a speed of the relative movement of the head and the substrate.

27. The method according to claim 25, wherein the panel comprises a color filter.

28. The method according to claim 25, wherein the panel comprises an electroluminescence device.

29. The method according to claim 25, wherein the panel comprises a plurality of electro-emitting devices having conductive thin film portions.

30. A color filter manufacturing method which manufactures a color filter by discharging a liquid, to a substrate, from a liquid discharge head having a plurality of nozzles including a nozzle whose liquid discharge amount can be changed, comprising:

changing at least one of a voltage value and a pulse width of a driving pulse to be supplied to a predetermined nozzle in accordance with a change in a discharging condition for at least one nozzle adjacent to the predetermined nozzle, wherein the discharging condition includes at least one of conditions including a combination of nozzles to be used for performing a liquid discharge operation to a sheet of the substrate, the number of nozzles to be used for performing a liquid discharge operation to a sheet of the substrate, a liquid discharge timing from the nozzle, a direction of relative movement of the head and the substrate, and a speed of the relative movement of the head and the substrate.

31. A method of manufacturing a liquid crystal display panel having a color filter, comprising the steps of:

providing the color filter manufactured by the method according to claim 30; and inserting a liquid crystal compound into a space between the color filter and a counter substrate.

32. A method of manufacturing an apparatus having a liquid crystal display panel comprising the steps of:

providing the liquid crystal display panel manufactured by the method according to claim 31; and connecting the liquid crystal display panel to a signal supply means which supplies the signal to the liquid crystal display panel.

* * * * *

UNITED STATES PATENT AND TRADEMARK OFFICE

CERTIFICATE OF CORRECTION

PATENT NO. : 7,111,755 B2
APPLICATION NO. : 10/607513
DATED : September 26, 2006
INVENTOR(S) : Koyama et al.

It is certified that error appears in the above-identified patent and that said Letters Patent is hereby corrected as shown below:

ON THE TITLE PAGE, AT ITEM (56), REFERENCES CITED:
U.S. PATENT DOCUMENTS, insert:

| | | |
|---|---|---|
| --6,692,095 B1 | 2/2004 | Marumoto et al. |
| 5,936,644 | 8/1999 | Ono et al. |
| 2002/0167560 A1 | 11/2002 | Fujimori |
| 6,503,116 B1 | 1/2003 | Suzuki et al. |
| 6,839,312 B2 | 1/2005 | Heylen et al. |
| 2002/0145639 A1 | 10/2002 | Masuda et al.--. |

ON THE TITLE PAGE, AT ITEM (56), REFERENCE CITED:
FOREIGN PATENT DOCUMENTS, insert:

| | | |
|---|---|---|
| --1998-041649 | 8/1998 | Korea |
| 2000-043269 | 2/2000 | Japan |
| 2001-0082374 | 8/2001 | Korea |
| 2002-0007368 | 01/2002 | Korea--. |

Figure 11:
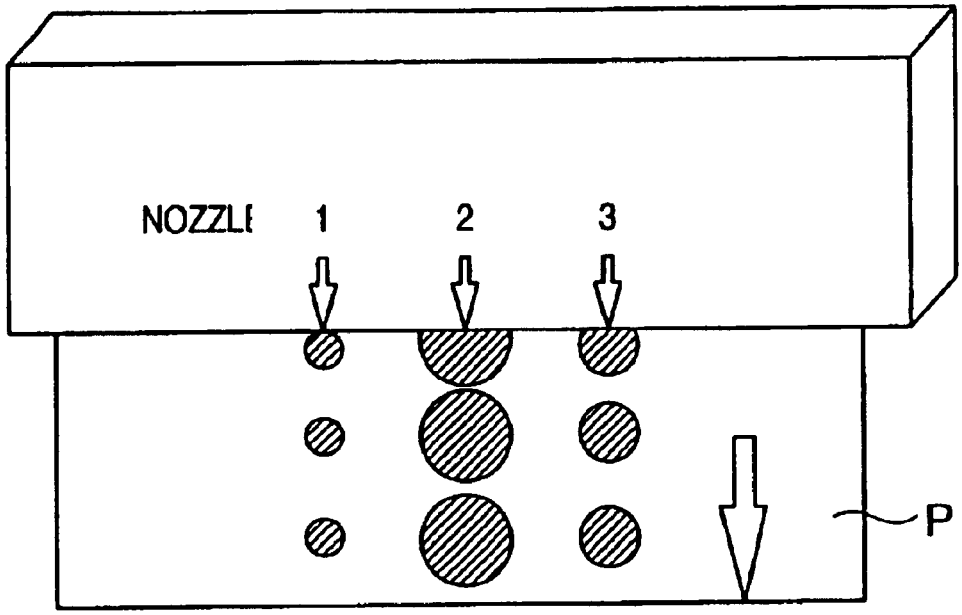
FIG. 11 is a view for explaining a conventional method of reducing density unevenness among the respective pixels of a color filter.
Figure 12:
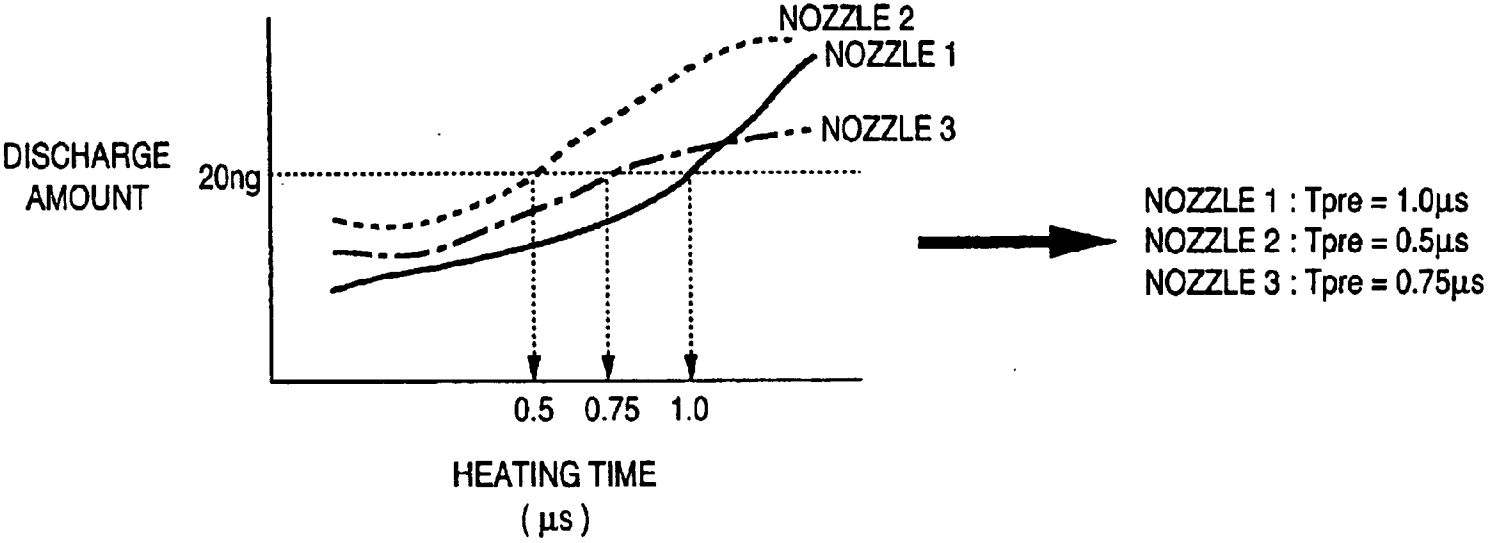
FIG. 12 is a view for explaining the conventional method of reducing density unevenness among the respective pixels of a color filter.
Figure 13:
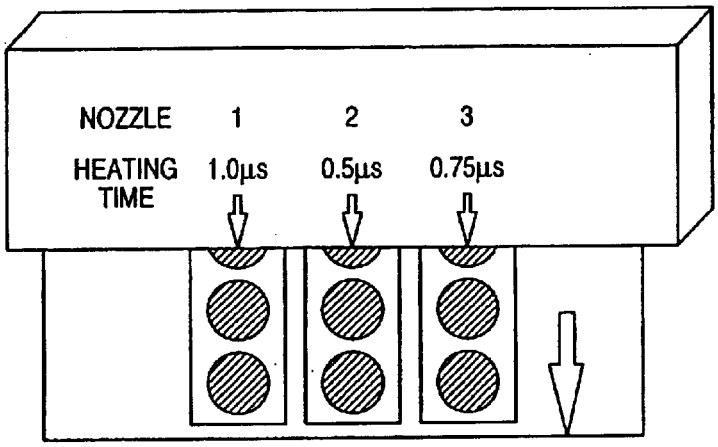
FIG. 13 is a view for explaining the conventional method of reducing density unevenness among the respective pixels of a color filter.
Figure 14:
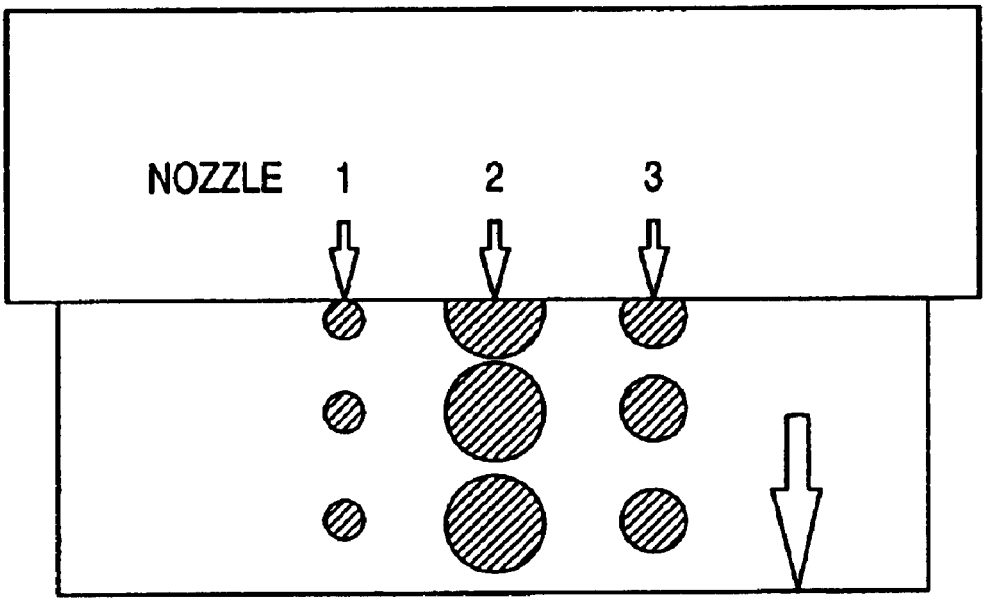
FIG. 14 is a view for explaining another conventional method of reducing density unevenness among the respective pixels of a color filter.
Figure 15:
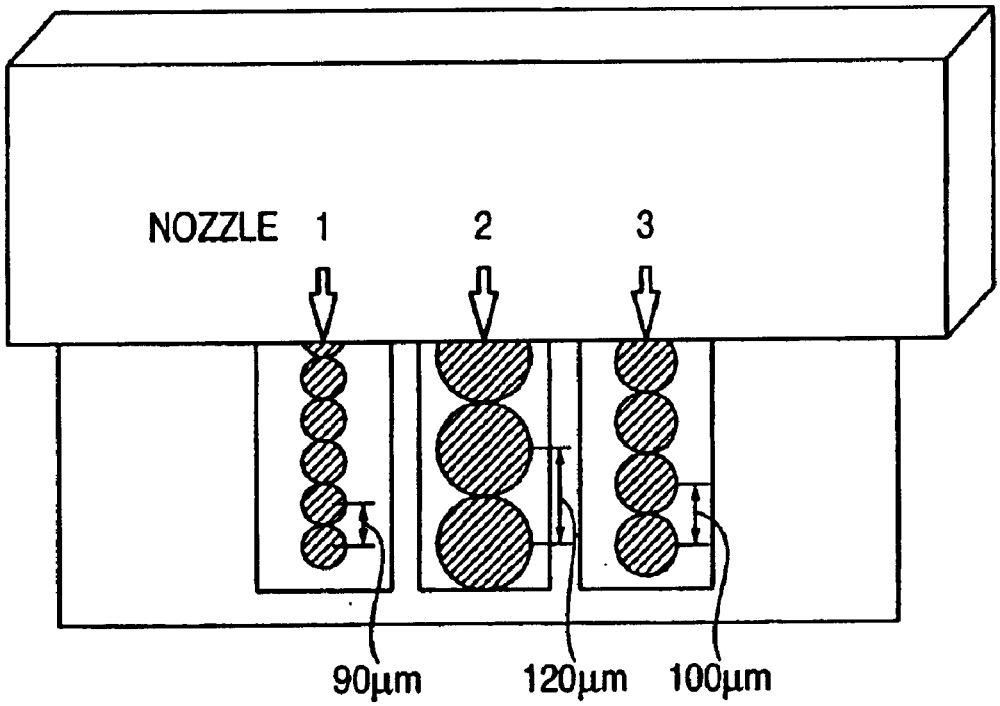
FIG. 15 is a view for explaining the conventional method of reducing density unevenness among the respective pixels of a color filter.

SHEET NO. 11 of 42:
Figure 11, “NOZZL” should read --NOZZLE--.

SHEET NO. 34 of 42:
Figure 34, “FIST” should read --FIRST--.

SHEET NO. 35 of 42:
Figure 35, “COUN T:40” should read --COUNT:40--.

COLUMN 6:
Line 2, “of” should read --or--.

COLUMN 13:
Line 27, “and” should read --or--.

COLUMN 22:
Line 21, “514.” should read --S514.--.

UNITED STATES PATENT AND TRADEMARK OFFICE

CERTIFICATE OF CORRECTION

PATENT NO. : 7,111,755 B2
APPLICATION NO. : 10/607513
DATED : September 26, 2006
INVENTOR(S) : Koyama et al.

It is certified that error appears in the above-identified patent and that said Letters Patent is hereby corrected as shown below:

COLUMN 32:
Line 51, “discharding” should read --discharging--.

COLUMN 33:
Line 30, “liquid” should read --liquid from the--.
Line 53, “nozzle” should read --nozzles--.

COLUMN 34:
Line 27, “voltage” should read --voltage value--.
Line 63, “of the” should read --of--.

COLUMN 35:
Line 47, “changed” should read --changed,--.

COLUMN 36:
Line 15, “electro-emitting” should read --electron-emitting--.
Line 40, “claim 30; and” should read --claim 30, and--.
Line 47, “claim 31; and” should read --claim 31, and--.

Signed and Sealed this

First Day of April, 2008

JON W. DUDAS
*Director of the United States Patent and Trademark Office*